US005701553A

United States Patent [19]

Endo et al.

[11] Patent Number: 5,701,553

[45] Date of Patent: Dec. 23, 1997

[54] MULTI-COLOR IMAGE FORMING APPARATUS HAVING HIGH DEVELOPABILITY WITHOUT FOGGING AND WITHOUT MIXING OF COLORS

[75] Inventors: Isao Endo; Toru Komatsu; Yotaro Sato; Hiroyuki Nomori; Kunio Shigeta; Masahiro Onodera, all of Hachioji, Japan

[73] Assignee: Konica Corporation, Tokyo, Japan

[21] Appl. No.: 506,389

[22] Filed: Jul. 24, 1995

[30] Foreign Application Priority Data

Sep. 8, 1994 [JP] Japan ..... 6-214811
Oct. 7, 1994 [JP] Japan ..... 6-244059

[51] Int. Cl.[6] ..... G03G 15/06

[52] U.S. Cl. ..... 399/55; 399/266; 399/291

[58] Field of Search ..... 355/208, 245, 355/261, 263, 265, 326 R; 118/647, 649; 399/38, 53, 55, 252, 222, 265, 267, 270, 285, 266, 290, 291

[56] References Cited

U.S. PATENT DOCUMENTS

| | | | |
|---|---|---|---|
| 5,119,147 | 6/1992 | Hays | 355/326 R |
| 5,339,142 | 8/1994 | Hays | 355/261 X |
| 5,428,428 | 6/1995 | Haneda | 355/261 X |
| 5,473,416 | 12/1995 | Endou et al. | 118/647 X |
| 5,519,472 | 5/1996 | Ojima et al. | 355/265 X |

FOREIGN PATENT DOCUMENTS

| | | |
|---|---|---|
| 59-223467 | 12/1984 | Japan . |
| 61-67876 | 4/1986 | Japan . |
| 5-346736 | 12/1993 | Japan . |

*Primary Examiner*—Sandra L. Brase
*Attorney, Agent, or Firm*—Frishauf, Holtz, Goodman, Langer & Chick

[57] ABSTRACT

A development apparatus for developing a latent image formed on an image forming body with a developer so as to obtain a toner image. A developer conveyance unit conveys the developer, including a toner, to a development zone, between the developer conveyance unit and the image forming body, from an upstream side of the development zone in a conveyance direction to a downstream side thereof. A plate member having an electrode portion is positioned at the upstream side of the development zone, wherein a downstream end portion of the plate member is positioned in contact with the development zone. A power supply unit applies a first voltage, including a DC component and an AC component, to the developer conveyance unit so that an electric field is generated at the development zone. The power supply unit applies a second voltage, including a DC component, to the electrode portion of the plate member, and the plate member controls the electric field with the second voltage. The development apparatus satisfies: $V_{AC}>|V_{DEN}|-|V_{DC}|$ when an amplitude of the AC component of the first voltage is defined as $V_{AC}$ (volts), the DC component of the first voltage is defined as $V_{DC}$ (volts), and the DC component of the second voltage is defined as $V_{DEN}$ (volts). The development apparatus satisfies: $10\cdot|Qt|\cdot d_t\cdot D_1>V_{AC}>5\cdot|Qt|\cdot d_t\cdot D_2$ when a closest distance from the developer conveyance unit to the image forming body is defined as $D_1$ (mm), a closest distance from the developer conveyance unit to the electrode portion is defined as $D_2$ (mm), an average charge-to-mass of the toner is defined as Qt (μC/g), and an average particle size of the toner is defined as dt (μm).

36 Claims, 10 Drawing Sheets

MULTI-COLOR IMAGE FORMING APPARATUS HAVING HIGH DEVELOPABILITY WITHOUT FOGGING AND WITHOUT MIXING OF COLORS

BACKGROUND OF THE INVENTION

The present invention relates to a developing apparatus for developing a latent image on an image forming body and an image forming apparatus for forming an image, using an electrophotographic method. The present invention specifically relates to a developing apparatus in which: a plate member, having an electrode portion at a position where the image forming body is opposed to the developer conveyance body, or a wire electrode is provided; a DC voltage is impressed upon the electrode portion or the wire electrode, an AC voltage component and a DC voltage component are impressed upon the developer conveyance body, the latent image on the image forming body is reversally developed when toner is scattered under an oscillation electric field; and relates to an image forming apparatus for forming a multi-color image in which a plurality of developing apparatus are provided, and a process for forming the latent image on the image forming body and a process for developing the latent image are repeated a plurality of times for forming a multi-color image.

Conventionally, as an image forming apparatus for developing a latent image on the image forming body and for forming a multi-color image, using an electrophotographic method, there exists on the market an image forming body in which processes for charging, exposing, developing and transferring are repeated a plurality of times, and a multi-color image is formed by superimposing a plurality of toner images onto a transfer sheet. This image forming apparatus has a disadvantage in which it is necessary to provide a mechanism for holding a transfer sheet inside the apparatus because a toner image is transferred onto the transfer sheet at each completion of development of each color, resulting in an apparatus which becomes larger.

In contrast to this, there exists on the market an image forming apparatus in which processes for charging, exposing and developing are repeated a plurality of times, a plurality of toner images are superimposed on the same image forming body and developed, and a plurality of toner images on the image forming body are collectively transferred onto a transfer sheet and a multi-color image is formed. In this image forming apparatus, a so-called toner image superimposition development simultaneous transfer method is adopted. Accordingly, the following advantage is provided: it is not necessary to provide a mechanism for holding the transfer sheet inside the apparatus, and thereby, dimensions of the apparatus can be made smaller.

This image forming apparatus is preferable, for example, in the following point: a developing apparatus is used in which: a developer layer on the developer conveyance body is not in contact with the image forming body; an AC voltage including a DC component is impressed upon the developer conveyance body, and toner is scattered under an oscillation electric field for developing the latent image on the image forming body, and since the developing process is carried out without contact between the developer layer and the image forming body, the relatively large amount of the preceding toner having adhered onto the image forming body is not mixed into the following developing apparatus in which the different color toner is accommodated.

Sometimes, however, the following problem occurs: in this type of superimposition development, since the latent image on the image forming body is non-contact developed, it is difficult to accurately reproduce fine lines or dots, or density differences, and thereby it is difficult to obtain the desired high image quality. Further, the following problem sometimes occurs: since toner is scattered for development onto the image forming body on which the toner image has already been formed, so-called mixing of color occurs in which excessive following toner adheres onto the preceding toner image.

Generally, it is effective to granulate toner more finely in order to obtain a higher quality image. However, in the case where toner is finely granulated as in the above-described superimposition development, it is necessary to increase the AC voltage, which is impressed upon the developer conveyance body, in order to obtain the desired image density. On the other hand, the more an AC voltage is increased, the more often the above-described mixing of color occurs. Further, fogging toner also adheres to a background portion. As a result, it is difficult to obtain the desired high image quality by finely granulating toner in the superimposition development.

In this connection, for example, the following developing method is disclosed in Japanese Patent Publication Open to Public Inspection No. 223467/1984: a wire-shaped control electrode to control toner scattering is provided in a gap between the image forming body and the developer layer on the developer conveyance body; an AC voltage is impressed upon either of the control electrode and the developer conveyance body, and an oscillation electric field is formed; and toner is made to scatter and development is carried out. In the publication, the following is described: fine toner particles can be used for toner for the two-component developer, and fogging can be prevented, and thereby, the desired clear image quality can be obtained.

Further, in Japanese Patent Publication Open to Public Inspection No. 67876/1986, the following developing apparatus is disclosed: plural wire electrodes are provided parallel at the same interval facing against the image forming surface; the toner cloud is introduced between the image forming surface and the wire electrodes so as to develop the latent image on the image forming body. In the publication, the following facts are disclosed: it is preferable to impress an AC voltage rather than a DC voltage upon the wire electrode for realizing a uniform development; the preferable range of the AC voltage is $V_{pp}$=600–3000V and f=50–2500 Hz; and it is possible to control a developing density and a fogging density by choosing the frequency of the impressing voltage and impressing the DC voltage component.

Further, the following developing apparatus is disclosed in Japanese Patent Publication Open to Public Inspection No. 346736/1993: a plate member having an electrode is provided at an upstream portion of the development zone, in which the image forming body is opposed to the developer conveyance body, in such a manner that the plate member is in contact with the developer conveyance body; the first oscillation electric field is formed between the electrode and the developer conveyance body; the second oscillation electric field is formed between the image forming body and the developer conveyance body; and toner is scattered for development. In this publication, the following is described: even when small diameter particle toner of average particle size of not more than 10 μm is used, the desired high image quality can be obtained; mixing of color does not occur even in an image forming apparatus in which the superimposition development.simultaneous transfer method is adopted; and the development efficiency is higher and uniform development can be carried out.

However, even when the developing apparatus described in the publication is used, the following are problems: the desired developability can not be obtained, fogging occurs in the background portion, mixing of colors occurs at the time of superimposition development, and the high quality image can not always be obtained, depending on: the position at which the wire electrode or the plate member with the electrode is positioned; the bias voltage to be impressed upon the electrode and the developer conveyance body; the surface potential voltage of the image forming body; the average charge amount or an average particle size of toner to be used, etc.

SUMMARY OF THE INVENTION

An objective of the present invention is to solve the above-described problems, and to provide an image forming apparatus in which the developability is higher and no fogging occurs in the background portion, even when small diameter toner is used in the developer, and further, no mixing of colors occurs even when multi-color toner images are superimposed and developed, and excellent development can be conducted.

Another objective of the present invention is to provide an image forming apparatus in which a multi-color image with a higher image quality, a higher density and no mixing of color, can be obtained even when superimposition development simultaneous transfer method is adopted in the apparatus.

As a result of consideration for attaining the above objectives, the present invention was completed as follows. An image forming apparatus for forming a multi-color image is structured as follows: a plate member having an electrode portion is positioned on the upstream side in the direction of movement of a developer conveyance body in a development zone in which the image forming body is opposed to the developer conveyance body; a DC voltage is impressed upon the electrode portion; an AC voltage, including a DC voltage component, is impressed upon the developer conveyance body; a plurality of developing apparatus, in which toner is scattered under an oscillation electric field and a latent image on the image forming body is developed, are provided; and a multi-color image is formed when a process for forming a latent image on the image forming body and a process for developing the latent image are repeated a plurality of times. In the image forming apparatus, the following points were found and the present invention has been completed.

(A) When the oscillation electric field formed in a gap between the electrode portion and the developer conveyance body is strengthened, generation of the toner cloud is accelerated, so that higher developability can be obtained.

(B) On the other hand, when the oscillation electric field formed in the gap between the image forming body and the developer conveyance body is strengthened, fogging is generated in the background portion, and the mixing of colors at the time of superimposition development is increased.

(C) In the case where the force of the DC electric field formed in the gap between the electrode portion and the developer conveyance body pushes toner onto the developer conveyance body side, the DC electric field is strengthened, the generation of the toner cloud is suppressed, and fogging in the background portion and the mixing of color at the superimposition development are also suppressed, however, higher developability can not be obtained.

(D) Reversely, in the case where the force of the DC electric field accelerates the toner, when the DC electric field is strengthened, the toner speed at the end portion of the plate member having the electrode portion is increased on the downstream side in the moving direction of the developer conveyance body, and higher developability is obtained in the solid portion, however, fogging is generated in the background portion and the mixing of colors is increased.

(E) When the strength of the oscillation field formed in the gap between the electrode portion and the developer conveyance body is weaker than that of the DC electric field in the gap, and when the force of the DC electric field pushes toner onto the developer conveyance body side, the toner is pushed onto the developer conveyance body side and the generation of toner cloud is suppressed, so that the desired higher developability can not be obtained.

(F) In the superimposition development, when the strength of the oscillation electric field formed in the gap between the image forming body and the developer conveyance body in each development process is strengthened more than that of the oscillation electric field in the preceding development process, the toner image formed in the preceding process is damaged in the succeeding development process and the mixing of color is increased.

The above-described objective is attained by the following development apparatus. A development apparatus is structured as follows: a plate member having an electrode portion is provided on the upstream side in the moving direction of a developer conveyance body, in a development zone in which an image forming body is opposed to the developer conveyance body; a DC voltage is impressed upon the electrode portion; a composite voltage of an AC component and a DC component is impressed upon the developer conveyance body; and toner is made to fly under the oscillation electric field, and a latent image on the image forming body is developed. Further, the developing apparatus is characterized by the following arithmetical relationships:

When the amplitude of an AC component to be impressed upon the developer conveyance body is defined as $V_{AC}$ [V], the DC voltage component is defined as $V_{DC}$ [V], and the DC voltage to be impressed upon the electrode portion is defined as $V_{DEN}$ [V], $$V_{AC}>|V_{DEN}|-|V_{DC}|$$

and, when the closest distance between the image forming body and the developer conveyance body is defined as $D_1$ [mm], the closest distance between the electrode portion and the developer conveyance body is defined as $D_2$ [mm], the average charge amount of the toner is defined as $Q_t$ [μC/g], and the average particle size is d [μm], $$10\cdot|Q_t|\cdot d\cdot D_1>V_{AC}>5\cdot|Q_t|\cdot d\cdot D_2$$

Further, the above-described objective is attained by the following development apparatus. In the development apparatus structured as follows: the plate member having an electrode portion is provided on the upstream side in the moving direction of the developer conveyance body, in the development zone in which an image forming body is opposed to the developer conveyance body; a DC voltage is impressed upon the electrode portion; a composite voltage of an AC component and a DC component is impressed upon the developer conveyance body; and toner is made to fly under the oscillation electric field, and a latent image on the image forming body is developed, the developing apparatus is characterized by the following arithmetical relationships:

When the amplitude of the AC component to be impressed upon the developer conveyance body is defined as $V_{AC}$ [V], the DC voltage component is defined as $V_{DC}$ [V], and the DC voltage to be impressed upon the electrode portion is defined as $V_{DEN}$ [V], $$V_{AC}>|V_{DEN}|-|V_{DC}|$$

and, when the closest distance between the image forming body and the developer conveyance body is defined as $D_1$ [mm], the closest distance between the end portion of the plate member, on the downstream side in the moving direction of the developer conveyance body, and the developer conveyance body is defined as $D_3$ [mm], the latent image electric potential at the solid portion on the image forming body is defined as $V_L$ [V], and the latent image electric potential at the background portion is defined as $V_H$ [V], then, $$|V_H|>|V_{DC}|>|V_L|,$$

and $$|V_{DC}|+(|V_{DC}-V_L|)\cdot D_3/D_1>|V_{DEN}|>|V_{DC}|-(|V_H-V_{DC}|)\cdot(1-D_3/D1)$$

Still further, the above objective is attained by the following image forming apparatus structured as follows. A plurality of developing apparatus in which: a plate member having an electrode portion is provided on the upstream side in the moving direction of a developer conveyance body, in a development zone in which an image forming body is opposed to the developer conveyance body; a DC voltage is impressed upon the electrode portion; a composite voltage of an AC component and a DC component is impressed upon the developer conveyance body; and toner is made to fly under the oscillation electric field, and a latent image on the image forming body is developed, are provided in the image forming apparatus. In the image forming apparatus, a process for forming a latent image on the image forming body, and a process for developing the latent image are repeated a plurality of times for forming a multi-color image. The apparatus is further characterized by the following arithmetic relationships: when the amplitude of the AC voltage to be impressed upon the developer conveyance body is defined as $V_{AC}$ [V], the DC voltage component is defined as $V_{DC}$ [V], and the DC voltage to be impressed upon the electrode portion is defined as $V_{DEN}$ [V], and when the closest distance between the image forming body and the developer conveyance body is defined as $D_1$ [mm], the closest distance between the electrode portion and the developer conveyance body is defined as $D_2$ [mm], the average charge amount of the toner is defined as $Q_t$ [μC/g], and the average particle size is defined as $d_t$ [μm], in each developing process, then, $$V_{AC}>|V_{DEN}|-|V_{DC}|$$

and, $$10\cdot|Q_t|\cdot d\cdot D_1>V_{AC}>5\cdot|Q_t|\cdot d\cdot D_2$$

and the image forming apparatus is still further characterized in that: the strength of the oscillation electric field formed in the gap between the image forming body and the developer conveyance body in each current developing process, is equal to, or weaker than, that of the oscillation electric field in the gap formed between the image forming body and the developer conveyance body in the preceding developing process.

Yet further, the above objective is attained by the following image forming apparatus structured as follows. A plurality of developing apparatus in which: a plate member having an electrode portion is provided on the upstream side in the moving direction of a developer conveyance body, in a development zone in which an image forming body is opposed to the developer conveyance body; a DC voltage is impressed upon the electrode portion; a composite voltage of an AC component and a DC component is impressed upon the developer conveyance body; and toner is made to fly under the oscillation electric field so that a latent image on the image forming body is developed, are provided in an image forming apparatus. In the image forming apparatus, a process for forming a latent image on the image forming body, and a process for developing the latent image are repeated a plurality of times for forming a multi-color image. The apparatus is further characterized by the following arithmetic relationships: when the amplitude of the AC component to be impressed upon the developer conveyance body is defined as $V_{AC}$ [V], the DC voltage component is defined as $V_{DC}$ [V], and a DC voltage to be impressed upon the electrode portion is defined as $V_{DEN}$ [V], and when the closest distance between the image forming body and the developer conveyance body is defined as $D_1$ [mm], the closest distance between the end portion of the plate member, on the downstream side in the moving direction of the developer conveyance body, and the developer conveyance body is defined as $D_3$ [mm], the latent image electric potential at the solid portion on the image forming body is defined as $V_L$ [V], and the latent image electric potential at the background portion on the image forming body is defined as $V_H$ [V], then, $$V_{AC}>|V_{DEN}|-|V_{DC}|$$

and, $$|V_{DC}|+(|V_{DC}-V_L|)\cdot D_3/D_1>|V_{DEN}|>|V_{DC}|-(|V_H-V_{DC}|)\cdot(1-D_3/D1),$$

and the image forming apparatus is still further characterized in that: the strength of the oscillation electric field formed in the gap between the image forming body and the developer conveyance body in each current developing process is equal to, or weaker than, that of the oscillation electric field in the gap formed between the image forming body and the developer conveyance body in the preceding developing process.

Further, a development apparatus is structured as follows: a wire electrode is provided between the image forming body and the developer conveyance body; a DC voltage is impressed upon the wire electrode; a composite voltage of an AC component and a DC component are impressed upon the developer conveyance body; the latent image on the image forming body is reversally developed when toner is scattered under an oscillation electric field. Further, the developing apparatus is characterized by the following arithmetical relationships:

When the amplitude of an AC component to be impressed upon the developer conveyance body is defined as $V_{AC}$ [V], the DC component is defined as $V_{DC}$ [V], and the DC voltage to be impressed upon the electrode portion is defined as $V_{DEN}$ [V], $$V_{AC}>|V_{DEN}|-|V_{DC}|$$

when the frequency of the AC voltage which is impressed upon the developer conveyance body is defined as $f_{AC}$ [Hz], the moving speed of the developer conveyance body is defined as $V_r$ [mm/sec], and the diameter of the wire electrode is defined as $d_w$ [mm], $$f_{AC} \geqq 2 \cdot V_r / d_w$$

preferablly, $$f_{AC} \geqq 3 \cdot V_r / d_w$$

and, when the closest distance between the image forming body and the developer conveyance body is defined as $D_1$ [mm], the closest distance between the wire electrode and the developer conveyance body is defined as $D_6$ [mm], the average charge amount of the toner is defined as $Q_t$ [μC/g], and the average particle size is d [μm], $$8 \cdot |Q_t| \cdot d_t \cdot D_1 > V_{AC} > 6 \cdot |Q_t| \cdot d_t \cdot D_6$$

Further, a development apparatus is structured as follows: a wire electrode is provided between the image forming body and the developer conveyance body; a DC voltage is impressed upon the wire electrode; a composite voltage of an AC component and a DC component are impressed upon the developer conveyance body; the latent image on the image forming body is reversally developed when toner is scattered under an oscillation electric field. Further, the developing apparatus is characterized by the following arithmetical relationships:

When the amplitude of an AC component to be impressed upon the developer conveyance body is defined as $V_{AC}$ [V], the DC component is defined as $V_{DC}$ [V], and the DC voltage to be impressed upon the electrode portion is defined as $V_{DEN}$ [V], $$V_{AC} > |V_{DEN}| - |V_{DC}|$$

when the frequency of the AC voltage which is impressed upon the developer conveyance body is defined as $f_{AC}$ [Hz], the moving speed of the developer conveyance body is defined as $V_r$ [mm/sec], and the diameter of the wire electrode is defined as $d_w$ [mm], $$f_{AC} \geqq 2 \cdot V_r / d_w$$

preferablly, $$f_{AC} \geqq 3 \cdot V_r / d_w$$

and, when the surface voltage of the latent image formed on the solid portion of the image forming body is defined as $V_L$ [V], and that on the background portion is defined as $V_H$ [V], the closest distance between the image forming body and the developer conveyance body is defined as $D_1$ [mm], the closest distance between the wire electrode and the developer conveyance body is defined as $D_6$ [mm], then, $$|V_H| > |V_{DC}| > |V_L|,$$

and $$|V_{DC}| + |V_{DC} - V_L| \cdot D_6/D_1 > |V_{DEN}| > |V_{DC}| - |V_H - V_{DC}| \cdot (1 - D_6/D1)$$

Still further, the above objective is attained by the following image forming apparatus structured as follows. A plurality of developing apparatus in which: a wire electrode is provided between the image forming body and the developer conveyance body; a DC voltage is impressed upon the wire electrode; a composite voltage of an AC component and a DC component are impressed upon the developer conveyance body; the latent image on the image forming body is reversally developed when toner is scattered under an oscillation electric field. In the image forming apparatus, a process for forming a latent image on the image forming body, and a process for developing the latent image are repeated plural times and superimposing plural toner images for forming a multi-color image. The apparatus is further characterized by the following arithmetic relationships: when the amplitude of the AC component to be impressed upon the developer conveyance body is defined as $V_{AC}$ [V], the DC component is defined as $V_{DC}$ [V], and the DC voltage to be impressed upon the wire electrode is defined as $V_{DEN}$ [V], $$V_{AC} > |V_{DEN}| - |V_{DC}|$$

and, when the amplitude of the AC voltage to be impressed upon the developer conveyance body and the closest distance between the image forming body and the developer conveyance body, in the develping process of nth time, are defined as $V_{AC}(n)$ [V] and $D_1(n)$ [mm]; and the amplitude of the AC voltage to be impressed upon the developer conveyance body and the closest distance between the image forming body and the developer conveyance body, in the develping process of n+1th time, are defined as $V_{AC}(n+1)$ [V] and $D_1(n+1)$ [mm], $$V_{AC}(n)/D_1(n) \geqq V_{AC}(n+1)/D_1(n+1)$$

Yet further, the above objective is attained by the following image forming apparatus structured as follows. A plurality of developing apparatus in which: a wire electrode is provided between the image forming body and the developer conveyance body; a DC voltage is impressed upon the wire electrode; an AC voltage component and a DC voltage component are impressed upon the developer conveyance body; the latent image on the image forming body is reversally developed when toner is scattered under an oscillation electric field. In the image forming apparatus, a process for forming a latent image on the image forming body, and a process for developing the latent image are repeated plural times and superimposing plural toner images for forming a multi-color image. The apparatus is further characterized by the following arithmetic relationships: when the amplitude of the AC voltage to be impressed upon the developer conveyance body is defined as $V_{AC}$ [V], the DC voltage component is defined as $V_{DC}$ [V], and the DC voltage to be impressed upon the wire electrode is defined as $V_{DEN}$ [V], $$V_{AC} > V_{DEN} - V_{DC}$$

and, when the DC voltage to be impressed upon the electrode portion, the surface voltage of the latent image formed on the background portion of the image forming body, and the closest distance between the image forming body and the wire electrode, in the develping process of nth time, are defined as $V_{DEN}(n)$ [V], $V_H(n)$ [V], and $D_7(n)$ [mm]; and the DC voltage to be impressed upon the electrode portion, the surface voltage of the latent image formed on the background portion of the image forming body, and the closest distance between the image forming body and the wire electrode, in the develping process of n+1th time, are defined as $V_{DEN}(n+1)$ [V], $V_H(n+1)$ [V], and $D_7(n+1)$ [mm], $$V_{DEN}(n+1)-V_H(n+1)/D_7(n+1) \geqq V_{DEN}(n)-V_H(n)/D_7(n)$$

In the present invention, the amplitude $V_{AC}$ of the AC component, $V_{DC}$ of the DC component, and $V_{DEN}$ of the DC voltage are set in such a manner that the amplitude $V_{AC}$ [V] of the AC component to be impressed upon the developer conveyance body, $V_{DC}$ of the DC component, and $V_{DEN}$ of the DC voltage to be impressed upon the electrode portion satisfy the following relationship, $$V_{AC}>|V_{DEN}|-|V_{DC}|$$

That is, since the strength of the oscillation electric field is made stronger than that of the DC electric field in the gap formed between the electrode and the developer conveyance body, toner is not pushed onto the developer conveyance body side, and generation of the toner cloud is accelerated.

Further, the amplitude $V_{AC}$ of the AC voltage, the closest distances $D_1$ and $D_2$, $Q_t$ of of an average charge amount, and the average particle size dt are set in such a manner that the amplitude $V_{AC}$ [V] of the AC component to be impressed upon the developer conveyance body, the closest distance $D_1$ [mm] between the image forming body and the developer conveyance body, the closest distance $D_2$ [mm] between the electrode portion and the developer conveyance body, $Q_t$ [μC/g] of an average charge amount of the toner, and the average particle size $d_t$ [μm] satisfy the following relationship, $$10\cdot|Q_t|\cdot d_t\cdot D_1>V_{AC}>5\cdot|Q_t|\cdot d_t\cdot D_2.$$

That is, the following relationship is satisfied in the gap formed between the electrode portion and the developer conveyance body, $$V_{AC}/D2>5\cdot|Q_t|\cdot d_t$$

and further, the following relationship is satisfied in the gap formed between the image forming body and the developer conveyance body, $$10\cdot|Q_t|\cdot d_t>V_{AC}/D_1.$$

The former relationship is a condition of the oscillation electric field in the above-described gap in order to accelerate the generation of the toner cloud in the gap formed between the electrode and the developer conveyance body, and the latter relationship is a condition of the oscillation electric field in the above-described gap in order to suppress the generation of the toner cloud in the gap formed between the image forming body and the developer conveyance body. When both relationships are satisfied, the desired higher developability can be obtained, and fogging in the background portion and generation of the mixing of colors are also suppressed.

Further, $V_{DC}$ of the DC component, $V_{DEN}$ of the DC voltage, the closest distances $D_1$ and $D_3$, the minimum value $V_L$ of the surface voltage, and the maximum value $V_H$ of that are set in such a manner that $V_{DC}$ [V] of the DC component of the composite voltage to be impressed upon the developer conveyance body, $V_{DEN}$ [V] of a DC voltage to be impressed upon the electrode portion, the closest distance $D_1$ [mm] between the image forming body and the developer conveyance body, the closest distance $D_3$ [mm] between the end portion of the plate member having the electrode portion, on the downstream side in the moving direction of the developer conveyance body, and the developer conveyance body, $V_L$ [V] of the latent image electric potential at the solid portion on the image forming body, and $V_H$ [V] of the latent image electric potential at the background portion on the image forming body, satisfy the following relationships, $$|V_H|>|V_{DC}|>|V_L|$$

and, $$|V_{DC}|+(|V_{DC}|-|V_L|)\cdot D_3/D_1>|V_{DEN}|>|V_{DC}|-(|V_H|-|V_{DC}|)\cdot(1-D_3/D1).$$

That is, in the solid portion, the following relationships are satisfied, $$|V_{DC}|>|V_L|$$

and $$(|V_{DC}|-|V_L|)/D_1>(|V_{DEN}|-|V_{DC}|)/D_3$$

and in the background portion, the following relationships are satisfied, $$|V_H|>|V_{DC}|$$

and $$(|V_H|-|V_{DC}|)/D_1>(|V_{DC}|-|V_{DEN}|)/(D_1-D_3).$$

The former relationships are conditions in which toner pressed onto the developer conveyance body side in the gap formed between the electrode portion and the developer conveyance body is moved onto the image forming body by the latent image electric field formed in the solid portion. The latter relationships are conditions in which toner accelerated in the gap formed between the electrode portion and the developer conveyance body is decelerated by the latent image electric field formed in the background portion, and does not arrive onto the image forming body. When both relationships are satisfied, the desired higher developability can be obtained in the solid portion, and the fogging and the mixing of colors are suppressed in the background portion.

Further, a process for forming a latent image onto the image forming body and a process for developing the latent image are repeated a plurality of times, and the strength of the oscillation electric field is set in such a manner that the strength of the oscillating electric field in the gap formed between the image forming body and the developer conveyance body in each developing process is equal to, or weaker than, that of the oscillation electric field in the gap formed between the image forming body and the developer conveyance body in the preceding developing process. Due to this setting, the toner image formed on the image forming body in the preceding developing process is not disturbed by the succeeding developing process, and the mixing of colors of the toners in the succeeding developing process into the toner image formed in the preceding process does not occur.

Further, when the amplitude of the AC component to be impressed upon the developer conveyance body is defined as $V_{AC}$ [V], the DC component is defined as $V_{DC}$ [V], and the DC voltage to be impressed upon the electrode portion is defined as $V_{DEN}$ [V], $$V_{AC}>|V_{DEN}|-|V_{DC}|$$

is satisfied by setting the amplitude $V_{AC}$ of the AC component, $V_{DC}$ of the DC component, and $V_{DEN}$ of the DC voltage. That is, since the strength of the oscillation electric field is made stronger than that of the DC electric field in the gap formed between the wire electrode and the developer conveyance body, toner is not pushed onto the developer conveyance body side, and generation of the toner cloud is accelerated.

when the frequency of the AC voltage which is impressed upon the developer conveyance body is defined as $f_{AC}$ [Hz], the moving speed of the developer conveyance body is defined as $V_r$ [mm/sec], and the diameter of the wire electrode is defined as $d_w$ [mm], $$f_{AC}\geqq 2\cdot V_r/d_w$$

preferably, $$f_{AC}\geqq 3\cdot V_r/d_w$$

are satisfied by setting the frequency of the AC component $f_{AC}$, the moving speed of the developer conveyance body $V_r$, and the diameter of the wire electrode $d_w$. In other words, by satisfying the above relationships, the frequency of the AC component $f_{AC}$ is set so that the peak voltage of the AC component is impressed not less than 2 times or, preferably, not less than 3 times when the developer layer on the developer conveyance body goes through the gap between the wire electrode and the developer conveyance body; therefore, the generation of toner cloud is accelerated and the high developability is obtained.

when the closest distance between the image forming body and the developer conveyance body is defined as $D_1$ [mm], the closest distance between the wire electrode and the developer conveyance body is defined as $D_6$ [mm], the average charge amount of the toner is defined as $Q_t$ [μC/g], and the average particle size is d [μm], $$8\cdot|Q_t|\cdot d_t\cdot D_1>V_{AC}>6\cdot|Q_t|\cdot d_t\cdot D_6$$

is satisfied by setting the amplitude $V_{AC}$ of the AC component, the closest distances $D_1$ and $D_6$, and the average charge amount $Q_t$. In other words, regarding the gap between the wire electrode and the developer conveyance body, $$V_{AC}\cdot D_6>6\cdot|Q_t|\cdot d_t$$

is satisfied, and regarding the gap between the image forming body and the developer conveyance body, $$8\cdot|Q_t|\cdot d_t>V_{AC}\cdot D_1$$

is satisfied. The former relationship is a condition of the oscillation electric field in the above-described gap in order to accelerate the generation of the toner cloud in the gap formed between the wire electrode and the developer conveyance body, and the latter relationship is a condition of the oscillation electric field in the above-described gap in order to suppress the generation of the toner cloud in the gap formed between the image forming body and the developer conveyance body. When both relationships are satisfied, the desired higher developability can be obtained, and fogging in the background portion and generation of the mixing of colors are also suppressed.

Further, when the surface voltage of the latent image formed on the solid portion of the image forming body is defined as $V_L$ [V], and that on the background portion is defined as $V_H$ [V], the closest distance between the image forming body and the developer conveyance body is defined as $D_1$ [mm], the closest distance between the wire electrode and the developer conveyance body is defined as $D_6$ [mm], $$|V_H|>|V_{DC}|>|V_L|,$$

and $$|V_{DC}|+|V_{DC}-V_L|\cdot D_6/D_1>|V_{DEN}|>|V_{DC}|-|V_H-V_{DC}\cdot(1-D_6/D1)$$

are satisfied by settings of the surface voltage of the latent image $V_H$ and $V_L$, the closest distances $D_1$ and $D_6$. In other words, regarding the solid portion, $$|V_{DC}|>|V_L|,$$

and $$|V_{DC}-V_L|\cdot/D_1>|V_{DEN}-V_{DC}|/D_6$$

are satisfied, and regarding the background portion, $$|V_H|>|V_{DC}|,$$

and $$|V_H-V_{DC}|\cdot/D_1>|V_{DC}-V_{DEN}|/(D_1-D_6)$$

are satisfied. The former relationships are conditions in which toner pressed onto the developer conveyance body side in the gap formed between the wire electrode and the developer conveyance body is moved onto the image forming body by the latent image electric field formed in the solid portion. The latter relationships are conditions in which toner accelerated in the gap formed between the electrode portion and the developer conveyance body is decelerated by the latent image electric field formed in the background portion, and does not arrive onto the image forming body. When both relationships are satisfied, the desired higher developability can be obtained in the solid portion, and the fogging and the mixing of colors are suppressed in the background portion.

Further, when a process for forming a latent image onto the image forming body and a process for developing the latent image are repeated plural times; the amplitude of the AC component to be impressed upon the developer conveyance body and the closest distance between the image forming body and the developer conveyance body, in the developing process of nth time, are defined as $V_{AC}(n)$ [V] and $D_1(n)$ [mm]; and the amplitude of the AC component to be impressed upon the developer conveyance body and the closest distance between the image forming body and the developer conveyance body, in the developing process of n+1th time, are defined as $V_{AC}(n+1)$ [V] and $D_1(n+1)$ [mm], $$V_{AC}(n)/D_1(n)\geqq V_{AC}(n+1)/D_1(n+1)$$

is satisfied by setting the amplitudes of the AC component $V_{AC}(n)$ and $V_{AC}(n+1)$, and the closest distances $D_1(n)$ and $D_1(n+1)$. In other words, the strength of the oscillation electric field is set in such a manner that the strength of the oscillating electric field in the gap formed between the image forming body and the developer conveyance body in the succeeding developing process is equal to or weaker than that of the oscillation electric field in the gap formed between the image forming body and the developer conveyance body in the preceding developing process. Due to this setting, the toner image formed on the image forming body in the preceding developing process is not disturbed by the succeeding developing process, and the mixing of colors of the toners in the succeeding developing process into the toner image formed in the preceding process does not occur.

Further, when a process for forming a latent image onto the image forming body and a process for developing the latent image are repeated plural times; the DC voltage to be impressed upon the wire electrode, the latent image voltage of the latent image formed on the background portion of the image forming body, and the closest distance between the image forming body and the wire electrode, in the developing process of nth time, are defined as $V_{DEN}(n)$ [V], $V_H(n)$ [V], and $D_7(n)$ [mm]; and the DC voltage to be impressed upon the wire electrode, the latent image voltage of the latent image formed on the background portion of the image forming body, and the closest distance between the image forming body and the wire electrode, in the developing process of n+1th time, are defined as $V_{DEN}(n+1)$ [V], $V_H(n+1)$ [V], and $D_7(n+1)$ [mm], $(|V_{DEN}(n+1)|-|V_H(n+1)|)/D_7(n+1) \geqq (|V_{DEN}(n)|-|V_H(n)|)/D_7(n)$ is satisfied by setting the amplitudes of the DC voltage $V_{DEN}(n)$ and $V_{DEN}(n+1)$, of the surface voltage of the latent image $V_H(n)$ and $V_H(n+1)$, and the closest distances $D_7(n)$ and $D_7(n+1)$. In other words, the strength of the DC electric field is set in such a manner that the strength of the direct electric field in the gap formed between the image forming body and the developer conveyance body in the succeeding developing process is equal to or stronger than that of the DC electric field in the gap formed between the image forming body and the developer conveyance body in the preceding developing process. Due to this setting, the toner image formed on the image forming body in the preceding developing process is not disturbed by the succeeding developing process or not attracted to the side of succeeding developers, and the mixing of colors of the toners in the succeeding developing process into the toner image formed in the preceding process does not occur.

Due to the foregoing, even in the case where a small particle size toner is used, excellent developing can be conducted in which developability is higher, fogging does not occur in the background portion, and the mixing of colors does not occur even when superimposition development is conducted. Further, even when superimposition development simultaneous transfer method is adopted, a higher quality multi-color image, which has a higher density and no mixing of colors, can be obtained.

DETAILED DESCRIPTION OF THE INVENTION

Figure 1:
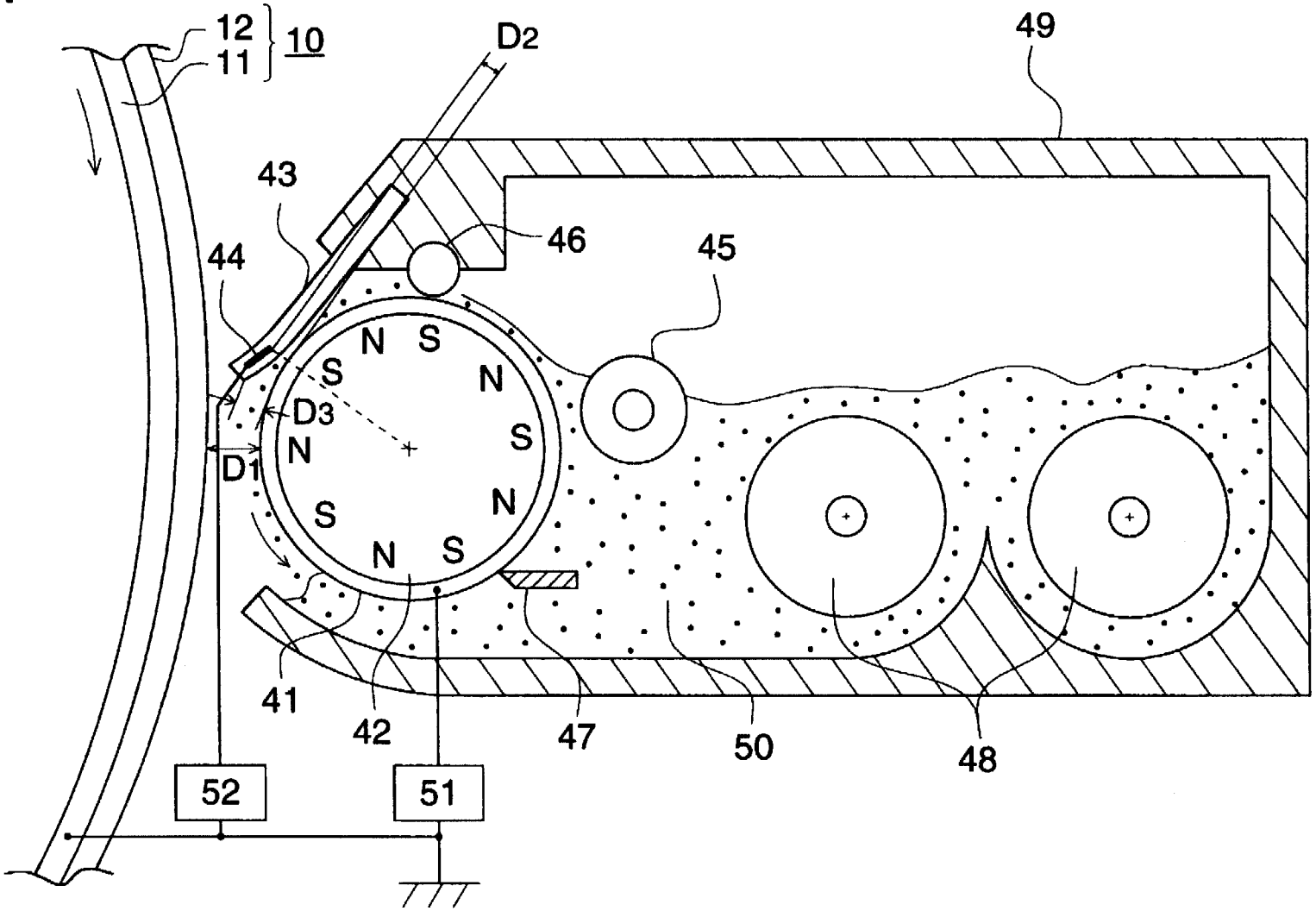
FIG. 1 is a sectional view showing an example of a developing apparatus according to the present invention.

Referring to the drawings, the present invention will be described below.

Figure 2:
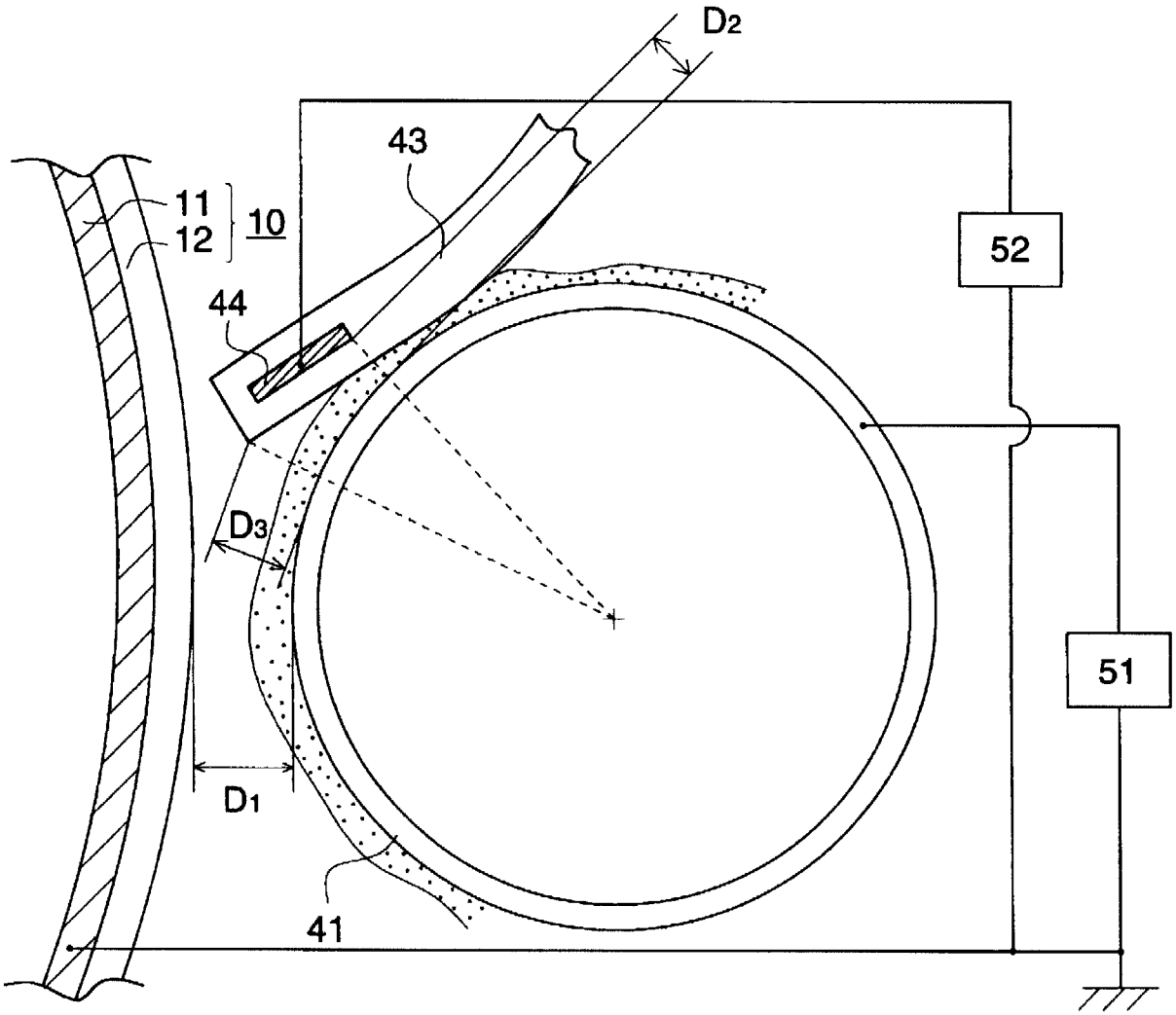
FIG. 2 is an enlarged sectional view of a main portion of the developing apparatus.

FIG. 1 is a sectional view showing an example of a developing apparatus according to the present invention. FIG. 2 is an enlarged view of a main portion of the developing apparatus. In these drawings, numeral 41 is a developing roller, which is a developer conveyance body having a fixed magnetic body 42 therein. Numeral 43 is a plate member having an electrode portion 44. Numeral 45 is a feed roller which is a developer feed member, and numeral 46 is a regulation rod which is a developer conveyance amount regulation member. Numeral 47 is a scraper which is a developer scraping member. Numeral 48 is a stirring roller which is a developer stirring member. Numeral 49 is a casing of the developing apparatus, and numeral 50 is a two-component developer composed of toner T and carrier C. Numerals 51 and 52 are power sources which are respectively bias voltage applying means. Numeral 10 is a photoreceptor drum which is an image forming body, and in which a photoreceptor layer 12 is formed on a conductive base body 11. $D_1$ is the closest distance between the photoreceptor drum 110 and the developing roller 41. $D_2$ is the closest distance between the electrode portion 44 and the developing roller 41. $D_3$ is the closest distance between the end portion of the plate member 43 and the developing roller 41. An arrow in the drawing shows the rotational direction of the photoreceptor drum 10 and the developing roller 41.

The developing roller 41 is a cylinder having a diameter of 0.5 to 3 cm, and made of, for example, non-magnetic and conductive metal such as aluminum, stainless steel, etc., and is surface processed so that the surface roughness (Rz) is 1 through 30 μm. The cylindrical magnetic body 42 having 4 to 12 magnetic poles, respectively magnetized into an N pole or an S pole so that the magnetic field of the surface of the developing roller 41 becomes 500 to 1200 Gauss, is fixed inside the developing roller 41. The developing roller 41 can be rotated with respect to the magnetic body 42.

The plate member is composed of a mono-layer or multi-layer plate member having a thickness of 0.05 to 0.5 mm, which is made of insulating organic base material or inorganic base material made of, for example, polyimide resin, epoxy resin, glass fibre reinforced epoxy resin, ceramic, etc. The electrode portion 44 having the thickness of 0.005 to 0.1 mm, the width of 0.1 to 1 mm, which is made of conductive material such as copper foil or the like, is formed on the upper surface or inside the plate member 43.

The casing 49 is made of insulating resins such as, for example, acrylic resin, polycarbonate, or the like. The developing roller 41 including therein the fixed magnetic body 42, the feed roller 45, the scraper 47, and the stirring roller 48 are disposed inside the casing 49. The regulation rod 46 is disposed at the exit of the casing 49, and the plate member 43 having the electrode portion 44 is disposed at the upper end portion of the casing 49 in such a manner that one end of the plate member 43 is fixed to the upper end portion.

A two-component developer 50 composed of toner T and carrier C are stored inside the casing 49. The two-component developer 50 is stirred by the stirring roller 48, supplied by the feed roller 45, adheres onto the developing roller 41, and forms a magnetic brush. The magnetic brush is conveyed by the rotation of the developing roller 41 while the conveyance amount is being regulated by the regulation rod 46.

A composite voltage of an AC component and a DC component is impressed upon the developing roller 41 from the power source 51 and a DC voltage is impressed upon the electrode portion 44 of the plate member 43 from the power source 52. A strong oscillation electric field is formed in a gap between the developing roller 41 and the electrode portion 44, and a weak oscillation electric field is formed in a gap between the developing roller 41 and the photoreceptor drum 10. The toner T is separated from the carrier C and made to fly by the strong oscillation electric field and a toner cloud is generated. The toner cloud is made to fly onto a latent image on the photoreceptor drum 10 by the weak oscillation electric field, and a toner image is formed on the photoreceptor drum 10.

Figure 3:
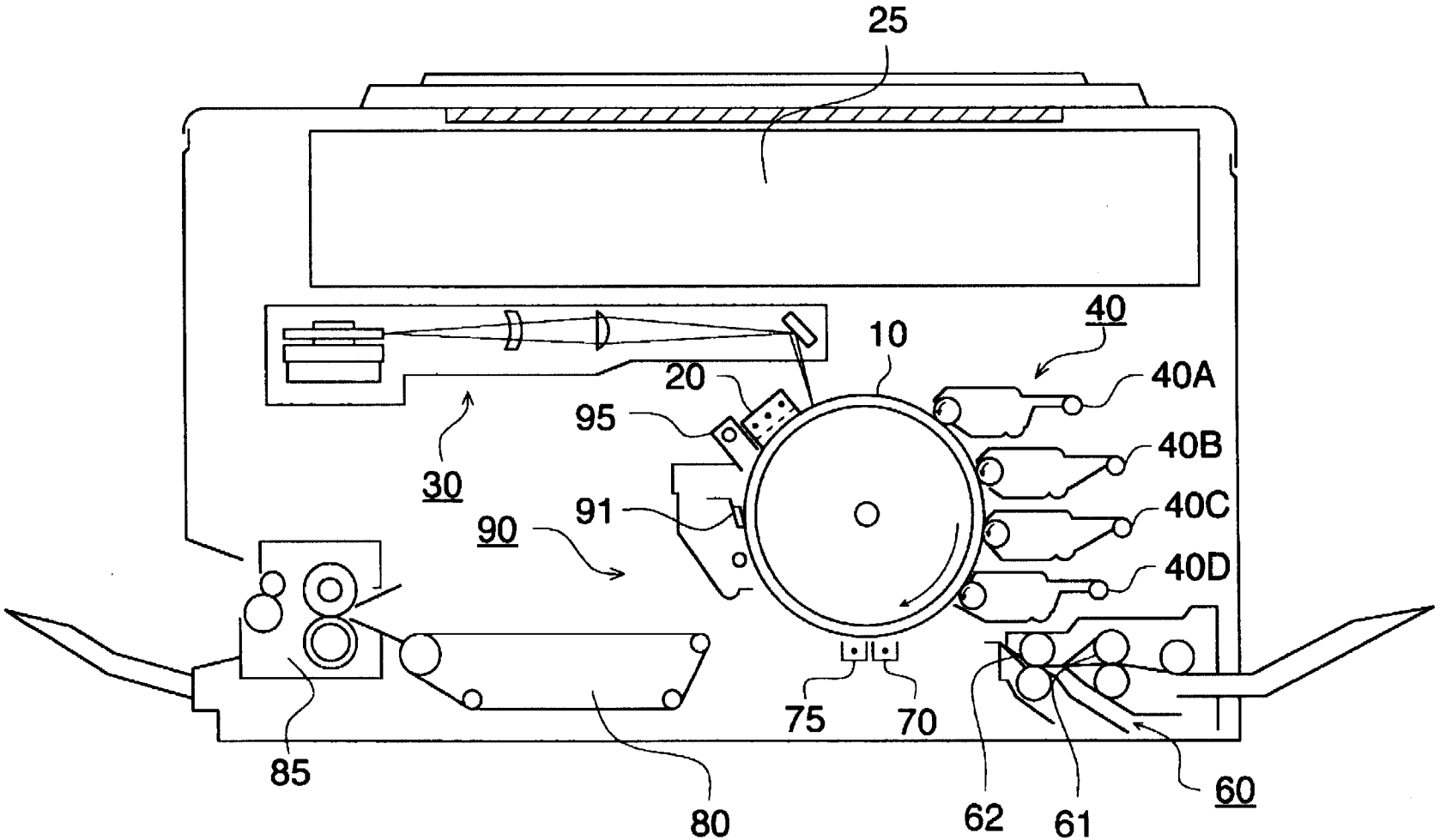
FIG. 3 is a view showing an example of a composition of an image forming apparatus of the present invention.

FIG. 3 is a view showing an example of a composition of an image forming apparatus of the present invention. In FIG. 3, numeral 10 is a photoreceptor drum which is an image forming body, numeral 20 is a scorotron charger which is a charging means, numeral 25 is an image reading section, and numeral 30 is an image writing section using a laser beam which is an exposure means. Numerals 40A, 40B, 40C and 40D are developing apparatus, shown in FIG. 1, in which respectively different color two-component developer is accommodated. Numeral 60 is a sheet feed section provided with the first sheet roller 61 and the second sheet roller 62. Numeral 70 is a transfer corona charger which is a transfer means, and numeral 75 is a separation corona charger which is a separation means. Numeral 80 is a conveyance section, numeral 85 is a fixing section, numeral 90 is a cleaning unit provided with a cleaning blade 91, and numeral 95 is a pre-charging exposure lamp. An arrow in the drawings shows the rotational direction of the photoreceptor drum 10.

Basic operations of a multi-color image forming process of this example are carried out as follows. Initially, a copy-start command is sent from an operation section, not shown, to a control section, not shown, and the rotation of the photoreceptor drum 10 starts. When the photoreceptor drum 10 rotates, the peripheral surface of the photoreceptor drum 10 is uniformly charged by the scorotron charger 20. In the image reading section 25, optical information from a document is converted into an electric signal, and after the electric signal has been image-processed, the signal is inputted into the image writing section 30. Laser beams are irradiated onto the charged photoreceptor drum 10 from the image writing section 30, and a latent image is formed on the photoreceptor drum 10. The latent image on the photoreceptor drum 10 is developed by any of the developing apparatus 40A, 40B, 40C, or 40D, and a toner image is formed on the photoreceptor drum 10.

The photoreceptor drum 10, on which the toner image has been formed, is uniformly charged again by the scorotron charge 20, laser beams are irradiated by the image writing apparatus 30, and the next latent image is formed. The latent image formed on the photoreceptor drum 10 is developed by any of the developing apparatus 40A, 40B, 40C or 40D, and the next toner image is superimposed on the photoreceptor drum 10.

In this example, as described above, the latent image forming process, the developing process are repeated 4 times, and four color toner images are superimposed on the photoreceptor drum 10.

Recording sheets, which are transfer sheets, are loaded in the sheet feed section 60, and a recording sheet is sent to the transfer corona charger 70 by the first sheet roller 61 and the second sheet roller 62 in timed relationship with the toner images superimposed on the photoreceptor drum 10. The toner images superimposed on the photoreceptor drum 10 are transferred onto a recording sheet by the transfer corona charger 70, and the recording sheet is separated from the photoreceptor drum 10 by the separation corona charger 75. The recording sheet onto which the toner image has been transferred, is conveyed to the fixing section 85 through the conveyance section 80, and after the transfer sheet having thereon the transferred toner image has been thermally fused, pressurized, and fixed, the sheet is delivered outside the apparatus.

On the other hand, the toner remaining on the photoreceptor drum 10 is scraped by the cleaning apparatus 90 provided with a cleaning blade 91, which is in pressure-contact with the photoreceptor drum 10 in timed relationship with the image forming process, and after the residual electric potential voltage on the photoreceptor drum 10 has been eliminated by the pre-charging exposure lamp 95, the photoreceptor drum 10 enters into the next image forming process.

Necessary conditions of the present invention will be explained below.

In the present invention, the required condition is that the amplitude $V_{AC}$ [V] of the composite voltage of the AC component and the DC component to be impressed upon the developing roller 41, $V_{DC}$ [V] of the DC component, and $V_{DEN}$ [V] of the DC voltage to be impressed upon the electrode portion 44 of the plate member 43, satisfy the following relationship:

$$V_{AC} > |V_{DEN}| - |V_{DC}|$$

When the above relationship is satisfied, the oscillation electric field to separate the toner T from the carrier C and to fly it so that the toner cloud is generated in the gap between the electrode portion 44 and the developing roller 41, is stronger than the DC electric field which tends to push the toner T to the developing roller 41 side, and accordingly, generation of the toner cloud is promoted.

When $V_{AC}$, $V_{DC}$ and $V_{DEN}$ do not satisfy the above relationship, and have the following relationship, $$V_{AC} \leqq |V_{DEN}| - |V_{DC}|,$$

then, the toner T is pushed to the developing roller 41 side, and accordingly, the generation of the toner cloud is suppressed, resulting in a lowered developability.

Further, another required condition in the fist example is that the amplitude $V_{AC}$ [V] of the AC component to be impressed upon the developing roller 41, the closest distance $D_1$ [mm] between the photoreceptor drum 10 and the developing roller 41, the closest distance $D_2$ [mm] between the electrode portion and the developing roller 41, $Q_t$ [μC/g] of of an average charge amount of the toner, and an average particle size $d_t$ [μm], satisfy the following relationship, $$10\cdot|Q_t|\cdot d_t\cdot D_1>V_{AC}>5\cdot|Q_t|\cdot d_t\cdot D_2$$

Figure 4:
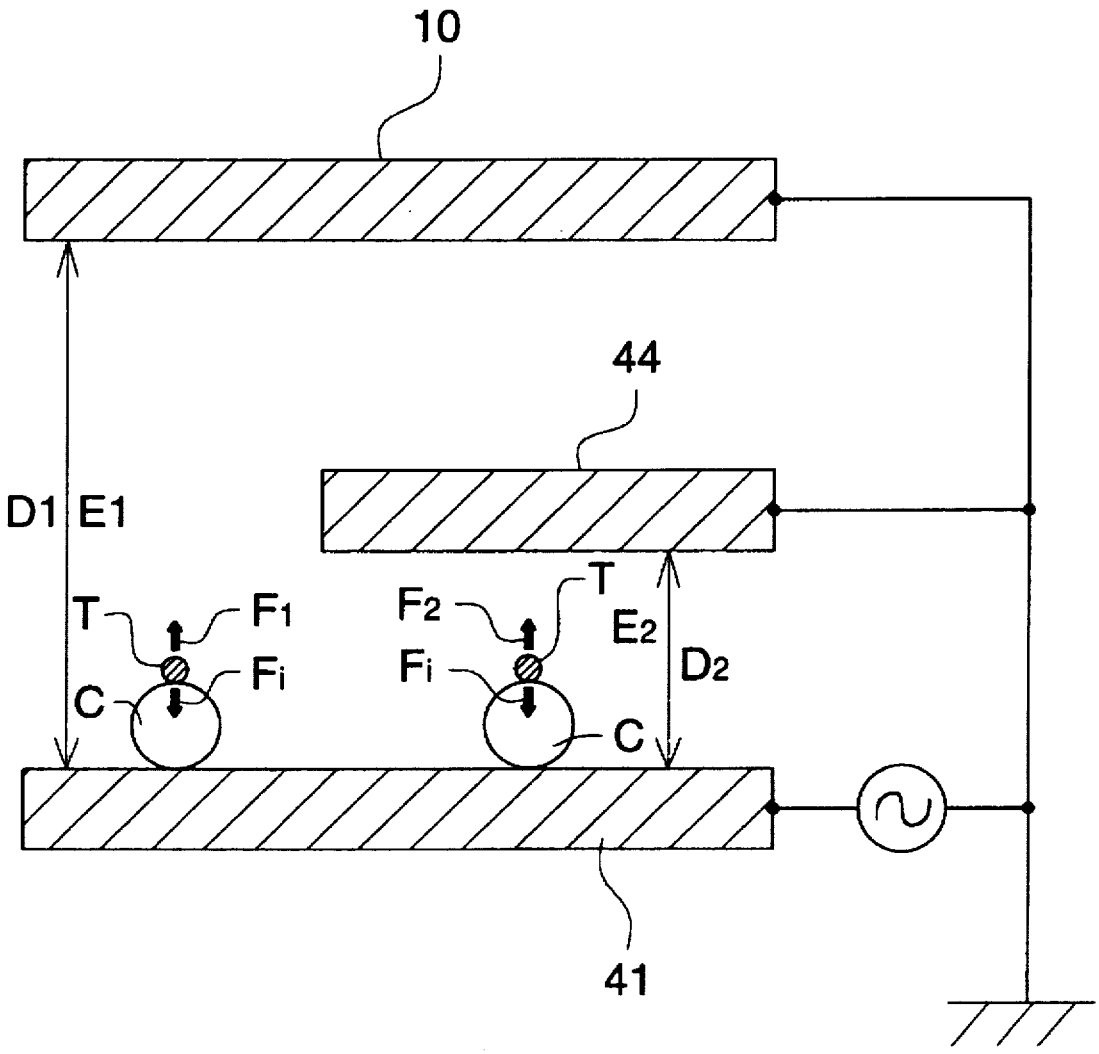
FIG. 4 is a view showing a model of the example shown in FIG. 1 for considering the oscillation electric field formed in a gap formed among a photoreceptor drum, a developing roller and an electrode portion.

Referring to FIG. 4, the above required condition will be explained below.

FIG. 4 is a view showing a model for considering the oscillation electric field formed in the gap between the photoreceptor drum 10 and the developing roller 41 and in the gap between the electrode portion 44 and the developing roller 41. In FIG. 4, numeral 10 is the photoreceptor drum, numeral 41 is the developing roller, numeral 44 is the electrode portion, $D_1$ is the closest distance between the photoreceptor drum 10 and the developing roller 41, and $D_2$ is the closest distance between the electrode portion 44 and the developing roller 41. The AC component $V_{AC}$ is impressed upon the developing roller 41, the oscillation electric field $E_1$ is formed in the gap between the photoreceptor drum 10 and the developing roller 41, and the oscillation electric field $E_2$ is formed in the gap between the electric portion 44 and the developing roller 41.

In order to obtain the higher developability and to suppress fogging and the mixing of colors in the background portion, it may be allowed that the toner cloud is generated only in the gap between the electrode portion 44 and the developing roller 41, and the toner cloud is not generated in the gap between the photoreceptor drum 10 and the developing roller 41. In order to realize this condition, the balance of the force to be applied to the toner T may be set as follows: force $F_2$ exerted by the oscillation electric field $E_2$ is larger than the mirror image force $F_i$, in the gap between the electrode portion 44 and the developing roller 41; force $F_1$ exerted by the oscillation electric field $E_1$ is smaller than the mirror image force $F_i$, in the gap between the photoreceptor drum 10 and the developing roller 41.

Initially, the gap between the photoreceptor drum 10 and the developing roller 41 will be considered below.

When the average charge amount of toner T is defined as q, the force $F_1$ exerted by the oscillation electric field $E_1$ in the gap is expressed as follows:

$$F_1=q\cdot E_1=q\cdot V_{AC}/D_1 \tag{1}$$

When the average charge amount of toner T is $q_t$, and the average particle size is defined as $d_t$, the mirror image force $F_i$ to be exerted onto toner T is expressed by the following equation:

$$F_i=\beta\cdot|q_t|^2/(4\cdot\pi\cdot\epsilon_0\cdot d_t^2) \tag{2}$$

In the gap, because $F_i>F_1$, the above relationships become as follows:

$$\beta\cdot|q_t|^2/(4\cdot\pi\cdot\epsilon_0\cdot d_t^2)>|q_t|\cdot V_{AC}/D_1,$$

then, $$\beta\cdot|q_t|\cdot D_1/(4\cdot\pi\cdot\epsilon_0\cdot d_t^2)>V_{AC} \tag{3}$$

When the average charge amount of toner T is $Q_t$, and the density of toner T is ρt, $q_t$ of the average charge amount of toner T is expressed by the following equation:

$$|q_t|=|Q_t|\cdot\rho_t\cdot(4/3)\cdot\pi\cdot(d_t/2)^3 \tag{4}$$

then, when equation (4) is substituted into equation (3), the following relationship can be obtained:

$$\beta\cdot\rho_t\cdot|Q_t|\cdot d_t\cdot D_1/(24\cdot\epsilon_0)>V_{AC} \tag{5}$$

In equations (2) to (5), β is a coefficient relating to a dielectric constant of toner T and carrier C, and β is 2 in the document (M. H. Davis, Amer. J. Physics, 37, 26 (1969)). $\epsilon_0$ is a dielectric constant of the vacuum, and $\epsilon_0=8.85\times10^{-12}$ [F/m]. The density $\rho_t$ of the toner T is $\rho_t=1.1$ [g/cm$^3$] in the ordinary non-magnetic toner. When these values are substituted into the equation (5), and units of $Q_t$, $d_t$, $D_1$ and $V_{AC}$ are respectively $Q_t$ [μC/g], $d_t$ [μm], $D_1$ [mm], and $V_{AC}$ [V], then, $$10\cdot|Q_t|\cdot d_t\cdot D_1>V_{AC} \tag{6}$$

Equation (6) is a condition for suppressing the generation of the toner cloud in the gap and for preventing fogging and the mixing of colors in the background portion.

Next, dimensions of the gap between the electrode portion 44 and the developing roller 41 will be considered below.

The force $F_2$ exerted by the oscillation electric field $E_2$ in the gap is expressed as follows:

$$F_2=|q_t|\cdot E_2=|q_t|\cdot V_{AC}/D_2 \tag{7}$$

The mirror image force $F_i$ to be exert given by the following equation:

$$F_i=\beta\cdot|q_t|^2/(4\cdot\pi\cdot\epsilon_0\cdot d_t^2) \tag{2}$$

Because $F_2>F_i$ in the gap, the following relationship can be obtained:

$$|q_t|\cdot V_{AC}/D_2>\beta\cdot|q_t|^2/(4\cdot\pi\cdot\epsilon_0\cdot d_t^2)$$

then, the following relationship can be obtained from the above:

$$V_{AC}>\beta\cdot|q_t|\cdot D_2/(4\cdot\pi\cdot\epsilon 0\cdot d_t^2) \tag{8}$$

When the equation (4) is substituted into the equation (8) in the same way as described above, and when β=2, $\epsilon_0=8.85\times10^{-12}$ [F/m], $\rho_t=1.1$ [g/cm$^3$], are substituted into the equation (8), and units of $V_{AC}$, $Q_t$, $d_t$, and $D_2$ are respectively $V_{AC}$ [V], $Q_t$ [μC/g], $d_t$ [μm], and $D_2$ [mm], then, the following relationship can be obtained:

$$V_{AC}>10\cdot|Q_t|\cdot d_t\cdot D_2 \tag{9}$$

When equation (9) was introduced, the oscillation electric field $E_2$ in the gap was calculated under the condition that any dielectric other than air did not exist in the gap between the electrode portion 44 and the developing roller 41. However, in practice, the plate member 43 and the two-component developer 50 exist in the gap. Accordingly, the oscillation electric field $E_2$ is strengthened.

Considering this condition, the equation (9) is expressed as follows.

$$V_{AC}>5\cdot|Q_t|\cdot d_t\cdot D_2 \tag{10}$$

Equation (10) is a condition in order to accelerate the generation of toner in the gap and to obtain higher developability.

When equation (6) and equation (10) are combined, the following relationship is obtained:

$$10\cdot|Q_t|\cdot d_t\cdot D_1>V_{AC}>5\cdot|Q_t|\cdot d_t\cdot D_2 \tag{11}$$

and then, the required condition of the present invention is introduced.

Actually, when toner T having $Q_t$ [μC/g] and the average particle size of $d_t$ [μm], is used, and when the AC component being impressed upon the developing roller 41, the closest distance $D_1$ [mm] between the photoreceptor drum 10 and the developing roller 41, and the closest distance $D_2$ [mm] between the electrode portion 44 and the developing roller 41 are set in such a manner that these distances satisfy the above equation (11), then, a high quality image can be obtained in which the image density is higher and fogging and the mixing of colors do not occur in the background portion.

On the other hand, When the relationships of the above equation (11) are not satisfied and $V_{AC}$ is greater than $10\cdot|Q_t|\cdot d_t\cdot D_1$, toner adheres onto the latent image and the toner image of the background portion, formed on the photoreceptor drum 10, resulting in fogging and the mixing of colors. Reversely, when $V_{AC}$ is less than $5\cdot|Q_t|\cdot d_t\cdot D_2$, the image density of the solid portion is lowered and the line width is narrowed. In both cases, a superior image can not be obtained.

Further, in the second invention of the present invention, another required condition is obtained when: the following relationships are satisfied when $V_{DC}$ [V] of a DC component to be impressed upon the developing roller 41; $V_{DEN}$ [V] of a DC voltage to be impressed upon the electrode portion 44 of the plate member 43; the closest distance $D_1$ [mm] between the photoreceptor drum 10 and the developing roller 41; the closest distance $D_3$ [mm] between the end portion of the plate member 43, on the downstream side in the moving direction of the developing roller 41 (hereinafter, called the end portion on the downstream side of the plate member 43), and the developing roller 41; $V_L$ [V] of a latent image electric potential at the solid portion on the photoreceptor drum 10; and $V_H$ [V] of the latent image electric potential at the background portion on the photoreceptor drum 10, individually satisfy the following relationships, $$|V_H|>|V_{DC}|>|V_L|,$$

and $$|V_{DC}|+(|V_{DC}|-|V_L|)\cdot D_3/D_1>|D_{DEN}|>|V_{DC}|-(|V_H|-|V_{DC}|)\cdot(1-D_3/D1).$$

Figure 5:
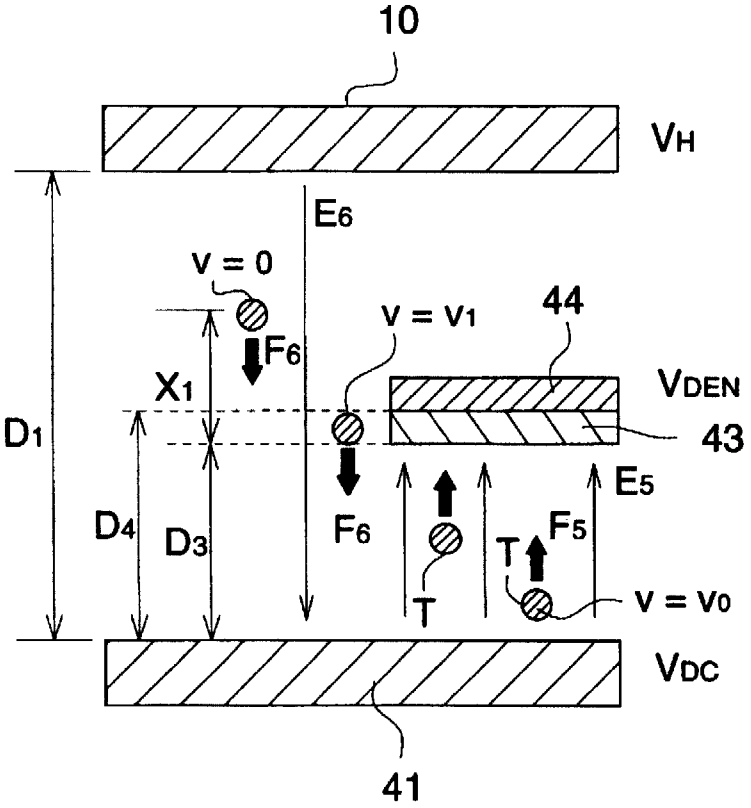
FIGS. 5(*a*) and 5(*b*) are views showing a model of the example shown in FIG. 1 for considering toner scattering in a development zone.
Figure 5:
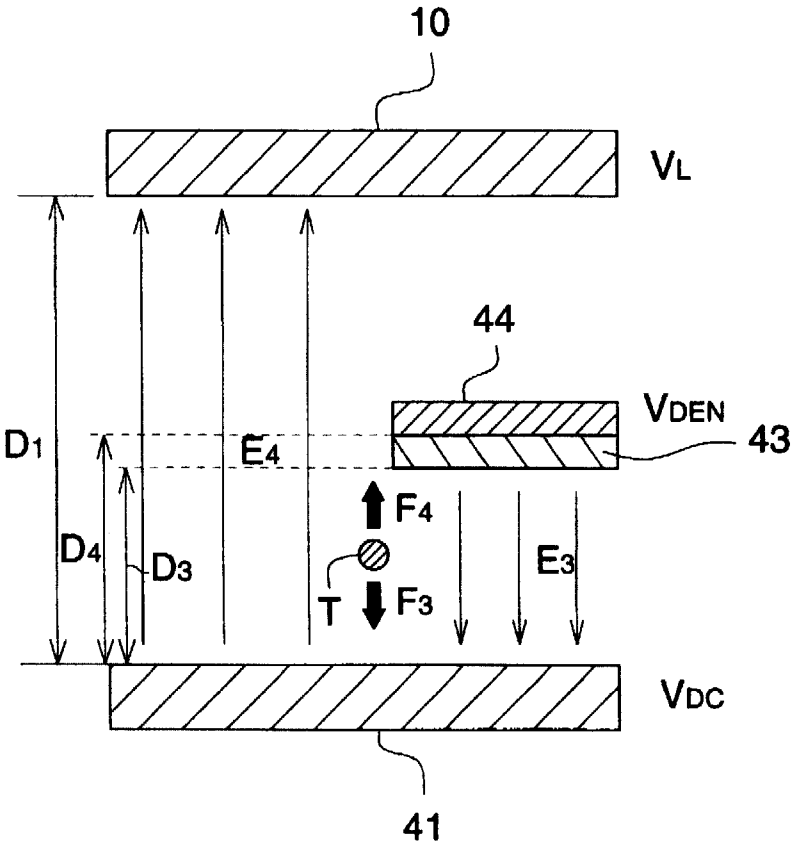

Referring to FIG. 5, the above-described required condition will be explained below.

FIGS. 5(*a*) and 5(*b*) are views showing a model for considering the toner scattering in the development zone in which the photoreceptor drum 10 is opposed to the developing roller 41. FIG. 5(*a*) is a case where the latent image of the solid portion is formed on the photoreceptor drum 10, and FIG. 5(*b*) is a case where the latent image or the toner image of the background portion is formed on the photoreceptor drum 10. In FIG. 5, numeral 10 is the photoreceptor drum, numeral 41 is the developing roller, numeral 43 is the plate member having the electrode portion 44, $D_1$ is the closest distance between the photoreceptor drum 10 and the developing roller 41, and $D_3$ is the closest distance between the end portion on the downstream side of the plate member 43 and the developing roller 41.

Initially, in FIG. 5(*a*), the following case is considered: the latent image of the solid portion is formed on the photoreceptor drum 10.

$V_{DEN}$ of the DC voltage is impressed upon the plate member 43, the DC voltage $V_{DC}$ is impressed upon the developing roller 41, and the DC electric field $E_3$ is formed in the gap between the plate member 43, having the electrode portion 44, and the developing roller 41. The latent image at the solid portion having the latent image electric potential thereon, which is $V_L$, is formed on the photoreceptor drum 10, and the DC electric field $E_4$ is also formed in the gap between the photoreceptor drum 10 and the developing roller 41.

Conditions to obtain the higher developability in the solid portion will be found from the balance of a force exerted onto toner T, which now exists on the end portion on the downstream side of the plate member 43, as explained below.

In order to move the toner T onto the latent image formed on the photoreceptor drum 10, the following is necessary: a force $F_4$ to move the toner T onto the latent image formed on the photoreceptor drum 10 by the DC electric field is larger than a force $F_3$ to push the toner T onto the developing roller 41 side by the DC electric field $E_3$, that is $F_4>F_3$.

The force $F_3$ to push the toner T onto the developing roller 41 side and the $F_4$ to move the toner T onto the latent image on the photoreceptor drum 10 are respectively given as follows. When the average charge amount of the toner T is defined as $q_t$, the distance between the end portion on the downstream side of the electrode portion 44 and the developing roller 41 is defined as $D_4$, and the closest distance between the photoreceptor drum 10 and the developing roller 41 is defined as $D_1$, then, $$F_3=|q_t|\cdot E_3=|q_t|\cdot|V_{DEN}-V_{DC}|/D_4 \tag{12}$$

and $$F_4=|q_t|\cdot E_4=|q_t|\cdot|V_{DC}-V_L|/D_1 \tag{13}$$

Accordingly, the condition to obtain the higher developability in the solid portion is $$|q_t|\cdot|V_{DC}-V_L|/D_1>|q_t|\cdot|V_{DEN}-V_{DC}|/D_4$$

When q is eliminated from both sides, then, $$|V_{DC}|+|V_{DC}-V_L|\cdot D_4/D_1>|V_{DEN}|$$

Because $D_3\geqq D_4$, the following relationship is obtained:

$$|V_{DC}|+|V_{DC}-V_L|\cdot D_3/D_1>|V_{DEN}| \tag{14}$$

Equation (14) is the condition to obtain the higher developability in the solid portion.

Next, referring to FIG. 5(*b*), the case where the latent image of the background portion is formed on the photoreceptor drum 10 will be considered below.

$V_{DEN}$ of the DC voltage is impressed upon the electrode portion of the plate member 43, the DC voltage $V_{DC}$ is impressed upon the developing roller 41, and the DC electric field $E_5$ is formed in the gap between the plate member 43 having the electrode portion 44 and the developing roller 41. The latent image at the background portion having $V_H$ of the latent image electric potential is formed on the photoreceptor drum 10, and the DC electric field $E_6$ is also formed in the gap between the photoreceptor drum 10 and the developing roller 41.

The following are assumed: the toner T on the developing roller 41 is now affected by the force $F_5$ of the DC electric field E5, and moves to the end portion on the downstream side of the plate member 43 while the speed of the toner T is being increased; and the toner T which has passed through the end portion on the downstream side of the plate member 43 is affected by the reverse force $F_6$ due to the DC electric field $E_6$, and the speed of the toner T is gradually reduced. Then, conditions in which no fogging and no mixing of colors occur in the background portion, will be discussed below.

The following relationships are obtained in the process in which the toner T on the developing roller 41 moves to the end portion on the downstream side of the plate member 43: when the mass of the toner T is defined as m, the acceleration to be exerted on the toner T is defined as $\alpha_1$, time necessary for the toner T to move from the developing roller 41 to the end portion on the downstream side of the plate member 43 is defined as $t_1$, the velocity of the toner T at the end portion on the downstream side of the plate member 43 is defined as $V_1$, and the distance between the developing roller 41 and the plate member 43 is defined as $D_3$, then, $$F_5=m\cdot\alpha_1 \tag{15}$$

$$V_1=\alpha_1\cdot t_1 \tag{16}$$

$$D_3=\alpha_1\cdot t_1^2/2 \tag{17}$$

Further, the following relationships are obtained in the process in which the toner T, which has passed through the end portion on the downstream side of the plate member 43 at the velocity $V_1$, is affected by the force opposite to the moving direction and the velocity of the toner T is finally reduced to 0: negative acceleration applied onto the toner T is defined as $\alpha_2$, time during which the velocity of the toner T is reduced to 0 is defined as $t_2$, and distance between the position at which the velocity of the toner T is reduced to 0 and the end portion on the downstream side of the plate member 43, is defined as $x_1$, then, $$F_6=m\cdot\alpha_2 \tag{18}$$

$$0=V_1-\alpha_2\cdot t_2 \tag{19}$$

$$X_1=V_1\cdot t_2-\alpha_2\cdot t_2^2/2 \tag{20}$$

When m, $\alpha_1$, $t_1$, $V_1$, $\alpha_2$, $t_2$ are eliminated using equations (15) through (20), the following relationship is obtained:

$$X_1=F_5\cdot D_3/F_6 \tag{21}$$

The condition in which no fogging and no mixing of colors occur in the background portion, is obtained as follows: because this condition means that the toner T does not reach the latent image or the toner image in the background portion on the photoreceptor drum 10, when the closest distance between the developing roller 41 and the photoreceptor drum 10 is dined as $D_1$, the condition of $X_1$ in the equation (21) becomes $$D_1-D_3>X_1 \tag{22}$$

On the other hand, the force $F_5$ due to the DC electric field $E_5$ and the force $F_6$ due to the DC electric field $E_6$ are respectively expressed by the following equations: when the average charge amount of the toner is defined as $q_t$, the closest distance between the developing roller 41 and the photoreceptor drum 10 is defined as $D_1$, the closest distance between the developing roller 41 and the end portion on the downstream side of the electrode portion 44 is defined as $D_4$, then, $$F_5=|q_t|\cdot E_5=|q_t|\cdot|V_{DC}-V_{DEN}|/D_4 \tag{23}$$

and $$F_6=|q_t|\cdot E_6=|q_t|\cdot|V_H-V_{DC}|/D_1 \tag{24}$$

When equations (21), (23) and (24) are substituted into equation (22), the following relationship is obtained:

$$|V_H-V_{DC}|\cdot(D_1-D_3)/D_1>|V_{DC}-V_{DEN}|\cdot D_3/D_4.$$

Because $D_3\leqq D_4$, the following relationship is obtained:

$$|V_H-V_{DC}|\cdot(D_1-D_3)/D_1>|V_{DC}-V_{DEN}|.$$

Then, as a result, the following relationship is obtained:

$$|V_{DEN}|>|V_{DC}|-|V_H-V_{DC}|\cdot(1-D_3/D_1) \tag{25}$$

Equation (25) is the condition for preventing fogging and the mixing of colors in the background portion.

When equation (14) and equation (25) are combined, the following relationship is obtained:

$$|V_{DC}|+|V_{DC}-V_L|\cdot D_3/D_1>|V_{DEN}|>|V_{DC}|-|V_H-V_{DC}|\cdot(1-D_3/D_1) \tag{26}$$

and now, the required condition of the present invention can be obtained as described above.

In the present invention, the same mathematical sign is given to $V_{DC}$, $V_{DEN}$, $V_H$ and $V_L$ When the DC component $V_{DC}$ [V] to be impressed upon the developing roller 41, $V_{DEN}$ [V] of the DC voltage to be impressed upon the electrode portion 44 of the plate member 43, $V_L$ of the potential voltage of the latent image in the solid portion on the photoreceptor drum 10, $V_H$ of the potential voltage of the latent image at the background portion on the photoreceptor drum 10, the distance $D_3$ between the end portion on the downstream side of the plate member 43 and the developing roller 41, and the closest distance $D_1$ between the photoreceptor drum 10 and the developing roller 41, are set so as to satisfy the relationship expressed by equation (26), then, the high quality image which has a higher image density and no fogging and no mixing of colors in the background portion, can be obtained.

On the other hand, when the relationship in equation (26) is not satisfied and $|V_{DEN}|$ is too great, the image density in the solid portion is decreased and the line width is decreased. When $|V_{DEN}|$ is too small, toner adheres to even the latent image or toner image in the background portion formed on the photoreceptor drum 10, resulting in fogging and the mixing of colors. In both cases, an excellent image can not be obtained.

Still further, a process to form a latent image on the photoreceptor drum 10 and a process to develop the latent image are repeated a plurality of times, and the strength of the oscillation electric field is set so that the strength of the oscillation electric field in the gap formed between the photoreceptor drum 10 and the developing roller 41, in the current developing process, is equal to or weaker than the strength of the oscillating electric field in the gap formed between the photoreceptor drum 10 and the developing roller 41, in the preceding developing process.

That is, when: the amplitude of the AC voltage to be impressed upon the developing roller 41 of the developing apparatus by which the latent image has been developed in the n-th time developing process, is defined as $V_{AC}(n)$; the closest distance between developing roller 41 and the photoreceptor drum 10 is defined as $D_1(n)$; the amplitude of the AC component to be impressed upon the developing roller 41' of the developing apparatus by which the latent image is developed in the (n+1)th time developing process is defined as $V_{AC}(n+1)$; and the closest distance between the developing roller 41' and the photoreceptor drum 10 is defined as $D_1(n+1)$, then, $V_{AC}(n+1)$ and $D_1(n+1)$ in the (n+1)th time developing process are set as follows:

$$V_{AC}(n)/D_1(n)\geqq V_{AC}(n+1)/D_1(n+1)$$

When $V_{AC}(n)$, $V_{AC}(n+1)$, $D_1(n)$ and $D_1(n+1)$ are set as above, the toner image formed on the photoreceptor drum 10 in the preceding developing process is not disturbed in the succeeding developing process, and colored toner of the preceding toner image is not mixed by the succeeding toner, so that a higher quality multi-color image can be obtained.

Conversely, when the oscillation electric field in the succeeding developing process is stronger than the oscillation electric field in the preceding developing process, the preceding toner image is disturbed and its color is mixed with the succeeding toner, resulting in an unclear and low quality multi-color image.

Next, other conditions relating to the present invention will be explained.

Initially, the plate member 43 having the electrode portion 44 and the arrangement of the plate member will be explained.

The plate member 43 having the electrode portion 44 is disposed on the upstream side in the moving direction of the developing roller 41 in the development zone in which the photoreceptor drum 10 is opposed to the developing roller 41, and when the oscillating electric field is formed in the gap between the electrode portion 44 and the developing roller 41, a toner cloud is generated.

Figure 6:
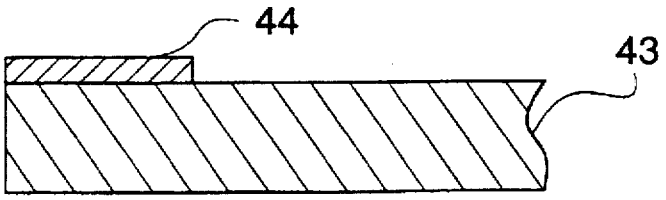
FIGS. 6(*a*) through 6(*f*) are sectional views showing the composition of a plate member having an electrode portion.
Figure 6:
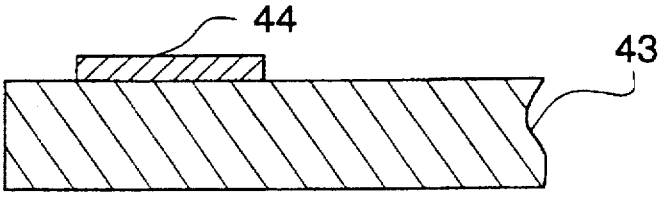
Figure 6:
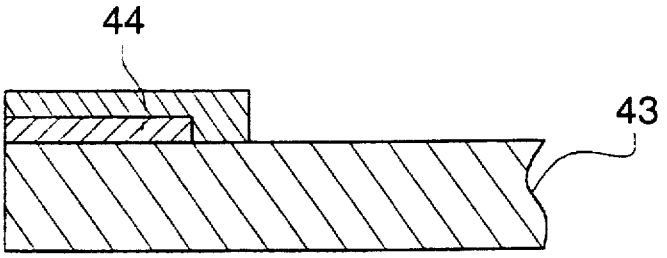
Figure 6:
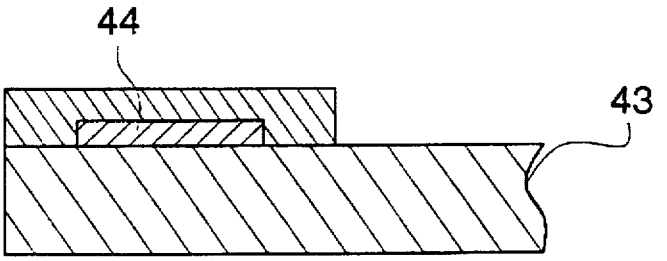
Figure 6:
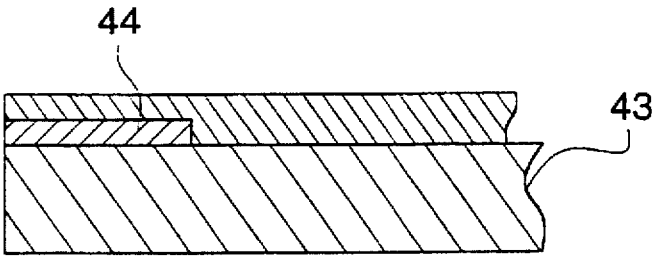
Figure 6:
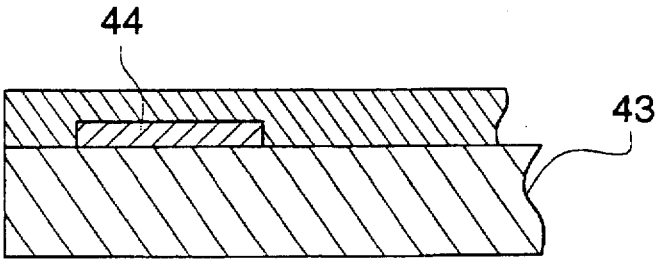

As the composition of the plate member 43 having the electrode portion 44, for example, the composition shown by FIGS. 6(*a*) through 6(*f*) are used. FIG. 6(*a*) shows the composition in which the electrode portion 44 made of, for example, conductive material such as a copper foil, is formed at the end portion on the downstream side of the upper surface of organic insulating base material or inorganic base material, such as polyimide resin, epoxy resin, glass fiber reinforced epoxy resin, ceramic, etc. FIG. 6(*b*) shows the composition in which a hood-like portion is provided at the end portion on the downstream side of the plate member 43, and the electrode portion 44 is formed at a position on the upstream side which is slightly apart from the end portion on the downstream side of the plate member 43. FIG. 6(*c*) and FIG. 6(*d*) respectively show the composition in which the electrode portion 44 and the hood-like portion in FIGS. 6(*a*) and 6(*b*) are coated by insulating material such as, for example, polyamide resin, epoxy resin, glass fiber reinforced epoxy resin, etc., and are multi-layer structured. FIGS. 6(*e*) and 6(*f*) respectively show the composition in which the entire upper surface in FIGS. 6(*a*) and 6(*b*) are coated by insulating material and are multi-layer structured.

In the composition described above, the composition shown by FIGS. 6(*d*) and 6(*f*) are specifically preferable. Because the hood-like portion is provided at the end portion on the downstream side of the plate member 43, and the electrode portion 44 is coated by insulating material, toner T does not move around the end portion on the downstream side of the plate member 43, and it can prevent toner T from adhering onto the upper surface of the plate member 43, specifically adhering to the electrode portion 44.

The plate member 43 having the electrode portion 44 is attached to the developing apparatus as follows. For example, as shown in FIG. 1, one end of the plate member 43 is fixed to the upper end portion of the casing 49 of the developing apparatus, and the lower surface of the plate member 43 is caused to come into contact with the two-component developer 50 on the developing roller 41 with a predetermined contact pressure.

Dimensions of each portion of the plate member 43 having the electrode portion 44, being in contact with the developing layer on the developing roller 41, and arrangement of the plate member 43 with respect to other members will be explained below using an enlarged view of the vicinity of the development zone shown in FIG. 7.

Figure 7:
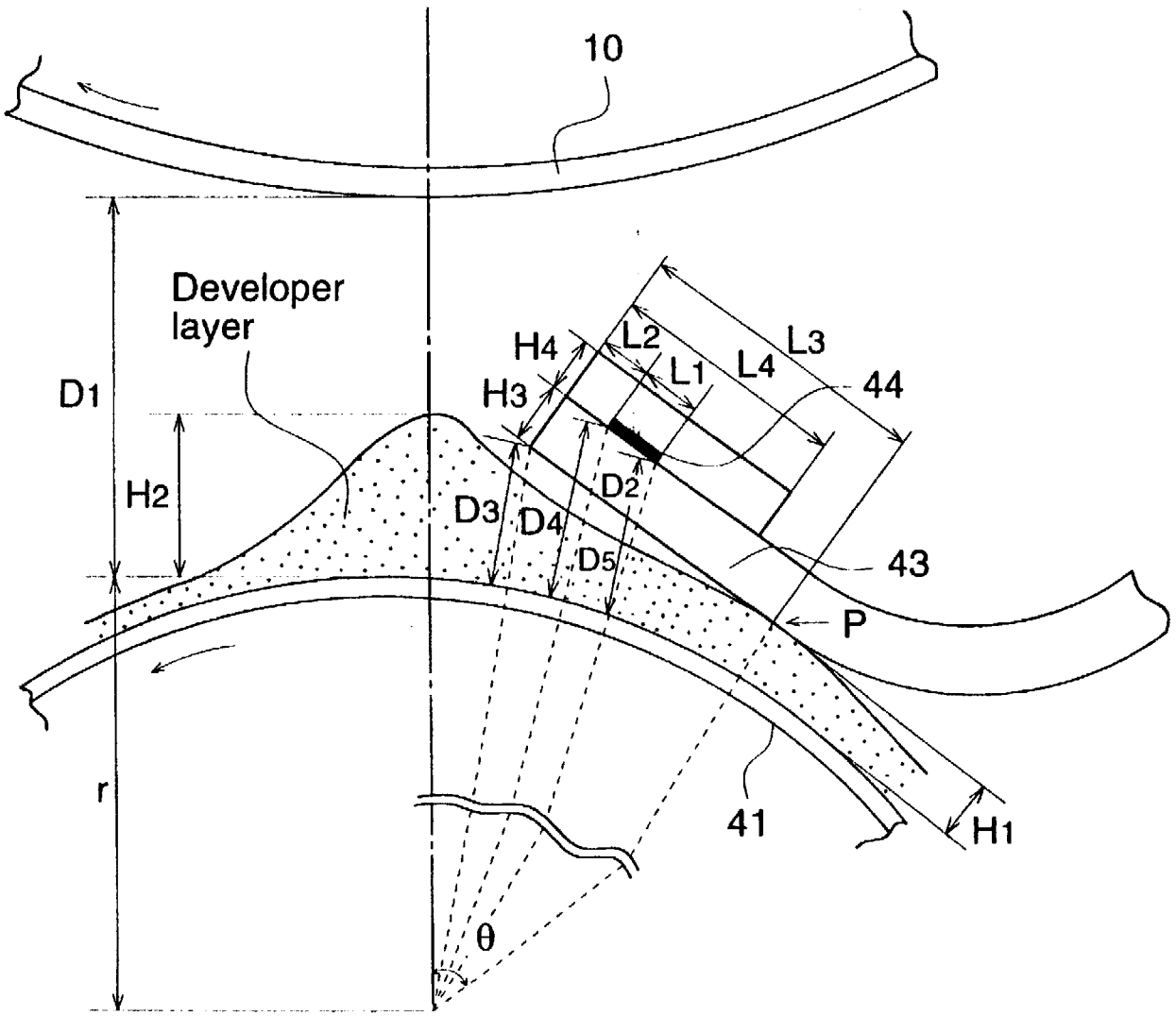
FIG. 7 is an enlarged view of the vicinity of the development zone in which the plate member having the electrode portion is provided.

In FIG. 7, $L_1$ is the width of the electrode portion 44 of the plate member 43 in the moving direction of the developing roller 41, and $L_2$ is the width of the hood-like portion of the plate member 43 in the moving direction of the developing roller 41. $L_3$ is a distance between a position P, at which the plate member 43 is in contact with the developer on the developing roller 41 (hereinafter, called contact point), and the portion on the downstream side of the plate member 43. $L_4$ is the width of a coating layer in the moving direction of the developing roller 41 in the case where the plate member 43, having the electrode portion 44, has the coating layer shown in FIG. 6(*c*) or FIG. 6(*d*). $D_1$ is the closest distance between the photoreceptor drum 10 and the developing roller 41. $D_2$ is the closest distance between the electrode portion 44 of the plate member 43 and the developing roller 41. $D_3$ is the closest distance between the end portion on the downstream side of the plate member 43 and the developing roller 41. $D_4$ is the closest distance between the end portion on the downstream side of the electrode member 44 and the developing roller 41. $D_5$ is the closest distance between the end portion on the upstream side of the electrode portion 44 and the developing roller 41. $H_1$ is the thickness of the developer layer at the contact point, and $H_2$ is the thickness of the developer layer or the height of the bristles of the magnetic brush at the closest position between the photoreceptor drum 10 and the developing roller 41. $H_3$ is the thickness of the plate member 43, having the electrode portion 44, in the downward direction from the electrode member 44, that is, the thickness of the plate member 43 on the side nearest the developing roller 41. $H_4$ is the thickness of the plate member 43, having the electrode portion 44, in the upward direction from the electrode portion 44, i.e., the thickness of the plate member 43 on the side nearest the photoreceptor 10. The symbol r represents the radius of curvature of the developing roller 41 in the development zone. The symbol θ is an angle formed between the line, connecting the closest position between the photoreceptor drum 10 and the developing roller 41, to the center of the curvature of the developing roller 41, and the line, connecting the contact point to the center of curvature of the developing roller 41, (hereinafter, the angle θ will be called the contact point angle).

The width $L_1$ of the electrode portion 44 of the plate member 43 is normally 0.2 to 3 mm, and preferably 0.3 to 1 mm. The width $L_2$ of the hood-like portion of the plate member 43 is normally up to 1 mm, and preferably 0.1 to 0.5 mm. The distance $L_3$ between the contact point and the end portion on the downstream side of the plate member 43 is normally 1 to 5 mm.

The relationship among $L_1$, $L_2$ and $L_3$ is preferably $$L_3>L_1>L_2\geqq 0$$

In the case where the plate member 43, having the electrode portion 44, has the coating layer shown in FIG. 6(*c*) or FIG. 6(*d*), the width $L_4$ of the coating layer is normally 0.2 to 5 mm, and it is preferable that $L_4$ is expressed as follows:

$$L_1+L_2\geqq L_4<L_3$$

The closest distance $D_1$ between the photoreceptor drum 10 and the developing roller 41 is normally 0.2 to 1 mm, and the plate member 43 is arranged in such a manner that it is not in contact with the photoreceptor drum 10. The closest distance $D_2$ between the electrode portion 44 and the developing roller 41 is normally about 0.05 to 0.5 mm, and the closest distance $D_3$ between the plate member end portion on the downstream side of the plate member 43 and the developing roller 41 is normally about 0.05 to 0.5 mm. The closest distance $D_4$ between the end portion on the downstream side of the electrode portion 44 and the developing roller 41 is normally about 0.1 to 0.6 mm. The closest distance $D_5$ between the end portion on the upstream side of the electrode portion 44 and the developing roller 41 is normally about 0.05 to 0.5 mm.

The relationships among $D_1$, $D_2$, $D_3$, $D_4$, $D_5$, the thickness $H_1$ of the developing layer at the contact point, and the thickness $H_2$ of the developing layer at the closest position between the photoreceptor drum 10 and the developing roller 41 are preferably as follows:

$$D_4>D_2=D_5>H_1$$

and are more preferably $$D_4 \geqq D_3>H_2$$

and $$0.6 \cdot D_1 \geqq D_3 \geqq 0.2 \cdot D_1$$

In the thickness of the plate member 43 having the electrode portion 44, the thickness $H_3$ of a layer of the plate member 43, on the lower side of the electrode portion 44 located on the plate member, is normally about 0.05 to 0.5 mm, and the thickness $H_4$ of the layer of the plate member 43 on the upper side of the electrode portion 44, is normally no more than 0.5 mm.

The relationship among $H_3$, $H_4$ and $D_1$ is preferably as follows:

$$H_3+H_4 \geqq D_1/2$$

Further, in the case where the plate member 43 having the electrode portion 44 is structured by multi-layers as shown in FIGS. 6(*c*) to 6(*f*), the value obtained when the thickness $H_3$ of the layer of the plate member, on the lower side of the electrode portion 44, is divided by the dielectric constant of the layer, is preferably greater than a value obtained when the thickness $H_4$ of the layer of the plate member, on the upper side of the electrode portion 44, is divided by the dielectric constant of the layer.

The radius of curvature r of the developing roller 41 in the development zone is normally about 2.5 to 15 mm, and the contact point angle θ is normally 10° to 30°.

It is preferable that the relationship among r, θ, the distance $L_3$ between the contact point and the end portion on the downstream side of the plate member 43, and the closest distance $D_1$ between the photoreceptor drum 10 and the developing roller 41 is as follows:

$$L_3 \cdot \cos\theta \leqq r \sin\theta$$

and $$D_1 \leqq r(1-\cos\theta)$$

When the moving speed of the developing roller 41 is $V_r$, and the moving speed of the photoreceptor drum 10 is $V_p$, it is preferable that $V_r$ is 1 to 3 times as much as $V_p$. The moving direction of the developing roller 41 is the same as that of the photoreceptor drum in the development zone in which the developing roller is opposed to the photoreceptor drum 10.

It is preferable that the thickness $H_1$ of the developer layer at the contact point, and the thickness $H_2$ of the developer layer at the closest position between the photoreceptor drum 10 and the developing roller 41 satisfy the following relationship, $$H_2>H_1$$

and specifically $$4 \cdot H_1 \geqq H_2 \geqq 2 \cdot H_1$$

In order to set $H_1$ and $H_2$ in the above relationship, it is preferable that the main magnetic pole of the magnetic body 42, which is fixed inside the developing roller 41, is arranged at the closest position between the photoreceptor drum 10 and the developing roller 41, or between the closest position and the contact point.

Further, when the width of the plate member 43 is $W_1$, the width of the electrode portion 44 of the plate member 43 is $W_2$, the width of the developer layer conveyed onto the developing roller 41 is $W_3$, and the width of the latent image formed on the photoreceptor drum 10 in the direction perpendicular to the moving direction of the photoreceptor drum 10, is $W_4$, it is preferable that the following relationship is satisfied:

$$W_1>W_3>W_2>W_4$$

Next, toner T will be explained.

Generally, when the average particle size $d_t$ of toner T is increased, the granular appearance of the image becomes conspicuous. In order to obtain the resolving power of fine lines arranged at, normally, a pitch of about 10 lines/mm, the average particle size $d_t$ may be about 20 μm, which results in acceptable quality. However, in order to obtain the high quality image in which the resolving power is further increased and the difference of density is accurately reproduced, it is preferable that the average particle size $d_t$ of the toner T is quite small. It is preferable that the average particle size d of the toner T is smaller than 10 μm, and specifically, 4 to 6 μm.

The average particle size $d_t$ of toner T is obtained as follows: in a suspension which is obtained when a sample of about 1 mg and surface active agent are supplied into about 200 ml of electrolyte, and the electrolyte is dispersed by an ultrasonic dispersion unit for about 1 minute, the volume average particle size distribution is measured by a particle size distribution measuring device [Coulter Counter TA-II type] (made by Japan Scientific Instrument Co., aperture: 100 μm.

When the absolute value of $Q_t$, which is the average charge amount of toner T, is increased, it is necessary to strengthen the electric field for adequate scattering of the toner T. In this case, discharge easily occurs in the gap formed between the electrode portion 44 and the developing roller 41. Conversely, when the absolute value of $Q_t$, which is the average charge amount of the toner T, is too small, the toner T scatters too easily from the developing apparatus. $Q_t$ of the average charge amount of the toner T is normally abut 5 to 40 μC/g.

$Q_t$ of the average charge amount of toner T is obtained as follows: a conductive plate of 2 cm×5 cm is arranged in such a manner that it is opposed to the developing roller, having a diameter of 20 mm, with a closest distance of 0.7 mm; developer is supplied onto the developing roller 41; a voltage in which the DC voltage is superimposed on the AC voltage (for example, $V_{DC}$=1000 [V], $V_{AC}$=1500 [V], a frequency of AC voltage is 8 [kHz]), is impressed upon the developing roller 41 while the developing roller 41 is being rotated at 200 rpm; the toner T is developed onto the conductive plate; the conductive plate, on which the toner T has been developed, is connected to a Faraday cage, and the toner T is blown off; and then, the charge amount and the weight of the blown-off toner T are measured.

Next, the AC component of the composite voltage to be impressed upon the developing roller 41 will be explained. When the frequency is $f_{AC}$ [Hz], the unit of the width $L_1$ of the electrode portion 44 of the plate member 43 in the moving direction of the developing roller 41 is [mm], and the unit of the moving speed $V_r$ of the developing roller 41 is [mm/sec], it is preferable that the frequency of the AC component is expressed by the following relationship:

$$f_{AC} \geqq 10 \cdot V_r / L_1$$

The wave form of the AC component may be either of a sine wave, a rectangular wave, or a triangular wave. However, the rectangular wave is preferable for efficiently generating the toner cloud.

The plate member 43 shown in FIG. 6 was described above as the plate member 43, having the electrode portion, used in the developing apparatus 40 of the image forming apparatus of the present invention. However, of course, either plate member, having the composition derived from the above-described plate member, can also be used for the image forming apparatus of the present invention.

In the developing apparatus 40 used for the image forming apparatus of the present invention, toner T can be made as follows: coloring components such as carbon black, coloring pigment, or coloring dye, and charge control agent, etc., are supplied into resins such as, for example, styrene resin, vinyl resin, acrylic resin, polyamide resin, silicon resin, polyester resin, fluororesin, epoxy resin, or the like; and the toner T is made by the same method as the conventional toner particle manufacturing methods. Further, when necessary, fluidization agents to increase the fluidity of particles or cleaning agents to clean the surface of the image forming body can be mixed into the toner T. Colloidal silica, silicon varnish, metallic soap, nonionic surface active agents, or the like, can be used as the fluidity agents. Fatty acid metallic salts, organic group substitution silicone or fluorine surface active agents may be used as cleaning agents.

Particles obtained from the following particles may be used as carrier C: spherical particles of ferromagnetic material or paramagnetic material including metals such as iron, chrome, nickel, cobalt, zinc, copper, etc., or their compounds or alloys, for example, such as γ-ferric oxide, chromium dioxide, manganese oxide, ferrite, etc.; the particles in which the surface of the above-described magnetic particles is spherically coated with resin such as styrene resin, vinyl resin, ethylene resin, acrylic resin, polyamide resin, polyester resin, etc.; or spherical particles made of resin including dispersed magnetic fine powders or spherical particles made of fatty acid wax. Particles having an average particle size smaller than 70 μm, preferably an average particle size of about 30 to 50 m, are satisfactorily used.

Although the present invention was explained using the two-component developer, the present invention is not limited to a two-component developer, and even when a one-component developer is used, the same effects can also be obtained.

An example of the present invention will be explained more specifically below.

[Developing apparatus]

Upper covers of casings 49 of the 4 developing apparatus, in which yellow (Y), magenta (M), cyan (C) and black (K) developers are respectively accommodated, which are used for the full color copier [Konica 9028] (made by Konica Corp.), are respectively modified, and one end of each plate member, which will be described later, is fixed to an end portion of each upper cover. The developing apparatus 40A, 40B, 40C and 40D of the present invention are made as described above.

[Image forming apparatus]

The image forming apparatus of the present invention is structured as follows: the original developing apparatus, respectively including yellow (Y), magenta (M), cyan (C), and black (K) developers, for use in the full color copier [Konica 9028] (made by Konica corp.), are replaced by the developing apparatus 40A, 40B, 490C and 40D of the present invention; and a power source, by which a voltage is impressed upon the developing roller of each developing apparatus and the electrode portion of each plate member, is provided outside the apparatus. Timing at which the DC voltage is impressed upon each electrode portion, and timing at which only the DC voltage is impressed upon each developing roller, are made to be the same as timing at which the photoreceptor drum is charged. Timing, at which the composite voltage of the AC component and the DC component is impressed upon the developing roller, is made to be the same as the timing at which each developing roller is driven.

[Developer]

Five types of developers shown in Table 1 were used in this example.

TABLE 1

| Developer No. | Yellow | Magenta | Cyan | Black 1 | Black 2 |
|---|---|---|---|---|---|
| Average particle size of toner $d_t$ | 8.5 μm | 9.0 μm | 8.7 μm | 8.3 μm | 5.2 μm |
| Average particle size of carrier | 46 μm | 46 μm | 46 μm | 46 μm | 46 μm |
| Toner density | 7 wt. % | 7.5 wt. % | 7 wt. % | 7 wt. % | 9 wt. % |
| The average charge amount of toner $Q_t$ | −21 μC/g | −17 μC/g | −23 μC/g | −24 μC/g | −30 μC/g |

[The plate member having the electrode portion]

Three types of the member shown in Table 2 were used in this example.

TABLE 2

| Plate member No. | Member-1 | Member-2 | Member-3 |
|---|---|---|---|
| Composition | Shown in FIG. 5(c) | Shown in FIG. 5(d) | Shown in FIG. 5(d) |
| Width $L_1$ of the electrode portion | 0.5 mm | 0.5 mm | 0.5 mm |
| Width $L_2$ of the hood-like portion | 0 mm | 0.1 mm | 0.3 mm |
| Width $L_4$ of the coating layer | 2.0 mm | 2.0 mm | 2.0 mm |
| Thickness $H_3$ of the lower side layer | 0.1 mm | 0.1 mm | 0.1 mm |
| Thickness $H_4$ of the upper side layer | 0.1 mm | 0.1 mm | 0.1 mm |

[Conditions common to each example]

Conditions common to each example are shown in Table 3.

TABLE 3

| | |
|---|---|
| Closest distance $D_1$ between the photoreceptor drum and the developing roller | 0.5 mm |
| Radius r of the developing roller | 10 mm |
| Moving speed $V_r$ of the developing roller 41 | 280 mm/sec |
| Moving speed $V_p$ of the photoreceptor drum 10 | 140 mm/sec |
| Frequency $f_{AC}$ of the AC component to be impressed upon the developing roller | 8000 $H_z$ |
| Waveform of the AC component to be impressed upon the developing roller | Rectangular wave |
| The DC component to be impressed upon the developing roller | −750 V |
| The potential voltage $V_H$ of the latent image in the background portion | −850 V |
| The potential voltage $V_L$ of the latent image in the solid portion | −50 V |

(Example 1-1)

Conditions of the developing apparatus were set as shown in the following Table 4. $V_{DEN}$ of the DC voltage to be impressed upon the electrode portion was set to −750 V. The image was developed in a mono-color mode while the AC component $V_{AC}$ to be impressed upon the developing roller was being changed. The weight of the toner adhered onto every unit area of the photoreceptor drum surface, corresponding to the solid portion, (hereinafter, called primary adhered amount M/A [mg/cm$^2$]), and the number of toner particles adhered onto every unit area of the surface of the photoreceptor drum, corresponding to the background portion, (hereinafter, called the number of fogging toner particles $N_1$ [pieces/mm$^2$]), were measured, and the result was judged by the following criterion.

The criterion for evaluation of the primary adhered amount M/A [mg/cm$^2$]

(In the case where the average particle size of toner is d [μm]):

○ . . . $d \times 0.8 \leqq M/A$

Δ . . . $d \times 0.6 \leqq M/A < d \times 0.8$

X . . . $M/A < d \times 0.6$

The criterion for evaluation of the number $N_1$ of fogging toner particles [pieces/mm$^2$]:

○ . . . $N_1 \leqq 10$

Δ . . . $10 < N_1 \leqq 20$

X . . . $20 \leqq N_1$

TABLE 4

| | |
|---|---|
| Developing apparatus | 40A |
| Developer No. | Yellow |
| Plate member No. | Member-1 |
| Angle θ of the contact point | 15° |
| The thickness $H_1$ of the developer layer at the contact point | 0.1 mm |
| The thickness $H_2$ of the developer layer at the closest position to the drum | 0.25 mm |
| The distance $L_3$ between the contact point and the end portion on the downstream side of the plate member | 2 mm |
| The closest distance $D_2$ between the electrode portion and the developing roller | 0.31 mm |
| The closest distance $D_3$ between the end portion on the downstream side of the plate member and the developing roller | 0.3 mm |
| The closest distance $D_4$ between the end portion on the downstream side of the electrode portion and the developing roller | 0.39 mm |
| The closest distance $D_5$ between the end portion on the upstream side of the electrode portion and the developing roller | 0.31 mm |

This result is shown in Table 5.

TABLE 5

| $V_{AC}$ [V] | M/A [mg/cm$^2$] | $N_1$ [pcs/mm$^2$] |
|---|---|---|
| 0 | x | ○ |
| 100 | x | ○ |
| 200 | Δ | ○ |
| 300 | ○ | ○ |
| 400 | ○ | ○ |
| 500 | ○ | ○ |
| 600 | ○ | ○ |
| 700 | ○ | ○ |
| 800 | ○ | ○ |
| 900 | ○ | ○ |
| 1000 | ○ | Δ |
| 1100 | ○ | x |
| 1200 | ○ | x |
| 1300 | ○ | x |
| 1400 | ○ | x |
| 1500 | ○ | x |

(Example 1-2)

Conditions of the developing apparatus were set to the same conditions as Example 1-1. The AC component $V_{AC}$ to be impressed upon the developing roller was fixed at 500 V. The image was developed in a mono-color mode while $V_{DEN}$ of the DC voltage to be impressed upon the electrode portion was being changed. The primary adhered amount M/A and the number $N_1$ of the fogging toner particles were measured, and evaluated in the same manner as Example 1-1. The result is shown in Table 6.

TABLE 6

| $V_{DEN}$ [V] | M/A [mg/cm$^2$] | $N_1$ [pcs/mm$^2$] |
|---|---|---|
| −300 | ○ | x |
| −400 | ○ | x |
| −500 | ○ | x |
| −600 | ○ | x |
| −700 | ○ | ○ |
| −800 | ○ | ○ |
| −900 | ○ | ○ |
| −1000 | ○ | ○ |
| −1100 | ○ | ○ |
| −1200 | Δ | ○ |
| −1300 | x | ○ |

(Example 2-1)

Conditions of the developing apparatus were set to conditions shown in Table 7. $V_{DEN}$ of the DC voltage to be impressed upon the electrode portion was fixed at −750 V. The image was developed in a mono-color mode while the AC component $V_{AC}$ to be impressed upon the developing roller was being changed. The primary adhered amount M/A and the number $N_1$ of the fogging toners were measured, and evaluated in the same manner as Example 1-1. The result is shown in Table 8.

TABLE 7

| | |
|---|---|
| Developing apparatus | 40B |
| Developer No. | Magenta |
| Plate member No. | Member-2 |
| Angle θ of the contact point | 15° |
| The thickness $H_1$ of the developer layer at the contact point | 0.1 mm |
| The thickness $H_2$ of the developer layer at the closest position to the drum | 0.25 mm |
| The distance $L_3$ between the contact point and the end portion on the downstream side of the plate member | 2 mm |
| The closest distance $D_2$ between the electrode portion and the developing roller | 0.3 mm |
| The closest distance $D_3$ between the end portion on the downstream side of the plate member and the developing roller | 0.3 mm |
| The closest distance $D_4$ between the end portion on the downstream side of the electrode portion and the developing roller | 0.38 mm |
| The closest distance $D_5$ between the end portion on the upstream side of the electrode portion and the developing roller | 0.3 mm |

TABLE 8

| $V_{AC}$ [V] | M/A [mg/cm²] | $N_1$ [pcs/mm²] |
|---|---|---|
| 0 | x | ○ |
| 100 | x | ○ |
| 200 | ○ | ○ |
| 300 | ○ | ○ |
| 400 | ○ | ○ |
| 500 | ○ | ○ |
| 600 | ○ | ○ |
| 700 | ○ | ○ |
| 800 | ○ | ○ |
| 900 | ○ | Δ |
| 1000 | ○ | Δ |
| 1100 | ○ | x |
| 1200 | ○ | x |
| 1300 | ○ | x |
| 1400 | ○ | x |
| 1500 | ○ | x |

(Example 2-2)

Conditions of the developing apparatus were set to the same conditions as Example 2-1. The AC component $V_{AC}$ to be impressed upon the developing roller was fixed at 500 V. The image was developed in a mono-color mode while $V_{DEN}$ of the DC voltage to be impressed upon the electrode portion was being changed. The primary adhered amount M/A and the number $N_1$ of the fogging toner particles were measured, and evaluated in the same manner as Example 1-1. The result is shown in Table 9.

TABLE 9

| $V_{DEN}$ [V] | M/A [mg/cm²] | $N_1$ [pcs/mm²] |
|---|---|---|
| −300 | ○ | x |
| −400 | ○ | x |
| −500 | ○ | x |
| −600 | ○ | Δ |
| −700 | ○ | ○ |
| −800 | ○ | ○ |
| −900 | ○ | ○ |
| −1000 | ○ | ○ |
| −1100 | ○ | ○ |
| −1200 | Δ | ○ |
| −1300 | x | ○ |

(Example 3-1)

Conditions of the developing apparatus were set to conditions shown in Table 10. $V_{DEN}$ of the DC voltage to be impressed upon the electrode portion was fixed at −750 V. The image was developed in a mono-color mode while the AC component $V_{AC}$ to be impressed upon the developing roller was being changed. The primary adhered amount M/A and the number $N_1$ of the fogging toners were measured, and evaluated in the same manner as Example 1-1. The result is shown in Table 11.

TABLE 10

| | |
|---|---|
| Developing apparatus | 40C |
| Developer No. | Cyan |
| Plate member No. | Member-3 |
| Angle θ of the contact point | 15° |
| The thickness $H_1$ of the developer layer at the contact point | 0.1 mm |
| The thickness $H_2$ of the developer layer at the closest position to the drum | 0.25 mm |
| The distance $L_3$ between the contact point and the end portion on the downstream side of the plate member | 2 mm |
| The closest distance $D_2$ between the electrode portion and the developing roller | 0.27 mm |
| The closest distance $D_3$ between the end portion on the downstream side of the plate member and the developing roller | 0.3 mm |
| The closest distance $D_4$ between the end portion on the downstream side of the electrode portion and the developing roller | 0.34 mm |
| The closest distance $D_5$ between the end portion on the upstream side of the electrode portion and the developing roller | 0.27 mm |

TABLE 11

| $V_{AC}$ [V] | M/A [mg/cm²] | $N_1$ [pcs/mm²] |
|---|---|---|
| 0 | x | ○ |
| 100 | x | ○ |
| 200 | Δ | ○ |
| 300 | ○ | ○ |
| 400 | ○ | ○ |
| 500 | ○ | ○ |
| 600 | ○ | ○ |
| 700 | ○ | ○ |
| 800 | ○ | ○ |
| 900 | ○ | ○ |
| 1000 | ○ | ○ |
| 1100 | ○ | Δ |
| 1200 | ○ | Δ |
| 1300 | ○ | Δ |
| 1400 | ○ | x |
| 1500 | ○ | x |

(Example 3-2)

Conditions of the developing apparatus were set to the same conditions as Example 3-1. The AC component $V_{AC}$ to be impressed upon the developing roller was fixed at 500 V. The image was developed in a mono-color mode while $V_{DEN}$ of the DC voltage to be impressed upon the electrode portion was being changed. The primary adhered amount M/A and the number $N_1$ of the fogging toner particles were measured, and evaluated in the same manner as Example 1-1. The result is shown in Table 12.

TABLE 12

| $V_{DEN}$ [V] | M/A [mg/cm²] | $N_1$ [pcs/mm²] |
|---|---|---|
| −300 | ○ | x |
| −400 | ○ | x |
| −500 | ○ | Δ |
| −600 | ○ | Δ |
| −700 | ○ | ○ |
| −800 | ○ | ○ |
| −900 | ○ | ○ |
| −1000 | ○ | ○ |
| −1100 | ○ | ○ |
| −1200 | Δ | ○ |
| −1300 | x | ○ |

(Example 4-1)

Conditions of the developing apparatus were set to conditions shown in Table 13. $V_{DEN}$ of the DC voltage to be impressed upon the electrode portion was fixed at −750 V. The image was developed in a mono-color mode while the AC component $V_{AC}$ to be impressed upon the developing roller was being changed. The primary adhered amount M/A and the number $N_1$ of the fogging toner particles were measured, and evaluated in the same manner as Example 1-1. The result is shown in Table 14.

TABLE 13

| | |
|---|---|
| Developing apparatus | 40D |
| Developer No. | Black-1 |
| Plate member No. | Member-3 |
| Angle θ of the contact point | 15° |
| The thickness $H_1$ of the developer layer at the contact point | 0.1 mm |
| The thickness $H_2$ of the developer layer at the closest position to the drum | 0.25 mm |
| The distance $L_3$ between the contact point and the end portion on the downstream side of the plate member | 2 mm |
| The closest distance $D_2$ between the electrode portion and the developing roller | 0.27 mm |
| The closest distance $D_3$ between the end portion on the downstream side of the plate member and the developing roller | 0.3 mm |
| The closest distance $D_4$ between the end portion on the downstream side of the electrode portion and the developing roller | 0.34 mm |
| The closest distance $D_5$ between the end portion on the upstream side of the electrode portion and the developing roller | 0.27 mm |

TABLE 14

| $V_{AC}$ [V] | M/A [mg/cm²] | $N_1$ [pcs/mm²] |
|---|---|---|
| 0 | x | ○ |
| 100 | x | ○ |
| 200 | x | ○ |
| 300 | ○ | ○ |
| 400 | ○ | ○ |
| 500 | ○ | ○ |
| 600 | ○ | ○ |
| 700 | ○ | ○ |
| 800 | ○ | ○ |
| 900 | ○ | ○ |
| 1000 | ○ | ○ |
| 1100 | ○ | Δ |
| 1200 | ○ | Δ |
| 1300 | ○ | Δ |
| 1400 | ○ | x |
| 1500 | ○ | x |

(Example 4-2)

Conditions of the developing apparatus were set to the same conditions as Example 4-1. The AC component $V_{AC}$ to be impressed upon the developing roller was fixed at 600 V. The image was developed in a mono-color mode while $V_{DEN}$ of the DC voltage to be impressed upon the electrode portion was being changed. The primary adhered amount M/A and the number $N_1$ of the fogging toner particles were measured, and evaluated in the same manner as Example 1-1. The result is shown in Table 15.

TABLE 15

| $V_{DEN}$ [V] | M/A [mg/cm²] | $N_1$ [pcs/mm²] |
|---|---|---|
| −300 | ○ | x |
| −400 | ○ | x |
| −500 | ○ | Δ |
| −600 | ○ | Δ |
| −700 | ○ | ○ |
| −800 | ○ | ○ |
| −900 | ○ | ○ |
| −1000 | ○ | ○ |
| −1100 | ○ | ○ |
| −1200 | Δ | ○ |
| −1300 | x | ○ |

(Example 5-1)

Conditions of the developing apparatus were set to conditions shown in Table 16. $V_{DEN}$ of the DC voltage to be impressed upon the electrode portion was fixed at −750 V. The image was developed in a mono-color mode while the AC component $V_{AC}$ to be impressed upon the developing roller was being changed. The primary adhered amount M/A and the number $N_1$ of the fogging toner particles were measured, and evaluated in the same manner as Example 1-1. The result is shown in Table 17.

TABLE 16

| | |
|---|---|
| Developing apparatus | 40D |
| Developer No. | Black-2 |
| Plate member No. | Member-3 |
| Angle θ of the contact point | 15° |
| The thickness $H_1$ of the developer layer at the contact point | 0.1 mm |
| The thickness $H_2$ of the developer layer at the closest position to the drum | 0.25 mm |
| The distance $L_3$ between the contact point and the end portion on the downstream side of the plate member | 2 mm |
| The closest distance $D_2$ between the electrode portion and the developing roller | 0.27 mm |
| The closest distance $D_3$ between the end portion on the downstream side of the plate member and the developing roller | 0.3 mm |
| The closest distance $D_4$ between the end portion on the downstream side of the electrode portion and the developing roller | 0.34 mm |
| The closest distance $D_5$ between the end portion on the upstream side of the electrode portion and the developing roller | 0.27 mm |

TABLE 17

| $V_{AC}$ [V] | M/A [mg/cm²] | $N_1$ [pcs/min²] |
|---|---|---|
| 0 | X | ○ |
| 100 | X | ○ |
| 200 | ○ | ○ |
| 300 | ○ | ○ |
| 400 | ○ | ○ |
| 500 | ○ | ○ |

TABLE 17-continued

| $V_{AC}$ [V] | M/A [mg/cm²] | $N_1$ [pcs/min²] |
|---|---|---|
| 600 | ○ | ○ |
| 700 | ○ | ○ |
| 800 | ○ | ○ |
| 900 | ○ | Δ |
| 1000 | ○ | Δ |
| 1100 | ○ | Δ |
| 1200 | ○ | X |
| 1300 | ○ | X |
| 1400 | ○ | X |
| 1500 | ○ | X |

(Example 5-2)

Conditions of the developing apparatus were set to the same conditions as Example 5-1. The AC component $V_{AC}$ to be impressed upon the developing roller was fixed at 500 V. The image was developed in a mono-color mode while $V_{DEN}$ of the DC voltage to be impressed upon the electrode portion was being changed. The primary adhered amount M/A and the number $N_1$ of the fogging toner particles were measured, and evaluated in the same manner as Example 1-1. The result is shown in Table 18.

TABLE 18

| $V_{DEN}$ [V] | M/A [mg/cm²] | $N_1$ [pcs/mm²] |
|---|---|---|
| −300 | ○ | X |
| −400 | ○ | Δ |
| −500 | ○ | Δ |
| −600 | ○ | Δ |
| −700 | ○ | ○ |
| −800 | ○ | ○ |
| −900 | ○ | ○ |
| −1000 | ○ | ○ |
| −1100 | ○ | ○ |
| −1200 | Δ | ○ |
| −1300 | X | ○ |

In this connection, values of $10\cdot|Q_t|\cdot d_t\cdot D_1$ and $5\cdot|Q_t|\cdot d_t\cdot D_2$ in Examples 1-1 through 5-1, are as shown in Table 19. When the value of $V_{AC}$ is set within the range expressed by the following relationship: $10\cdot|Q_t|\cdot d_t\cdot D_1>V_{AC}>5\cdot|Q_t|\cdot d_t\cdot D_2$, then, both the primary adhered amount M/A and the number $N_1$ of fogging toner particles can show excellent results. When $V_{AC}$ is too large, the number $N_1$ of fogging toner particles is increased. Conversely, when $V_{AC}$ is too small, the primary adhered amount M/A is insufficient. In both cases, desired results can not be obtained.

TABLE 19

| | $10\cdot|Q_t|\cdot d_t\cdot D_1$ [V] | $5\cdot|Q_t|\cdot d_t\cdot D_2$ [V] |
|---|---|---|
| Example 1-1 | 892 | 277 |
| Example 2-1 | 765 | 226 |
| Example 3-1 | 1001 | 270 |
| Example 4-1 | 996 | 269 |
| Example 5-1 | 780 | 211 |

Values of the mathematical expressions, $|V_{DC}|+|V_{DC}-V_L|\cdot D_3/D_1$, and $|V_{DC}|-|V_H-V_{DC}|\cdot(1-D_3/D_1)$, are as shown in Table 20. When the value of $|V_{DEN}|$ is set as follows: $|V_{DC}|+|V_{DC}-V_L|\cdot D_3/D_1>|V_{DEN}|>|V_{DC}|-|V_H-V_{DC}|\cdot(1-D_3/D_1)$, then, both the primary adhered amount M/A and the number $N_1$ of fogging toner particles can have desired results. When $|V_{DEN}|$ is too great, the primary adhered amount M/A is insufficient. Conversely, when $|V_{DEN}|$ is too small, the number $N_1$ of fogging toner particles is increased. In both cases, desired results can not be obtained.

TABLE 20

| | $\|V_{DC}\|+\|V_{DC}-V_L\|\cdot D_3/D_1$ [V] | $\|V_{DC}\|-\|V_H-V_{DC}\|\cdot(1-D_3D_1)$ [V] |
|---|---|---|
| Example 1-2 | 1164 | 709 |
| Example 2-2 | 1164 | 709 |
| Example 3-2 | 1164 | 709 |
| Example 4-2 | 1164 | 709 |
| Example 5-2 | 1164 | 709 |

(Example 6)

Conditions of each developing apparatus of the image forming apparatus were set as shown in Tables 4, 7, 10 and 13. $|V_{DEN}|$ of the DC voltage to be impressed upon the electrode portion was set to −750 V in each developing apparatus. The AC component $V_{AC}$ to be impressed upon the developing roller of each developing apparatus was set as shown in Table 19. Developing was carried out in the sequence of yellow→magenta→cyan→black in the full-color mode, and toner images were superimposed on the photoreceptor drum. The number of other color toners per unit area, in which color toners of yellow, magenta and cyan adhered to each solid portion of each color toner, (hereinafter, called the number of mixed color toners $N_2$ [pcs/mm²]), were measured, and judged on the following criterion. The result is shown in Table 21.

The criterion of evaluation of the mixed color toners $N_2$ [pcs/mm²]:

○ . . . $N_2\leqq 20$

Δ . . . $20<N_2\leqq 40$

X . . . $40\leqq N_2$

TABLE 21

| Experiments | $V_{AC}$ [V] | | | | $N_2$ [pcs/mm²] | | |
|---|---|---|---|---|---|---|---|
| No. | Yellow | Magenta | Cyan | Black | Yellow | Magenta | Cyan |
| 6-1 | 300 | 300 | 300 | 300 | ○ | ○ | ○ |
| 6-2 | 400 | 300 | 300 | 300 | ○ | ○ | ○ |
| 6-3 | 300 | 400 | 300 | 300 | x | ○ | ○ |
| 6-4 | 300 | 300 | 400 | 300 | x | x | ○ |
| 6-5 | 300 | 300 | 300 | 400 | x | x | x |
| 6-6 | 400 | 400 | 300 | 300 | ○ | ○ | ○ |
| 6-7 | 300 | 400 | 400 | 300 | x | ○ | ○ |
| 6-8 | 300 | 300 | 400 | 400 | x | x | ○ |
| 6-9 | 400 | 500 | 300 | 300 | x | ○ | ○ |
| 6-10 | 300 | 400 | 500 | 300 | x | x | ○ |
| 6-11 | 300 | 300 | 400 | 500 | x | x | x |
| 6-12 | 500 | 400 | 300 | 300 | ○ | ○ | ○ |
| 6-13 | 300 | 500 | 400 | 300 | x | ○ | ○ |
| 6-14 | 300 | 300 | 500 | 400 | x | x | ○ |
| 6-15 | 500 | 500 | 400 | 300 | ○ | ○ | ○ |
| 6-16 | 500 | 500 | 300 | 400 | ○ | ○ | x |
| 6-17 | 300 | 350 | 400 | 400 | x | Δ | ○ |
| 6-18 | 300 | 300 | 350 | 400 | x | x | Δ |
| 6-19 | 400 | 350 | 300 | 300 | ○ | ○ | ○ |
| 6-20 | 500 | 450 | 400 | 300 | ○ | ○ | ○ |

In this example, the closest distance $D_1$ between the developing roller and the photoreceptor drum is 0.5 mm in each developing apparatus. Accordingly, the strength of the oscillation electric field in the gap between the photoreceptor drum and developing roller is determined depending on the value of the AC component $V_{AC}$ to be impressed upon the developing roller. As shown in Table 21, when the values of $V_{AC}$ to be impressed upon the developing rollers in the developing apparatus, in which yellow, magenta, cyan and black toners are respectively accommodated, are set in the following relationship:

$V_{AC}$(yellow)≧$V_{AC}$(magenta)≧$V_{AC}$(cyan)≧$V_{AC}$(black), then, an excellent multi-color image having no mixing of color can be obtained. On the other hand, when the value of $V_{AC}$ is set to be larger than that in the preceding developing process, the toner developed in the preceding developing process is mixed with the current toner image, and therefore, an excellent image can not be obtained.

Figure 8:
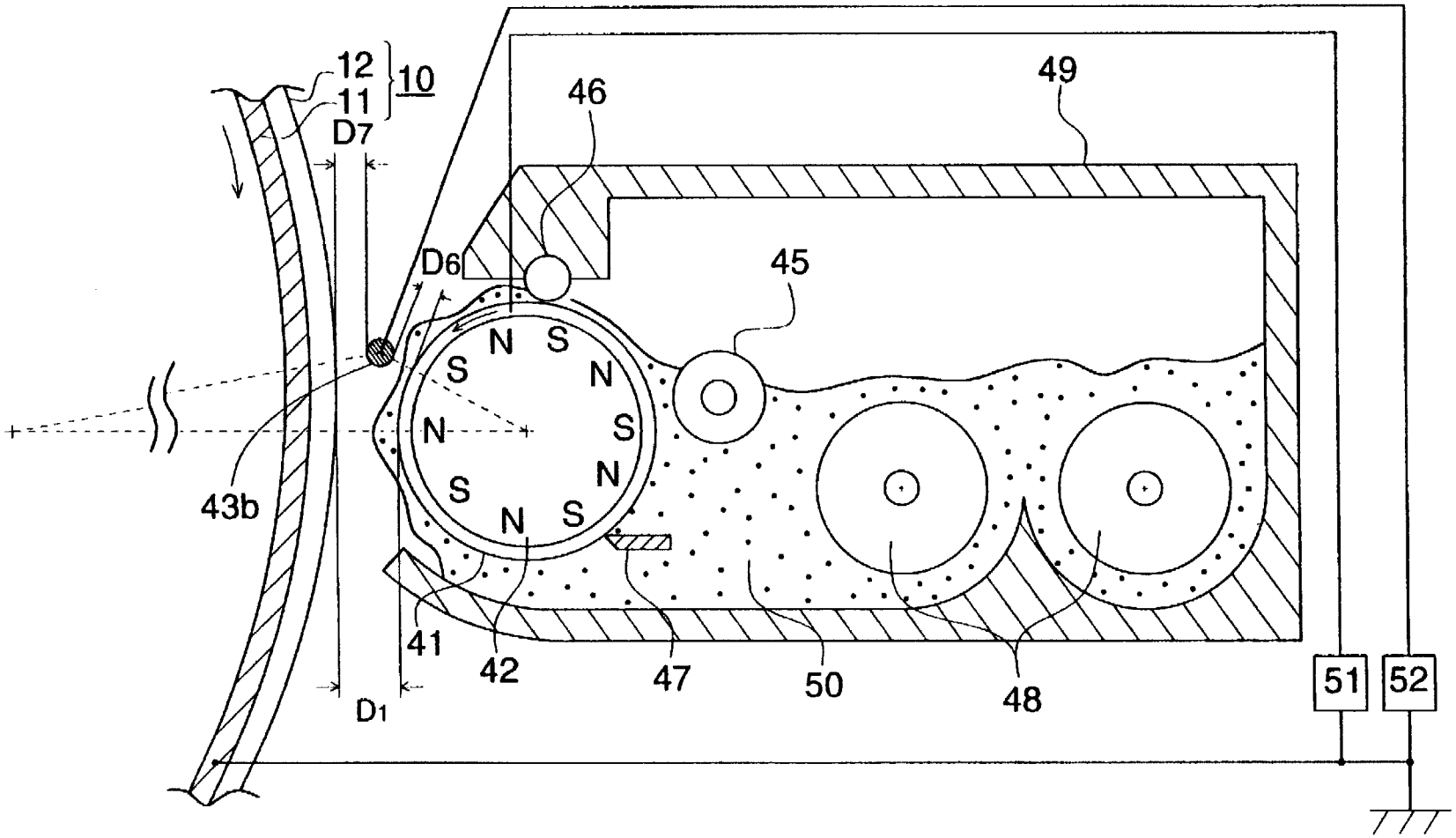
FIG. 8 is a view showing other example of a composition of an image forming apparatus of the present invention.

FIG. 8 is a sectional view showing another example of a developing apparatus according to the present invention. In the drawing, numeral 41 is a developing roller, which is a developer conveyance body having a fixed magnetic body 42 therein. Numeral 43b is a wire electrode. Numeral 45 is a feed roller which is a developer feed member, and numeral 46 is a regulation rod which is a developer conveyance amount regulation member. Numeral 47 is a scraper which is a developer scraping member. Numeral 48 is a stirring roller which is a developer stirring member. Numeral 49 is a casing of the developing apparatus, and numeral 50 is a two-component developer composed of toner T and carrier C. Numerals 51 and 52 are power sources which are respectively bias voltage applying means. Numeral 10 is a photoreceptor drum which is an image forming body, and in which a photoreceptor layer 12 is formed on a conductive base body 11. $D_1$ is the closest distance between the photoreceptor drum 110 and the developing roller 41. $D_6$ is the closest gap between the wire electrode 43b and the developing roller 41. $D_3$ is the closest distance between the end portion of the plate member 43 and the developing roller 41. An arrow in the drawing shows the rotational direction of the photoreceptor drum 10 and the developing roller 41.

The wire electrode 43b is composed of a conductive metal such as tungsten and stainless steel, and is in the form of wire having a diameter of 0.05 to 0.3 mm and preferably having an insulation film on its surface. The wire electrode 43b is strained in the gap, where the photoreceptor drum 10 is facing against the developer roller 41, in the direction perpendicular to the moving direction of the developer roller 41.

The fixed pines are located on the outer sides of the both side panels of the casing 49, and the both sides of the wire electrode 43b are suspended to the fixed pines through the tension springs.

A composit voltage of an AC voltage and a DC component is impressed upon the developing roller 41 from the power source 51 and a DC voltage is impressed upon the wire electrode 43b from the power source 52. A strong oscillation electric field is formed in a gap between the developing roller 41 and the wire electrode 43b, and a weak oscillation electric field is formed in a gap between the developing roller 41 and the photoreceptor drum 10.

Necessary conditions of the embodiment shown in FIG. 8 will be explained below.

The required condition is that the amplitude $V_{AC}$ [V] of the AC voltage having the DC component to be impressed upon the developing roller 41, $V_{DC}$ [V] of the DC component, and $V_{DEN}$ [V] of the DC voltage to be impressed upon the wire electrode 43b, satisfy the following relationship:

$$V_{AC}>|V_{DEN}|-|V_{DC}|$$

When the above relationship is satisfied, the oscillation electric field to separate the toner T from the carrier C and to fly it so that the toner cloud is generated in the gap between the wire electrode 43b and the developing roller 41, is stronger than the DC electric field which tends to push the toner T to the developing roller 41 side, and accordingly, generation of the toner cloud is promoted.

When $V_{AC}$, $V_{DC}$ and $V_{DEN}$ do not satisfy the above relationship, and have the following relationship, $$V_{AC}\leqq|V_{DEN}|-|V_{DC}|$$

then, the toner T is pushed to the developing roller 41 side, and accordingly, the generation of the toner cloud is suppressed, resulting in a lowered developability.

when the frequency of the AC voltage which is impressed upon the developing roller 41 is defined as $f_{AC}$ [Hz], the moving speed of the developing roller 41 is defined as $V_r$ [mm/sec], and the diameter of the wire electrode 43b is defined as $d_w$ [mm], $$f_{AC}\geqq 2\cdot V_r/d_w$$

preferably, $$f_{AC}\geqq 3\cdot V_r/d_w$$

are the requirement to be satisfied.

By satisfying the above relationships, the peak voltage of the AC voltage component is impressed not less than 2 times or, preferably, not less than 3 times when the developer layer on the developing roller 41 goes through the gap between the wire electrode 43b and the developing roller 41; therefore, the generation of toner cloud is accelerated and the high developability is obtained.

When $f_{AC}$, $\cdot V_r$, $d_w$ do not satisfy the above relationships and the relationsips amoung them become $$f_{AC}<2V_r/d_w,$$

the number of times to impress the peak voltage of the AC voltage component is too few in relation to that the developer layer on the developing roller 41 goes through the gap; therefore, the generation of toner cloud is not accelerated and the high developability is not obtained.

Further, another required condition is that the closest distance $D_1$ [mm] between the photoreceptor drum 10 and the developing roller 41, the closest distance $D_6$ [mm] between the wire electrode 43b and the developing roller 41, $Q_t$ [μC/g] of an average charge amount of the toner, and an average particle size $d_t$ [μm], satisfy the following relationship, $$8\cdot|Q_t|\cdot d_t\cdot D_1>V_{AC}>6\cdot|Q_t|\cdot d_t\cdot D_6$$

Figure 9:
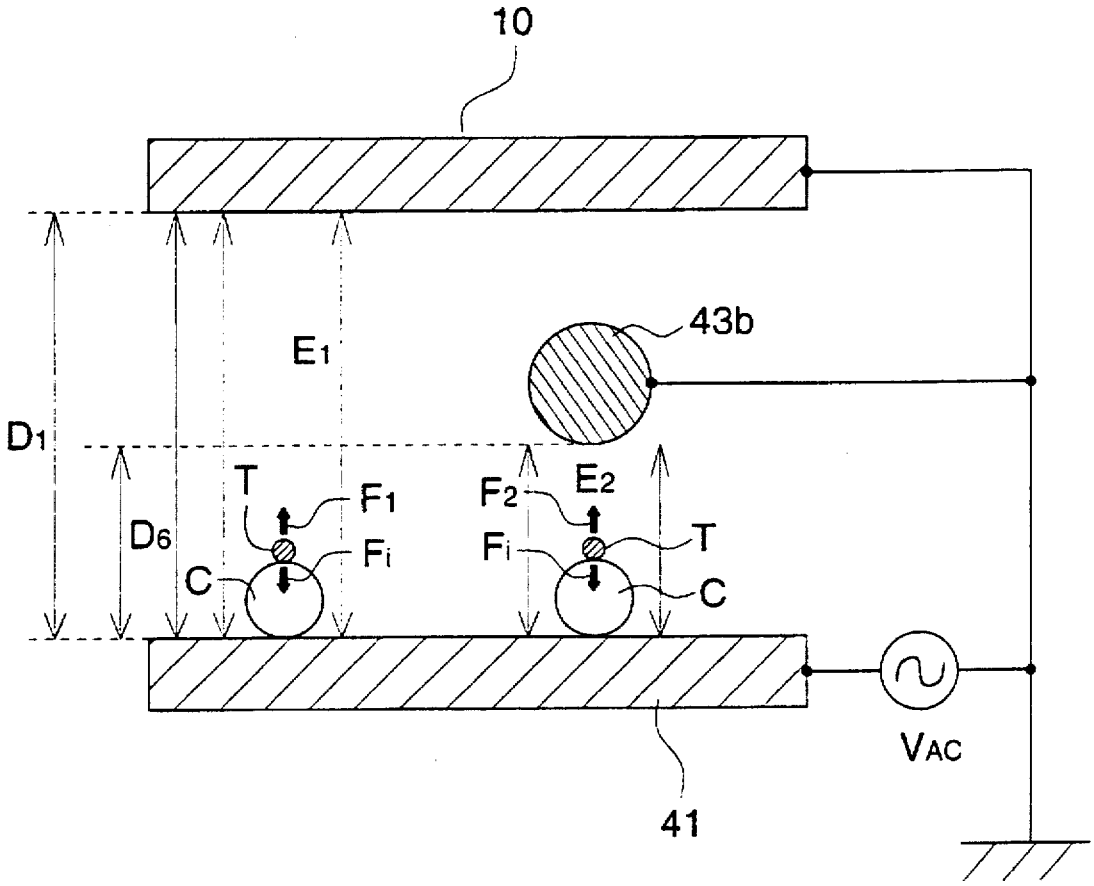
FIG. 9 is a view showing a model of the example shown in FIG. 8 for considering the oscillation electric field formed in a gap formed between a photoreceptor drum and a developing roller and in a gap between a wire electrode and the developing roller.

Referring to FIG. 9, the above required condition will be explained below.

FIG. 9 is a view showing a model for considering the oscillation electric field formed in the gap between the photoreceptor drum 10 and the developing roller 41 and in the gap between the wire electrode 43b and the developing roller 41. In FIG. 9, numeral 10 is the photoreceptor drum, 41 is the developing roller, 43b is the wire electrode, $D_1$ is the closest distance between the photoreceptor drum 10 and the developing roller 41, $D_6$ is the closest distance between the wire electrode 43b and the developing roller 41, T is toner, and C is carrier. The AC component $V_{AC}$ is impressed upon the developing roller 41, the oscillation electric field $E_1$ is formed in the gap between the photoreceptor drum 10 and the developing roller 41, and the oscillation electric field $E_2$ is formed in the gap between the wire electrode 43b and the developing roller 41.

In order to obtain the higher developability and to suppress fogging and the mixing of colors in the background portion, it may be allowed that the toner cloud is generated only in the gap between the wire electrode 43b and the developing roller 41, and the toner cloud is not generated in the gap between the photoreceptor drum 10 and the developing roller 41. In order to realize this condition, the balance of the force to be applied to the toner T may be set as follows: force $F_2$ exerted by the oscillation electric field $E_2$ is larger than the mirror image force $F_i$, in the gap between the wire electrode 43b and the developing roller 41; force $F_1$ exerted by the oscillation electric field $E_1$ is smaller than the mirror image force $F_i$, in the gap between the photoreceptor drum 10 and the developing roller 41.

The gap between the photoreceptor drum 10 and the developing roller 41 is the same as that of the first embodiment for equations (1) through (6).

Obtaining the equation (6), the oscillation electric field $E_1$ is calculated as if there is no conductive material other than air in the gap between the photoreceptor drum 10 and the developing roller 41. However, in practice, the two-component developer 50; therefore, the oscillation electric field $E_2$ is strengthened.

Considering this condition, the equation (6) is expressed as follows.

$$8\cdot|Q_t|\cdot d_t\cdot D_1>V_{AC} \tag{27}$$

Equation (27) is a condition for suppressing the generation of the toner cloud in the gap and for preventing fogging and the mixing of colors in the background portion.

Next, dimensions of the gap between the wire electrode 43b and the developing roller 41 will be considered below.

The force $F_2$ exerted by the oscillation electric field $E_2$ in the gap is expressed as follows:

$$F_2=|q_t|\cdot E_2=|q_t|\cdot V_{AC}/D_6 \tag{28}$$

The mirror image force $F_i$ to be exerted onto toner T is given by the following equation:

$$F_i=\beta\cdot|q_t|^2/(4\cdot\pi\cdot\epsilon_0\cdot d_t^2) \tag{2}$$

Because $F_2>F_i$ in the gap, the following relationship can be obtained:

$$|q_t|\cdot V_{AC}/D_6>\beta\cdot|q_t|^2/(4\cdot\pi\cdot\epsilon_0\cdot d_t^2)$$

then, the following relationship can be obtained from the above:

$$V_{AC}>\beta\cdot|q_t|\cdot D_2/(4\cdot\pi\cdot\epsilon_0\cdot d^2) \tag{29}$$

When the equation (4) is substituted into the equation (29) in the same way as described above, and when $\beta=2$, $\epsilon_0=8.85\times10^{-12}$ [F/m], $\rho=1.1$ [g/cm$^3$], are substituted into the equation (8), and units of $V_{AC}$, $Q_t$, $d_t$, and $D_6$ are respectively $V_{AC}$[V], $Q_t$ [μC/g], $d_t$ [μm], and $D_6$ [mm], then, the following relationship can be obtained:

$$V_{AC}>10\cdot|Q_t|\cdot d_t\cdot D_6 \tag{30}$$

When equation (30) was introduced, the oscillation electric field $E_2$ in the gap was calculated under the condition that any dielectric other than air did not exist in the gap between the wire electrode 43b and the developing roller 41. However, in practice, the two-component developer 50 exist in the gap, and the ratio of the thickness of the developer layer to the above gap is larger than that to the gap between the photosensitive drum 10 and the developing roller 41. Accordingly, the oscillation electric field $E_2$ is strengthened.

Considering this condition, the equation (30) is expressed as follows.

$$V_{AC}>6\cdot|Q_t|\cdot d_t\cdot D_6 \tag{31}$$

Equation (31) is a condition in order to accelerate the generation of toner in the gap and to obtain higher developability.

When equation (27) and equation (31) are combined, the following relationship is obtained:

$$8\cdot|Q_t|\cdot d_t\cdot D_1>V_{AC}>6\cdot|Q_t|\cdot d_t\cdot D_6 \tag{32}$$

and then, the required condition of the present invention is introduced.

Actually, when toner T having $Q_t$ [μC/g] of an average charge amount of the toner and the average particle size of d [μm], is used, and when the closest distance $D_1$ [mm] between the photoreceptor drum 10 and the developing roller 41 and the closest distance $D_6$ [mm] between the wire electrode 43b and the developing roller 41 are set in such a manner that these distances satisfy the above equation (12), then, a high quality image can be obtained in which the image density is higher and fogging and the mixing of colors do not occur in the background portion.

On the other hand, not satisfying the relationships of the equation (32) and when $V_{AC}$ is greater than $8\cdot Q_t\cdot d_t\cdot D_1$, toner adheres onto the latent image and the toner image of the background portion, formed on the photoreceptor drum 10, resulting in fogging and the mixing of colors. Reversely, when $V_{AC}$ is less than $6\cdot Q_t\cdot d_t\cdot D_6$, the image density of the solid portion is lowered and the line width is narrowed. In both cases, a superior image can not be obtained.

Further, when the surface voltage of the latent image formed on the solid portion of the photoreceptor drum 10 is defined as $V_L$ [V], and that on the background portion is defined as $V_H$ [V], the closest distance between the photoreceptor drum 10 and the developing roller 41 is defined as $D_1$ [mm], the closest distance between the wire electrode 43b and the developing roller 41 is defined as $D_6$ [mm], then, the relationships defined by $$|V_H|>|V_{DC}|>|V_L|,$$

and $$|V_{DC}|+|V_{DC}-V_L|\cdot D_6/D_1>|V_{DEN}|>|V_{DC}|-|V_H-V_{DC}|\cdot(1-D_6/D1)$$

are other required conditions.

Figure 10:
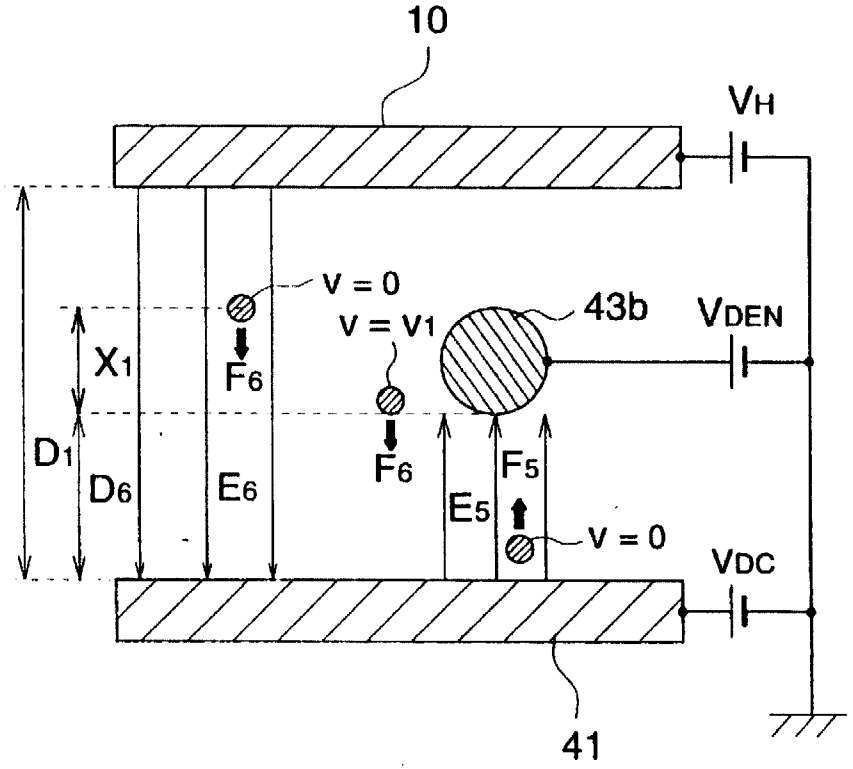
FIGS. 10(*a*) and 10(*b*) are views showing a model of the example shown in FIG. 8 for considering toner scattering in a development zone.
Figure 10:
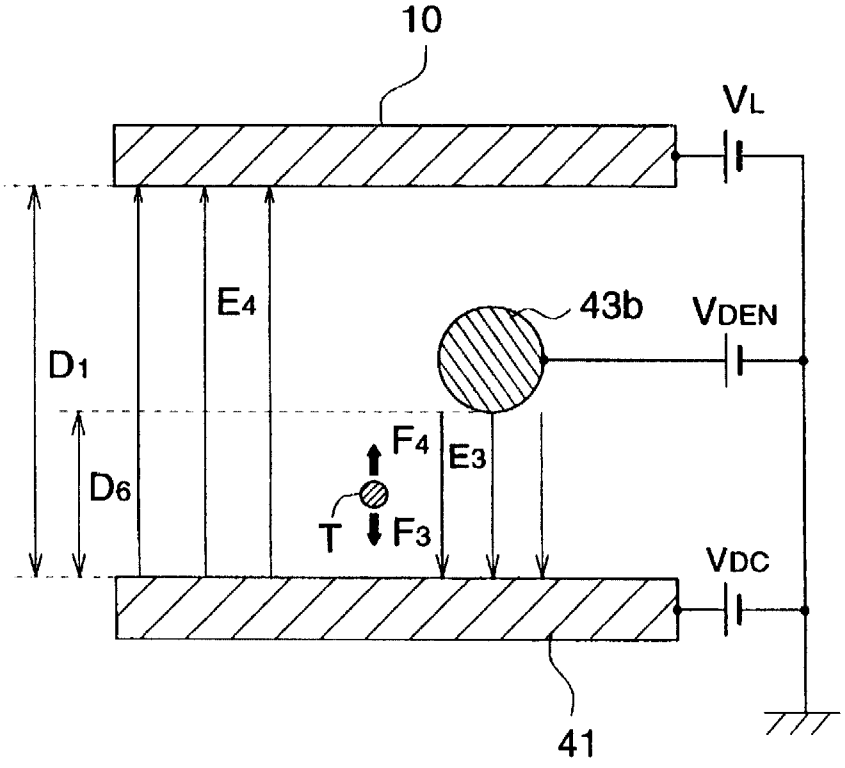

Referring to FIG. 10, the above-described required condition will be explained below.

FIG. 10 is a view showing a model for considering the toner scattering in the development zone in which the photoreceptor drum 10 is opposed to the developing roller 41. FIG. 10(*a*) is a case where the latent image of the solid portion is formed on the photoreceptor drum 10, and FIG. 10(*b*) is a case where the latent image or the toner image of the background portion is formed on the photoreceptor drum 10. In FIGS. 10(*a*) and 10(*b*), numeral 10 is the photoreceptor drum, 41 is the developing roller, 43b is the wire electrode, $D_1$ is the closest distance between the photoreceptor drum 10 and the developing roller 41, and $D_6$ is the closest distance between the wire electrode 43b and the developing roller 41.

Initially, in FIG. 10(*a*), the following case is considered: the latent image of the solid portion is formed on the photoreceptor drum 10.

$V_{DEN}$ of the DC voltage is impressed upon the wire electrode 43b, the DC voltage $V_{DC}$ is impressed upon the developing roller 41, and the DC electric field $E_3$ is formed in the gap between the wire electrode 43b and the developing roller 41. The latent image of the solid portion, having the latent image potential voltage, which is $V_L$, is formed on the photoreceptor drum 10, and the DC electric field $E_4$ is also formed in the gap between the photoreceptor drum 10 and the developing roller 41.

Conditions to obtain the higher developability in the solid portion will be found from the balance of a force exerted onto toner T, which now exists on the space between the wire electrode 43b and the developing roller 41, as explained below.

In order to move the toner T onto the latent image formed on the photoreceptor drum 10, the following is necessary: a force $F_4$ to move the toner T onto the latent image formed on the photoreceptor drum 10 by the DC electric field is larger than a force $F_3$ to push the toner T onto the developing roller 41 side by the DC electric field $E_3$, that is $F_4>F_3$.

The force $F_3$ to push the toner T onto the developing roller 41 side and the $F_4$ to move the toner T onto the latent image on the photoreceptor drum 10 are respectively given as follows. When the average charge amount of the toner T is defined as $q_r$, the distance between the wire electrode 43b and the developing roller 41 is defined as $D_6$, and the closest distance between the photoreceptor drum 10 and the developing roller 41 is defined as $D_1$, then, $$F_3=|q_r|\cdot E_3=|q_r|\cdot|V_{DEN}-V_{DC}|/D_6 \quad (33)$$

and $$F_4=|q_r|\cdot E_4=|q_r|\cdot|V_{DC}-V_L|/D_1 \quad (34)$$

Accordingly, the condition to obtain the higher developability in the solid portion is $$|q_r|\cdot|V_{DC}-V_L|/D_1>|q_r|\cdot|V_{DEN}-V_{DC}|/D_6$$

When $|q_r|$ is eliminated from both sides, then, $$V_{DC}|+|V_{DC}-V_L|\cdot D_6/D_1>|V_{DEN}| \quad (35)$$

Equation (35) is the condition to obtain the higher developability in the solid portion.

Next, referring to FIG. 10(*b*), the case where the latent image of the background portion is formed on the photoreceptor drum 10 will be considered below.

$V_{DEN}$ of the DC voltage is impressed upon the wire electrode 43b, the DC voltage $V_{DC}$ is impressed upon the developing roller 41, and the DC electric field $E_5$ is formed in the gap between the wire electrode 43b and the developing roller 41. The latent image of the background protion, having $V_H$ of the latent image potential voltage, is formed on the photoreceptor drum 10, and the DC electric field $E_6$ is also formed in the gap between the photoreceptor drum 10 and the developing roller 41.

The following are assumed: the toner T on the developing roller 41 is now affected by the force $F_5$ of the DC electric field $E_5$, and moves to the wire electrode 43b while the speed of the toner T is being increased; and the toner T which has passed through the wire electrode 43b is affected by the reverse force $F_6$ due to the DC electric field $E_6$, and the speed of the toner T is gradually reduced. Then, conditions in which no fogging and no mixing of colors occur in the background portion, will be discussed below.

The following relationships are obtained in the process in which the toner T on the developing roller 41 moves to the wire electrode 43b: when the mass of the toner T is defined as $m_r$, the acceleration to be exerted on the toner T is defined as $\alpha 1$, time necessary for the toner T to move from the developing roller 41 to the wire electrode 43b is defined as $t_1$, the velocity of the toner T moving through the wire electrode 43b is defined as $V_1$, and the distance between the developing roller 41 and the wire electrode 43b is defined as $D_6$, then, $$F_5=m_r\cdot\alpha_1 \quad (36)$$

$$V_1=\alpha_1\cdot t_1 \quad (37)$$

$$D_6=\alpha_1\cdot t_1^2/2 \quad (38)$$

Further, the following relationships are obtained in the process in which the toner T, which has passed through the wire electrode 43b at the velocity $V_1$, is affected by the force opposite to the moving direction and the velocity of the toner T is finally reduced to 0: negative acceleration applied onto the toner T is defined as $\alpha_2$, time during which the velocity of the toner T is reduced to 0 is defined as $t_2$, and distance between the position at which the velocity of the toner T is reduced to 0 and the wire electrode 43b, is defined as $x_1$, then, $$F_6=m_r\cdot\alpha_2 \quad (39)$$

$$0=V_1-\alpha_2\cdot t_2 \quad (40)$$

$$X_1=V_1\cdot t_2-\alpha_2\cdot t_2^2/2 \quad (41)$$

When $m_r$, $\alpha_1$, $t_1$, $V_1$, $\alpha_2$, $t_2$ are eliminated using equations (36) through (41), the following relationship is obtained:

$$X_1=F_5\cdot D_6/F_6 \quad (42)$$

The condition in which no fogging and no mixing of colors occur in the background portion, is obtained as follows: because this condition means that the toner T does not reach the latent image in the background portion on the photoreceptor drum 10, when the closest distance between the developing roller 41 and the photoreceptor drum 10 is defined as $D_1$ and the closest distance between the wire electrode 43b and the developing roller 41 is defined as $D_6$, the condition of $X_1$ in the equation (42) becomes $$D_1-D_6>X_1 \quad (43)$$

then, the following relationship can be obtained by substituting the equation (42) into the above:

$$F_6(D_1-D_6)>F_5\cdot D_6 \quad (44)$$

On the other hand, the force $F_5$ due to the DC electric field $E_5$ and the force $F_6$ due to the DC electric field $E_6$ are respectively expressed by the following equations: when the average charge amount of the toner is defined as $q_r$, the closest distance between the developing roller 41 and the photoreceptor drum 10 is defined as $D_1$, the closest distance between the developing roller 41 and the wire electrode 43b is defined as $D_6$, then, $$F_5=|q_r|\cdot E_5=|q_r|\cdot|V_{DC}-V_{DEN}|/D_6 \quad (45)$$

and $$F_6=|q_t|\cdot E_6=|q_t|\cdot|V_H-V_{DC}|/D_1 \quad (46)$$

Therefore, when equations (45) and (46) are substituted into equation (44), the following relationship is obtained:

$$(|q_t|\cdot|V_H-V_{DC}|/D_1)\cdot(D_1-D_6)>(|q_t|\cdot|V_{DC}-V_{DEN}|/D_6)\cdot D_6.$$

By deleting $q_t$ from both sides of the equation, the following relationship is obtained:

$$|V_{DEN}|>|V_{DC}|-|V_H-V_{DC}|\cdot(1-D_6)/D_1 \quad (47)$$

Equation (47) is the condition for preventing fogging and the mixing of colors in the background portion.

When equation (35) and equation (47) are combined, the following relationship is obtained:

$$|V_{DC}|+|V_{DC}-V_L|\cdot D_6/D_1>|V_{DEN}|>|V_{DC}|-|V_H-V_{DC}|\cdot(1-D_6)/D_1 \quad (48)$$

and now, the required condition of the present invention can be obtained as described above.

In the present invention, the same mathematical sign is given to $V_{DC}$, $V_{DEN}$, $V_H$ and $V_L$ When the DC voltage component $V_{DC}$ [V] to be impressed upon the developing roller 41, $V_{DEN}$ [V] of the DC voltage to be impressed upon the wire electrode 43b, $V_L$ of the latent image potential voltage in the solid portion on the photoreceptor drum 10, $V_H$ of the latent image potential voltage of the background portion, the closest distance $D_1$ between the photoreceptor drum 10 and the developing roller 41, and the distance $D_6$ between the wire electrode 43b and the developing roller 41, are set so as to satisfy the relationship expressed by equation (48), then, the high quality image which has a higher image density and no fogging and no mixing of colors in the background portion, can be obtained.

On the other hand, when the relationship in equation (48) is not satisfied and $V_{DEN}$ is too great, the image density in the solid portion is decreased and the line width is decreased. When $V_{DEN}$ is too small, toner adheres to even the latent image or toner image in the background portion formed on the photoreceptor drum 10, resulting in fogging and the mixing of colors. In both cases, an excellent image can not be obtained.

Still further, when a process to form a latent image on the photoreceptor drum 10 and a process to develop the latent image are repeated a plurality of times; the amplitude of the AC voltage to be impressed upon the developing roller 41 and the closest distance between the photoreceptor 10 and the developing roller 41, in the developing process of nth time, are defined as $V_{AC}(n)$ [V] and $D_1(n)$ [mm]; and the amplitude of the AC voltage to be impressed upon the developing roller 41 and the closest distance between the photoreceptor 10 and the developing roller 41, in the developing process of n+1th time, are defined as $V_{AC}(n+1)$ [V] and $D_1(n+1)$ [mm], $$V_{AC}(n)/D_1(n)\geqq V_{AC}(n+1)/D_1(n+1)$$

is other required condition.

As mentioned above, the strength of the oscillation electric field is set so that the strength of the oscillation electric field in the gap formed between the photoreceptor drum 10 and the developing roller 41, in the current developing process, is equal to or weaker than the strength of the oscillating electric field in the gap formed between the photoreceptor drum 10 and the developing roller 41, in the preceding developing process, the toner image formed on the photoreceptor drum 10 in the preceding developing process is not disturbed in the succeeding developing process, and the preceding toner image is not mixed by the succeeding toner, so that a higher quality multi-color image can be obtained.

Conversely, when the oscillation electric field in the succeeding developing process is stronger than the oscillation electric field in the preceding developing process, the preceding toner image is disturbed and its color is mixed with the succeeding toner, resulting in an unclear and low quality multi-color image.

Further, when a process for forming a latent image onto the photoreceptor drum 10 and a process for developing the latent image are repeated plural times; the DC voltage to be impressed upon the wire electrode 43b, the latent image voltage of the latent image formed on the background portion of the photoreceptor drum 10, and the closest distance between the photoreceptor drum 10 and the wire electrode 43b, in the developing process of nth time, are defined as $V_{DEN}(n)$ [V], $V_H(n)$ [V], and $D_7(n)$ [mm]; and the DC voltage to be impressed upon the wire electrode 43b, the latent image voltage of the latent image formed on the background portion of the photoreceptor drum 10, and the closest distance between the photoreceptor drum 10 and the wire electrode 43b, in the developing process of n+1th time, are defined as $V_{DEN}(n+1)$ [V], $V_H(n+1)$ [V], and $D_7(n+1)$ [mm], $$(|V_{DEN}(n+1)|-|V_H(n+1)|)/D_7(n+1)\geqq(|V_{DEN}(n)|-|V_H(n)|)/D_7(n)$$

is other required condition.

As mentioned above, the strength of the DC electric field is set so that the strength of the oscillation electric field in the gap formed between the photoreceptor drum 10 and the wire electrode 43b, in the preceding developing process, is equal to or weaker than the strength of the DC electric field in the gap formed between the photoreceptor drum 10 and the wire electrode 43b, in the current developing process, the toner image formed on the photoreceptor drum 10 in the preceding developing process is not disturbed in the succeeding developing process or not attracted to the side of succeeding developers, and the preceding toner image is not mixed by the succeeding toner, so that a higher quality multi-color image can be obtained.

Conversely, when the DC electric field at the gap in the succeeding developing process is weaker than the DC electric field at the gap in the preceding developing process, the preceding toner image is disturbed and its color is mixed with the succeeding toner, resulting in an unclear and low quality multi-color image.

Next, other conditions relating to the present embodiment will be explained.

The wire electrode 43b is composed of a conductive metal such as tungsten and stainless steel, and is in the form of wire having a diameter of 0.05 to 0.3 mm. It is preferable for the wire electrode 43b to have a film layer, on its surface, which is composed of an insulation resin such as polyurethane or polyamide in order to prevent discharge at the gap between the wire electrode 43b and the developing roller 41.

For fixing the wire electrode 43b to the developing apparatus, the fixed pines are placed on the outer sides of the both side panels of the casing 49, and the both sides of the wire electrode 43b are suspended to the fixed pines through the tension springs. The location of the wire electrode 43b is limited by the end portions, which face to the photoreceptor drum 10, of the side panels and the location pins placed on the side panels.

The closest distance $D_1$ between the photoreceptor drum 10 and the developing roller 41 is normally 0.2 to 1 mm, and the developer layer on the developing roller 41 is arranged in such a manner that it is not in contact with the photoreceptor drum 10. The closest distance $D_6$ between the wire electrode 43b and the developing roller 41 is normally about 0.05 to 0.5 mm, and the closest distance $D_7$ between the wire electrode 43b and the photoreceptor drum 10 is normally about 0.1 to 1 mm. The wire electrode 43b is arranged in such a manner that it is not in contact with the developer layer and the photoreceptor drum 10. The relationships among $D_1$, $D_6$ and $D_7$, are as follows:

$$D_1 \geqq D_7 > D_6$$

and are preferably $$0.6 \cdot D_1 \geqq D_6 \geqq 0.2 \cdot D_1$$

When the radius of curvature of the developing roller 41 in the development zone is defined as r, it is normally about 2.5 to 15 mm. When the angle, created by the straight line connecting the location, where the photoreceptor drum 10 is closest to the developing roller 41, to the center of curvature of the developing roller 41 and another straight line which goes though the center of curvature of the wire electrode 43b and the center of curvature of the developing roller 41, is defined as θ and the moving direction of the developing roller 41 to the upstream side is defined as + direction, the angle θ is normally +5° to +30°. It is preferable that the relationship among r, θ, and the closest distance $D_1$ between the photoreceptor drum 10 and the developing roller 41 is as follows:

$$r \cdot (1 - \cos\theta) \geqq D_1$$

It is preferable that the thickness $H_2$ of the developer layer at the closest position between the photoreceptor drum 10 and the developing roller 41, and the thickness $H_5$ of the developer layer at the closest position between the wire electrode 43b and the developing roller 41 satisfy the following relationship, $$H_2 > H_5$$

and specifically $$4H_5 \geqq H_2 > 1.5H_5$$

For setting the relationship between $H_2$ and $H_5$ to that of the above, the magnetic pole, closest to the closest position between the photoreceptor drum 10 and the developing roller 41, is placed at the neighbor of the closest position and at the downstream side in the moving direction of the developing roller 41 in which the magnetic pole is of the magnetic body 42 which is fixed inside the developing roller 41. It is preferable that another magnetic pole, which is at the upstream side from the above-mentioned magnetic pole, is placed at the upstream side in the moving direction of the developing roller 41 from the closest position between the photoreceptor drum 10 and the developing roller 41. Further, it is also preferable that an insulate unifying member is provided to be in contact with the developer layer at the gap between the wire electrode 43 and the developing roller 41 or the upstream side of the gap.

When the moving speed of the developing roller 41 is $V_r$, and the moving speed of the photoreceptor drum 10 is $V_p$, it is preferable that $V_r$ is 1 to 3 times as much as $V_p$. It is preferable that the moving direction of the developing roller 41 is the same as that of the photoreceptor drum in the development zone in which the developing roller is opposed to the photoreceptor drum 10.

The wave form of the AC component, which is impressed upon the developing roller 41, may be either of a sine wave, a rectangular wave, or a triangular wave. However, the rectangular wave is preferable for efficiently generating the toner cloud.

An example described in FIG. 8 will be explained more specifically below.

In the developing apparatus of the following examples is mostly the same as that of the examples 1 through 6; however, the side panels of casings 49 are respectively modified to suspend the wire electrodes so that the developing apparatus 40A', 40B', 40C' and 40D' of the following examples are made.

In the image forming apparatus of the following examples, the following are performed: The timing to impress the voltage upon the wire electrode is the same as that the charger is ON; and the timing to impress the voltage upon the developing roller is that only the DC component is impressed when the charger is ON and the rotation of the developing roller is OFF, and that the composite voltage of the DC component and the AC component is impressed when both of the charger and the rotation of the developing roller are ON.

(Example 7)

Conditions of the developing apparatus were set as shown in the following Table 22. The value $V_{DEN}$ of the DC voltage to be impressed upon the wire electrode was set to −750 V. The image was developed in a mono-color mode while the AC component $V_{AC}$ of the AC voltage to be impressed upon the developing roller was being changed. The primary adhered amount M/A and the number of fogging toner particles $N_1$ were measured, and the result was judged by the following criterion.

The criterion for evaluation of the primary adhered amount M/A [mg/cm²]

(In the case where the average particle size of toner is d [μm]):

○ . . . $d_t \times 0.8 \leqq M/A$

Δ . . . $d_t \times 0.6 \leqq M/A < d_t \times 0.8$

X . . . $M/A < d_t \times 0.6$

The criterion for evaluation of the number $N_1$ of fogging toner particles [pieces/mm²]:

○ . . . $N_1 \leqq 10$

Δ . . . $10 < N_1 \leqq 20$

X . . . $20 \leqq N_1$

TABLE 22

| | |
|---|---|
| Developing apparatus | 40A |
| Developer | Yellow |
| The average charge amount of the toner $Q_t$ | −18 [μC/g] |
| The average particle size of the toner $d_t$ | 8.5 [μm] |
| The average particle size of the carrier | 46 [μm] |
| Toner density | 7.5 [wt. %] |
| The diameter of the wire electrode $d_w$ | 0.17 mm |
| The thickness of the film layer on the wire electrode | 0.01 mm |
| The closest distance $D_1$ between the photoreceptor drum and the developing roller | 0.65 mm |
| The closest distance $D_6$ between the wire electrode and the developing roller | 0.20 mm |
| The closest distance $D_7$ between the | 0.45 mm |

TABLE 22-continued

| | |
|---|---|
| photoreceptor drum and the wire electrode | |
| The DC component impressed upon the developing roller $V_{DC}$ | −750 [V] |
| The frequency of the AC component impressed upon the developing roller $f_{AC}$ | 8000 [Hz] |
| The wave form of the AC component impressed upon the developing roller | rectangular wave |
| The latent image voltage on the background portion $V_H$ | −850 [V] |
| The latent image voltage on the solid portion $V_L$ | −50 [V] |
| The moving speed of the developing roller $V_r$ | 350 [mm/sec] |
| The moving speed of the photoreceptor drum $V_p$ | 140 [mm/sec] |
| The radius of the developing roller r | 10 [mm] |
| The radius of the photoreceptor drum | 90 [mm] |
| The angle between the closest location of the photoreceptor drum and the closest location of the wire electrode θ | +10 [°] |
| The thickness of the developer at the closest location of the photoreceptor drum $H_2$ | 0.3 [mm] |
| The thickness of the developer at the closest location of the wire electrode $H_5$ | 0.1 [mm] |

This result is shown in Table 23.

TABLE 23

| $V_{AC}$ [V] | M/A [mg/cm²] | $N_1$ [pcs/mm²] |
|---|---|---|
| 0 | X | ○ |
| 100 | X | ○ |
| 200 | ○ | ○ |
| 300 | ○ | ○ |
| 400 | ○ | ○ |
| 500 | ○ | ○ |
| 600 | ○ | ○ |
| 700 | ○ | ○ |
| 800 | ○ | ○ |
| 900 | ○ | X |
| 1000 | ○ | X |
| 1100 | ○ | X |
| 1200 | ○ | X |
| 1300 | ○ | X |
| 1400 | ○ | X |
| 1500 | ○ | X |

In this example, the values of the equations $8 \cdot |Q_t| \cdot d_t \cdot D_1$ and $6 \cdot |Q_t| \cdot d_t \cdot D_6$ are 796 and 184.

(Example 8)

Conditions of the developing apparatus were set as shown in the following Table 24. The value $V_{DEN}$ of the DC voltage to be impressed upon the wire electrode was set to −750 V. The image was developed in a mono-color mode while the AC component $V_{AC}$ of the AC voltage to be impressed upon the developing roller was being changed. The primary adhered amount M/A and the number of fogging toner particles $N_1$ were measured, and the result was judged as in the same manner of Example 7.

TABLE 24

| | |
|---|---|
| Developing apparatus | 40B |
| Developer | Magenta |
| The average charge amount of the toner $Q_t$ | −15 [μC/g] |
| The average particle size of the toner $d_t$ | 9.0 [μm] |
| The average particle size of the carrier | 46 [μm] |
| Toner density | 7.5 [wt. %] |
| The diameter of the wire electrode $d_w$ | 0.1 mm |
| The thickness of the film layer on the wire electrode | 0.01 mm |

TABLE 24-continued

| | |
|---|---|
| The closest distance $D_1$ between the photoreceptor drum and the developing roller | 0.65 mm |
| The closest distance $D_6$ between the wire electrode and the developing roller | 0.2 mm |
| The closest distance $D_7$ between the photoreceptor drum and the wire electrode | 0.39 mm |
| The DC component impressed upon the developing roller $V_{DC}$ | −750 [V] |
| The frequency of the AC component impressed upon the developing roller $f_{AC}$ | 8000 [Hz] |
| The wave form of the AC component impressed upon the developing roller | rectangular wave |
| The latent image voltage on the background portion $V_H$ | −850 [V] |
| The latent image voltage on the solid portion $V_L$ | −50 [V] |
| The moving speed of the developing roller $V_r$ | 350 [mm/sec] |
| The moving speed of the photoreceptor drum $V_p$ | 140 [mm/sec] |
| The radius of the developing roller r | 10 [mm] |
| The radius of the photoreceptor drum | 90 [mm] |
| The angle between the closest location of the photoreceptor drum and the closest location of the wire electrode θ | +5 [°] |
| The thickness of the developer at the closest location of the photoreceptor drum $H_2$ | 0.3 [mm] |
| The thickness of the developer at the closest location of the wire electrode $H_5$ | 0.1 [mm] |

This result is shown in Table 25.

TABLE 25

| $V_{AC}$ [V] | M/A [mg/cm²] | $N_1$ [pcs/mm²] |
|---|---|---|
| 0 | X | ○ |
| 100 | X | ○ |
| 200 | ○ | ○ |
| 300 | ○ | ○ |
| 400 | ○ | ○ |
| 500 | ○ | ○ |
| 600 | ○ | ○ |
| 700 | ○ | ○ |
| 800 | ○ | X |
| 900 | ○ | X |
| 1000 | ○ | X |
| 1100 | ○ | X |
| 1200 | ○ | X |
| 1300 | ○ | X |
| 1400 | ○ | X |
| 1500 | ○ | X |

In this example, the values of the equations $8 \cdot |Q_t| \cdot d_t \cdot D_1$ and $6 \cdot |Q_t| \cdot d_t \cdot D_6$ are 702 and 162.

(Example 9)

Conditions of the developing apparatus were set as shown in the following Table 26. The value $V_{DEN}$ of the DC voltage to be impressed upon the wire electrode was set to −750 V. The image was developed in a mono-color mode while the AC component $V_{AC}$ of the AC voltage to be impressed upon the developing roller was being changed. The primary adhered amount M/A and the number of fogging toner particles $N_1$ were measured, and the result was judged as in the same manner of Example 7.

TABLE 26

| | |
|---|---|
| Developing apparatus | 40C |
| Developer | Cyan |
| The average charge amount of the toner $Q_t$ | −20 [μC/g] |
| The average particle size of the toner $d_t$ | 8.7 [μm] |

TABLE 26-continued

| | |
|---|---|
| The average particle size of the carrier | 46 [μm] |
| Toner density | 7.5 [wt. %] |
| The diameter of the wire electrode $d_w$ | 0.17 mm |
| The thickness of the film layer on the wire electrode | 0.01 mm |
| The closest distance $D_1$ between the photoreceptor drum and the developing roller | 0.65 mm |
| The closest distance $D_6$ between the wire electrode and the developing roller | 0.3 mm |
| The closest distance $D_7$ between the photoreceptor drum and the wire electrode | 0.36 mm |
| The DC component impressed upon the developing roller $V_{DC}$ | −750 [V] |
| The frequency of the AC component impressed upon the developing roller $f_{AC}$ | 8000 [Hz] |
| The wave form of the AC component impressed upon the developing roller | rectangular wave |
| The latent image voltage on the background portion $V_H$ | −850 [V] |
| The latent image voltage on the solid portion $V_L$ | −50 [V] |
| The moving speed of the developing roller $V_r$ | 350 [mm/sec] |
| The moving speed of the photoreceptor drum $V_p$ | 140 [mm/sec] |
| The radius of the developing roller r | 10 [mm] |
| The radius of the photoreceptor drum | 90 [mm] |
| The angle between the closest location of the photoreceptor drum and the closest location of the wire electrode θ | +10 [°] |
| The thickness of the developer at the closest location of the photoreceptor drum $H_2$ | 0.3 [mm] |
| The thickness of the developer at the closest location of the wire electrode $H_5$ | 0.1 [mm] |

This result is shown in Table 27.

TABLE 27

| $V_{AC}$ [V] | M/A [mg/cm²] | $N_1$ [pcs/mm²] |
|---|---|---|
| 0 | X | ○ |
| 100 | X | ○ |
| 200 | ○ | ○ |
| 300 | ○ | ○ |
| 400 | ○ | ○ |
| 500 | ○ | ○ |
| 600 | ○ | ○ |
| 700 | ○ | ○ |
| 800 | ○ | ○ |
| 900 | ○ | ○ |
| 1000 | ○ | Δ |
| 1100 | ○ | X |
| 1200 | ○ | X |
| 1300 | ○ | X |
| 1400 | ○ | X |
| 1500 | ○ | X |

In this example, the values of the equations $8\cdot|Q_t|\cdot d_t\cdot D_1$ and $6\cdot|Q_t|\cdot d_t\cdot D_6$ are 905 and 313.

(Example 10)

Conditions of the developing apparatus were set as shown in the following Table 28. The value $V_{DEN}$ of the DC voltage to be impressed upon the wire electrode was set to −750 V. The image was developed in a mono-color mode while the AC component $V_{AC}$ of the AC voltage to be impressed upon the developing roller was being changed. The primary adhered amount M/A and the number of fogging toner particles $N_1$ were measured, and the result was judged as in the same manner of Example 7.

TABLE 28

| | |
|---|---|
| Developing apparatus | 40D |
| Developer | Black 1 |
| The average charge amount of the toner $Q_t$ | −21 [μC/g] |
| The average particle size of the toner $d_t$ | 8.3 [μm] |
| The average particle size of the carrier | 46 [μm] |
| Toner density | 7.5 [wt. %] |
| The diameter of the wire electrode $d_w$ | 0.1 mm |
| The thickness of the film layer on the wire electrode | 0.01 mm |
| The closest distance $D_1$ between the photoreceptor drum and the developing roller | 0.65 mm |
| The closest distance $D_6$ between the wire electrode and the developing roller | 0.3 mm |
| The closest distance $D_7$ between the photoreceptor drum and the wire electrode | 0.29 mm |
| The DC component impressed upon the developing roller $V_{DC}$ | −750 [V] |
| The frequency of the AC component impressed upon the developing roller $f_{AC}$ | 8000 [Hz] |
| The wave form of the AC component impressed upon the developing roller | rectangular wave |
| The latent image voltage on the background portion $V_H$ | −850 [V] |
| The latent image voltage on the solid portion $V_L$ | −50 [V] |
| The moving speed of the developing roller $V_r$ | 350 [mm/sec] |
| The moving speed of the photoreceptor drum $V_p$ | 140 [mm/sec] |
| The radius of the developing roller r | 10 [mm] |
| The radius of the photoreceptor drum | 90 [mm] |
| The angle between the closest location of the photoreceptor drum and the closest location of the wire electrode θ | +5 [°] |
| The thickness of the developer at the closest location of the photoreceptor drum $H_2$ | 0.3 [mm] |
| The thickness of the developer at the closest location of the wire electrode $H_5$ | 0.1 [mm] |

This result is shown in Table 29.

TABLE 29

| $V_{AC}$ [V] | M/A [mg/cm²] | $N_1$ [pcs/mm²] |
|---|---|---|
| 0 | X | ○ |
| 100 | X | ○ |
| 200 | X | ○ |
| 300 | Δ | ○ |
| 400 | ○ | ○ |
| 500 | ○ | ○ |
| 600 | ○ | ○ |
| 700 | ○ | ○ |
| 800 | ○ | ○ |
| 900 | ○ | ○ |
| 1000 | ○ | Δ |
| 1100 | ○ | X |
| 1200 | ○ | X |
| 1300 | ○ | X |
| 1400 | ○ | X |
| 1500 | ○ | X |

In this example, the values of the equations $8\cdot|Q_t|\cdot d_t\cdot D_1$ and $6\cdot|Q_t|\cdot d_t\cdot D_6$ are 906 and 314.

(Example 11)

Conditions of the developing apparatus were set as shown in the following Table 30. The value $V_{DEN}$ of the DC voltage to be impressed upon the wire electrode was set to −750 V. The image was developed in a mono-color mode while the AC component $V_{AC}$ of the AC voltage to be impressed upon the developing roller was being changed. The primary adhered amount M/A and the number of fogging toner particles $N_1$ were measured, and the result was judged as in the same manner of Example 7.

TABLE 30

| | |
|---|---|
| Developing apparatus | 40D |
| Developer | Black 2 |
| The average charge amount of the toner $Q_t$ | −27 [μC/g] |
| The average particle size of the toner $d_t$ | 5.2 [μm] |
| The average particle size of the carrier | 46 [μm] |
| Toner density | 7.5 [wt. %] |
| The diameter of the wire electrode $d_w$ | 0.1 mm |
| The thickness of the film layer on the wire electrode | 0.01 mm |
| The closest distance $D_1$ between the photoreceptor drum and the developing roller | 0.65 mm |
| The closest distance $D_6$ between the wire electrode and the developing roller | 0.3 mm |
| The closest distance $D_7$ between the photoreceptor drum and the wire electrode | 0.43 mm |
| The DC component impressed upon the developing roller $V_{DC}$ | −750 [V] |
| The frequency of the AC component impressed upon the developing roller $f_{AC}$ | 8000 [Hz] |
| The wave form of the AC component impressed upon the developing roller | rectangular wave |
| The latent image voltage on the background portion $V_H$ | −850 [V] |
| The latent image voltage on the solid portion $V_L$ | −50 [V] |
| The moving speed of the developing roller $V_r$ | 350 [mm/sec] |
| The moving speed of the photoreceptor drum $V_p$ | 140 [mm/sec] |
| The radius of the developing roller r | 10 [mm] |
| The radius of the photoreceptor drum | 90 [mm] |
| The angle between the closest location of the photoreceptor drum and the closest location of the wire electrode θ | +10 [°] |
| The thickness of the developer at the closest location of the photoreceptor drum $H_2$ | 0.3 [mm] |
| The thickness of the developer at the closest location of the wire electrode $H_5$ | 0.1 [mm] |

This result is shown in Table 31.

TABLE 31

| $V_{AC}$ [V] | M/A [mg/cm²] | $N_1$ [pcs/mm²] |
|---|---|---|
| 0 | X | ○ |
| 100 | X | ○ |
| 200 | Δ | ○ |
| 300 | ○ | ○ |
| 400 | ○ | ○ |
| 500 | ○ | ○ |
| 600 | ○ | ○ |
| 700 | ○ | ○ |
| 800 | ○ | Δ |
| 900 | ○ | X |
| 1000 | ○ | X |
| 1100 | ○ | X |
| 1200 | ○ | X |
| 1300 | ○ | X |
| 1400 | ○ | X |
| 1500 | ○ | X |

In this example, the values of the equations $8\cdot|Q_t|\cdot d_t\cdot D_1$ and $6\cdot|Q_t|\cdot d_t\cdot D_6$ are 730 and 253.

As shown in Examples 7 through 11, when the value of $V_{AC}$ is set within the range expressed by the following relationship: $8\cdot|Q_t|\cdot d_t\cdot D_1>V_{AC}>6\cdot|Q_t|\cdot d_t\cdot D_6$, then, both the primary adhered amount M/A and the number $N_1$ of fogging toner particles can show excellent results. When $V_{AC}$ is too large, the number $N_1$ of fogging toner particles is increased. Conversely, when $V_{AC}$ is too small, the primary adhered amount M/A is insufficient. In both cases, desired results can not be obtained.

(Example 12)

Conditions of the developing apparatus were set as the same as those of Example 7. The image formation is executed under the condition that the amplitude of the AC component of the composit voltage, which is impressed upon. the developing roller, $V_{AC}$ is fixed at 500 [V], the DC voltage, which is impressed upon the wire electrode, $V_{DEN}$ is being varied, and the the developing apparatus is set to the monochromatic mode. The primary adhered amount M/A and the number of fogging toner particles $N_1$ were measured, and the result was judged as in the same manner of Example 7. This result is shown in Table 32.

TABLE 32

| $V_{DEN}$ [V] | M/A [mg/cm²] | $N_1$ [pcs/mm²] |
|---|---|---|
| −300 | ○ | X |
| −400 | ○ | X |
| −500 | ○ | X |
| −600 | ○ | X |
| −700 | ○ | ○ |
| −800 | ○ | ○ |
| −900 | ○ | ○ |
| −1000 | Δ | ○ |
| −1100 | X | ○ |
| −1200 | X | ○ |
| −1300 | X | ○ |

In this example, the values of the equations $|V_{DC}|+|V_{DC}-V_L|\cdot D_6/D_1$ and $|V_{DC}|-|V_H-V_{DC}|\cdot(D_1-D_6)/D_1$ are 965 and 681.

(Example 13)

Conditions of the developing apparatus were set as the same as those of Example 8. The image formation is executed under the condition that the amplitude of the AC component of the composit voltage, which is impressed upon the developing roller, $V_{AC}$ is fixed at 500 [V], the DC voltage, which is impressed upon the wire electrode, $V_{DEN}$ is being varied, and the the developing apparatus is set to the monochromatic mode. The primary adhered amount M/A and the number of fogging toner particles $N_1$ were measured, and the result was judged as in the same manner of Example 7. This result is shown in Table 33.

TABLE 33

| $V_{DEN}$ [V] | M/A [mg/cm²] | $N_1$ [pcs/mm²] |
|---|---|---|
| −300 | ○ | X |
| −400 | ○ | X |
| −500 | ○ | X |
| −600 | ○ | Δ |
| −700 | ○ | ○ |
| −800 | ○ | ○ |
| −900 | ○ | ○ |
| −1000 | Δ | ○ |
| −1100 | X | ○ |
| −1200 | X | ○ |
| −1300 | X | ○ |

In this example, the values of the equations $|V_{DC}|+|V_{DC}-V_L|\cdot D_6/D_1$ and $|V_{DC}|-|V_H-V_{DC}|\cdot(D_1-D_6)/D_1$ are 965 and 681.

(Example 14)

Conditions of the developing apparatus were set as the same as those of Example 9. The image formation is executed under the condition that the amplitude of the AC component of the composit voltage, which is impressed upon the developing roller, $V_{AC}$ is fixed at 500 [V], the DC voltage, which is impressed upon the wire electrode, $V_{DEN}$ is being varied, and the the developing apparatus is set to the monochromatic mode. The primary adhered amount M/A and the number of fogging toner particles $N_1$ were measured, and the result was judged as in the same manner of Example 7. This result is shown in Table 34.

TABLE 34

| $V_{DEN}$ [V] | M/A [mg/cm²] | $N_1$ [pcs/mm²] |
|---|---|---|
| −300 | ○ | X |
| −400 | ○ | X |
| −500 | ○ | X |
| −600 | ○ | Δ |
| −700 | ○ | ○ |
| −800 | ○ | ○ |
| −900 | ○ | ○ |
| −1000 | ○ | ○ |
| −1100 | ○ | ○ |
| −1200 | X | ○ |
| −1300 | X | ○ |

In this example, the values of the equations $|V_{DC}|+|V_{DC}-V_L|\cdot D_6/D_1$ and $|V_{DC}|-|V_H-V_{DC}|\cdot(D_1-D_6)/D_1$ are 1073 and 696.

(Example 15)

Conditions of the developing apparatus were set as the same as those of Example 10. The image formation is executed under the condition that the amplitude of the AC component of the composit voltage, which is impressed upon the developing roller, $V_{AC}$ is fixed at 500 [V], the DC voltage, which is impressed upon the wire electrode, $V_{DEN}$ is being varied, and the the developing apparatus is set to the monochromatic mode. The primary adhered amount M/A and the number of fogging toner particles $N_1$ were measured, and the result was judged as in the same manner of Example 7. This result is shown in Table 35.

TABLE 35

| $V_{DEN}$ [V] | M/A [mg/cm²] | $N_1$ [pcs/mm²] |
|---|---|---|
| −300 | ○ | X |
| −400 | ○ | X |
| −500 | ○ | X |
| −600 | ○ | Δ |
| −700 | ○ | ○ |
| −800 | ○ | ○ |
| −900 | ○ | ○ |
| −1000 | ○ | ○ |
| −1100 | Δ | ○ |
| −1200 | X | ○ |
| −1300 | X | ○ |

In this example, the values of the equations $|V_{DC}|+|V_{DC}-V_L|\cdot D_6/D_1$ and $|V_{DC}|-|V_H-V_{DC}|\cdot(D_1-D_6)/D_1$ are 1073 and 696.

(Example 16)

Conditions of the developing apparatus were set as the same as those of Example 11. The image formation is executed under the condition that the amplitude of the AC component of the composit voltage, which is impressed upon the developing roller, $V_{AC}$ is fixed at 500 [V], the DC voltage, which is impressed upon the wire electrode, $V_{DEN}$ is being varied, and the the developing apparatus is set to the monochromatic mode. The primary adhered amount M/A and the number of fogging toner particles $N_1$ were measured, and the result was judged as in the same manner of Example 7. This result is shown in Table 36.

TABLE 36

| $V_{DEN}$ [V] | M/A [mg/cm²] | $N_1$ [pcs/mm²] |
|---|---|---|
| −300 | ○ | X |
| −400 | ○ | X |
| −500 | ○ | X |
| −600 | ○ | X |
| −700 | ○ | ○ |
| −800 | ○ | ○ |
| −900 | ○ | ○ |
| −1000 | ○ | ○ |
| −1100 | Δ | ○ |
| −1200 | X | ○ |
| −1300 | X | ○ |

In this example, the values of the equations $|V_{DC}|+|V_{DC}-V_L|\cdot D_6/D_1$ and $|V_{DC}|-|V_H-V_{DC}|\cdot(D_1-D_6)/D_1$ are 1073 and 696.

As shown in Examples 12 through 16, when the value of $|V_{DEN}|$ is set within the range expressed by the following relationship: $|V_{DC}|+|V_{DC}-V_L|\cdot D_6/D_1>|V_{DEN}|>|V_{DC}|-|V_H-V_{DC}|\cdot(D_1-D_6)/D_1$, then, both the primary adhered amount M/A and the number $N_1$ of fogging toner particles can show excellent results. When $|V_{DEN}|$ is too large, the number $N_1$ of fogging toner particles is increased. Conversely, when $|V_{DEN}|$ is too small, the primary adhered amount M/A is insufficient. In both cases, desired results can not be obtained.

(Example 17)

Conditions of each developing apparatus of the image forming apparatus were set as shown in Tables 22, 24, 26 and 28. $V_{DEN}$ of the DC voltage to be impressed upon the wire electrode was set to −850 V in each developing apparatus. The AC component $V_{AC}$ of the composit voltage to be impressed upon the developing roller of each developing apparatus was set as shown in Table 37. Developing was carried out in the sequence of yellow→magenta→cyan→black in the full-color mode, and toner images were superimposed on the photoreceptor drum. The number of other color toners per unit area, in which color toners of yellow, magenta and cyan adhered to each solid portion of each color toner, (hereinafter, called the number of mixed color toners $N_2$ [pcs/mm²]), were measured, and judged on the following criterion. The result is shown in Table 37.

The criterion of evaluation of the mixed color toners $N_2$ [pcs/mm²]:

○ . . . $N_2 \leqq 20$

Δ . . . $20 < N_2 \leqq 40$

X . . . $40 \leqq N_2$

TABLE 37

| $V_{AC}$ [V] | | | | $V_{AC}/D_1$ [V/mm] | | | | $N_2$ [pcs/mm²] | | |
|---|---|---|---|---|---|---|---|---|---|---|
| 3 | M | C | K | Y | M | C | K | Y | M | C |
| 400 | 400 | 400 | 400 | 615 | 615 | 615 | 615 | ○ | ○ | ○ |
| 500 | 500 | 500 | 500 | 769 | 769 | 769 | 769 | ○ | ○ | ○ |
| 600 | 600 | 600 | 600 | 923 | 923 | 923 | 923 | ○ | ○ | ○ |
| 700 | 760 | 700 | 700 | 1077 | 1077 | 1077 | 1077 | ○ | ○ | ○ |

TABLE 37-continued

| $V_{AC}$ [V] | | | | $V_{AC}/D_1$ [V/mm] | | | | $N_2$ [pcs/mm$^2$] | | |
|---|---|---|---|---|---|---|---|---|---|---|
| 3 | M | C | K | Y | M | C | K | Y | M | C |
| 400 | 500 | 600 | 700 | 615 | 769 | 923 | 1077 | ○ | ○ | ○ |
| 700 | 600 | 500 | 400 | 1077 | 923 | 769 | 615 | ○ | ○ | ○ |
| 600 | 500 | 500 | 500 | 923 | 769 | 769 | 769 | ○ | ○ | ○ |
| 500 | 600 | 500 | 500 | 769 | 923 | 769 | 769 | x | ○ | ○ |
| 500 | 500 | 600 | 500 | 769 | 769 | 923 | 769 | x | x | ○ |
| 500 | 500 | 500 | 600 | 769 | 769 | 769 | 923 | x | x | x |
| 400 | 500 | 500 | 500 | 615 | 769 | 769 | 769 | x | ○ | ○ |
| 500 | 400 | 500 | 500 | 769 | 615 | 769 | 769 | ○ | x | ○ |
| 500 | 500 | 400 | 500 | 769 | 769 | 615 | 769 | ○ | ○ | x |
| 500 | 500 | 500 | 400 | 769 | 769 | 769 | 615 | ○ | ○ | ○ |
| 400 | 450 | 500 | 500 | 615 | 692 | 769 | 769 | x | Δ | ○ |
| 500 | 500 | 450 | 400 | 769 | 769 | 692 | 615 | ○ | ○ | ○ |
| 500 | 450 | 450 | 500 | 769 | 692 | 692 | 769 | ○ | Δ | x |
| 450 | 500 | 500 | 450 | 692 | 769 | 769 | 692 | Δ | ○ | ○ |
| 600 | 550 | 500 | 450 | 923 | 846 | 769 | 692 | ○ | ○ | ○ |
| 700 | 650 | 600 | 500 | 1077 | 1000 | 923 | 769 | ○ | ○ | ○ |

Yellow (Y): $V_{DEN}$ = −850 [V], $V_{DC}$ = −750 [V], $V_H$ = −850[V], $D_1$ = 0.65 [MM]
Magenta (M): $V_{DEN}$ = −850 [V], $V_{DC}$ = −750 [V], $V_H$ = −850[V], $D_1$ = 0.65 [MM]
Cyan (C): $V_{DEN}$ = −850 [V], $V_{DC}$ = −750 [V], $V_H$ = −850[V], $D_1$ = 0.65 [MM]
Black (K): $V_{DEN}$ = −850 [V], $V_{DC}$ = −750 [V], $V_H$ = −850[V], $D_1$ = 0.65 [MM]

As the above, when the values of $V_{AC}/D_1$ of the strength of the oscillating electric field in the gap formed between the photoreceptor drum and the developing roller in developing processes of yellow, magenta, cyan and black colors, are set in the following relationship:

$$V_{AC}/D_1(\text{yellow}) \geqq V_{AC}/D_1(\text{magenta}) \geqq V_{AC}/D_1(\text{cyan}) \geqq$$

$V_{AC}/D_1$ (black), then, an excellent multi-color image having no mixing of color can be obtained. On the other hand, when the value of $V_{AC}/D_1$ is set to be larger than the value $V_{AC}/D_1$ in the preceding developing process, the toner developed in the preceding developing process is mixed with the current toner image, and therefore, an excellent image can not be obtained.

(Example 18)

Conditions of each developing apparatus of the image forming apparatus were set as shown in Tables 22, 24, 26 and 28. The value $V_{AC}$ of the amplitude of the AC component of the composit voltage, which is impressed upon the developing roller, is fixed at 500 [V] and the value $V_{DEN}$ of the DC voltage, which is impressed upon the wire electrode, is set as shown in Table 38, in each developing apparatus. Developing was carried out in the sequence of yellow (Y)→magenta (M)→cyan (c)→black (K) in the full-color mode, and toner images were superimposed on the photoreceptor drum. The number of other color toners per unit area, in which color toners of yellow, magenta and cyan adhered to each solid portion of each color toner, the number of mixed color toners $N_2$ [pcs/mm$^2$], were measured, and judged in the same manner of Example 17. The result is shown in Table 38.

TABLE 38

| $V_{DEN}$ [V] | | | | $V_{DEN}$-$V_H/D_7$ [V/mm] | | | | $N_2$ [pcs/mm$^2$] | | |
|---|---|---|---|---|---|---|---|---|---|---|
| 3 | M | C | K | Y | M | C | K | Y | M | C |
| −750 | −750 | −750 | −750 | −222 | −256 | −278 | −345 | x | x | x |
| −800 | −800 | −800 | −800 | −111 | −128 | −139 | −172 | x | Δ | Δ |
| −850 | −850 | −850 | −850 | 0 | 0 | 0 | 0 | ○ | ○ | |
| −900 | −900 | −900 | −900 | 111 | 128 | 139 | 172 | ○ | ○ | ○ |
| −950 | −950 | −950 | −950 | 222 | 256 | 278 | 345 | ○ | ○ | ○ |
| −750 | −850 | −850 | −850 | −222 | 0 | 0 | 0 | ○ | ○ | ○ |
| −850 | −750 | −850 | −850 | 0 | −256 | 0 | 0 | x | ○ | ○ |
| −850 | −850 | −750 | −850 | 0 | 0 | −278 | 0 | x | x | ○ |
| −850 | −850 | −850 | −750 | 0 | 0 | 0 | −345 | x | x | x |
| −900 | −850 | −850 | −850 | 111 | 0 | 0 | 0 | x | ○ | ○ |
| −850 | −900 | −850 | −850 | 0 | 128 | 0 | 0 | ○ | x | ○ |
| −850 | −850 | −900 | −850 | 0 | 0 | 139 | 0 | ○ | ○ | x |
| −850 | −850 | −850 | −900 | 0 | 0 | 0 | 172 | ○ | ○ | ○ |
| −950 | −850 | −850 | −850 | 222 | 0 | 0 | 0 | x | ○ | ○ |
| −850 | −950 | −850 | −850 | 0 | 256 | 0 | 0 | ○ | x | ○ |
| −850 | −850 | −950 | −850 | 0 | 0 | 278 | 0 | ○ | ○ | x |
| −850 | −850 | −850 | −950 | 0 | 0 | 0 | 345 | ○ | ○ | ○ |
| −850 | −800 | −750 | −700 | 0 | −128 | −278 | −517 | x | x | x |
| −700 | −750 | −800 | −850 | −517 | −278 | −128 | 0 | ○ | ○ | ○ |
| −950 | −900 | −850 | −750 | 222 | 128 | 0 | −345 | x | x | x |
| −750 | −850 | −900 | −950 | −345 | 0 | 128 | 222 | ○ | ○ | ○ |

Yellow (Y): $V_{AC}$ = 500 [V], $V_{DC}$ = −750 [V], $V_H$ = −850 [V], $D_7$ = 0.45 [MM]
Magenta (M): $V_{AC}$ = 500 [V], $V_{DC}$ = −750 [V], $V_H$ = −850 [V], $D_7$ = 0.39 [MM]
Cyan (C): $V_{AC}$ = 500 [V], $V_{DC}$ = −750 [V], $V_H$ = −850 [V], $D_7$ = 0.36 [MM]
Black (K): $V_{AC}$ = 500 [V], $V_{DC}$ = −750 [V], $V_H$ = −850 [V], $D_7$ = 0.29 [MM]

As the above, when the values of $V_{DEN}$−$V_H/D_7$ of the strength of the DC electric field in the gap formed between the photoreceptor drum and the wire electrode in developing processes of yellow, magenta, cyan and black colors, are set in the following relationship:

$$(|V_{DEN}|-|V_H|)/D_7(\text{yellow}) \leqq (|V_{DEN}|-|V_H|)/D_7(\text{magenta}) \leqq (|V_{DEN}|-|V_H|)/D_7(\text{cyan}) \leqq (|V_{DEN}|-|V_H|)/D_7(\text{black})$$

, then, an excellent multi-color image having no mixing of color can be obtained. On the other hand, when the value of $(|V_{DEN}|-|V_H|)/D_7$ is set to be larger than the value $(|V_{DEN}|-|V_H|)/D_7$ in the preceding developing process, the toner developed in the preceding developing process is mixed with the current toner image, and therefore, an excellent image can not be obtained.

As described above, according to the developing apparatus and the image forming apparatus of the present invention, a developing apparatus can be provided, in which the developability is higher and no fogging occurs in the background portion even when small particle-size toners are used, and in which no mixing of color occurs and excellent developing can be carried out even at the time of the multi-color toner image superimposition development. Further, in the color image forming apparatus in which toner images are simultaneously transferred after multi-color toner images have been superimposed and developed on the photoreceptor drum, a high quality multi-color image, in which density is higher, and no mixing of color occurs, can be obtained.

What is claimed is:

1. A development apparatus for developing a latent image formed on an image forming body with a developer so as to obtain a toner image, comprising:

a developer conveyance means for conveying said developer, including a toner, to a development zone, between said developer conveyance means and said image forming body, from an upstream side of said development zone in a conveyance direction to a downstream side thereof;

a plate member having an electrode portion, positioned at said upstream side of said development zone, wherein a downstream end portion of said plate member is positioned in contact with said development zone; and a power supply means for applying a first voltage, including a DC component and an AC component, to said developer conveyance means so that an electric field is generated at said development zone, said power supply means applying a second voltage, including a DC component, to said electrode portion of said plate member;

said plate member for controlling said electric field with said second voltage; said development apparatus satisfies:

$$V_{AC}>|V_{DEN}|-|V_{DC}|$$

when an amplitude of said AC component of said first voltage is defined as $V_{AC}$ (volts), said DC component of said first voltage is defined as $V_{DC}$ (volts), and said DC component of said second voltage is defined as $V_{DEN}$ (volts); and said development apparatus satisfies:

$$10\cdot|Q_t|\cdot d_t\cdot D_1>V_{AC}>5\cdot|Q_t|\cdot d_t\cdot D_2$$

when a closest distance from said developer conveyance means to said image forming body is defined as $D_1$ (mm), a closest distance from said developer conveyance means to said electrode portion is defined as $D_2$ (mm), an average charge-to-mass of said toner is defined as $Q_t$ (μC/g), and an average particle size of said toner is defined as $d_t$ (μm).

2. The apparatus of claim 1, further satisfying:

$$f_{AC}\geqq 10\cdot V_r/L_1$$

when a frequency of said AC component of said first voltage is defined as $f_{AC}$ (Hz), a moving speed of said developer conveyance means is defined as $V_r$ (mm/sec), and a width of said electrode portion in said conveyance direction of said developer conveyance means is defined as $L_1$ (mm).

3. The apparatus of claim 1, further satisfying:

$$D_4>D_2=D_5>H_1$$

when a closest distance from said developer conveyance means to an end portion of said electrode portion on said downstream side of said conveyance direction is defined as D4 (mm), a closest distance from said developer conveyance means to an end portion of said electrode portion on said upstream side of said conveyance direction is defined as D5 (mm), and a thickness of a developer layer at a contacting point of said developer on said developer conveyance means with said plate member is defined as $H_1$ (mm).

4. The apparatus of claim 3, further satisfying:

$$D_4\geqq D_3>H_2$$

and $$0.6\cdot D_1\geqq D_3\geqq 0.2\cdot D_1$$

when a closest distance from said developer conveyance means to an end portion of said plate member on said downstream side of said conveyance direction is defined as $D_3$ (mm), and a thickness of a developer layer at a closest distance between said image forming body and said developer conveyance means is defined as $H_2$ (mm).

5. The apparatus of claim 1, further satisfying:

$$L_3>L_1>L_2O$$

when a width of said electrode portion in said conveyance direction of said developer conveyance means is defined as $L_1$ (mm), a distance between an end portion of said electrode portion on said downstream side of said conveyance direction and an end portion of said plate member on said downstream side of said conveyance direction is defined as $L_2$ (mm), and a distance between a contacting point of said toner on said developer conveyance means with said plate member and an end portion of said plate member on said downstream side of said conveyance direction is defined as $L_3$ (mm).

6. The apparatus of claim 5, wherein said plate member includes said electrode portion and a coating layer which are formed on an insulating base material; and said apparatus further satisfying:

$$L_3>L_4\geqq L_1+L_2$$

when a width of said coating layer in said conveyance direction is defined as $L_4$ (mm).

7. The apparatus of claim 1, further satisfying:

$$r\cdot(1-\cos\theta)\geqq D_1$$

and $$r\cdot\sin\theta\geqq L_3\cdot\cos\theta$$

when a radius curvature of said developer conveyance means at a developing area is defined as r (mm), an angle, created by a line through a radius center of said developer conveyance means and a closest point of said developer conveyance means to said image forming body and a line through said radius center and a contact point of said plate member to said developer on said developer conveyance means, is defined as θ (°).

8. The apparatus of claim 1, further satisfying:

$$W_1>W_3>W_2>W_4$$

when a width of said plate member in a direction perpendicular to said conveyance direction is defined as $W_1$ (mm), a width of said electrode portion in a direction perpendicular to said conveyance direction is defined as $W_2$ (mm), a width of said developer, conveyed on said developer conveyance means, in a direction perpendicular to said conveyance direction is defined as $W_3$ (mm), and a width of said latent image, formed on said image forming body, in a direction perpendicular to said conveyance direction is defined as $W_4$ (mm).

9. A development apparatus for developing a latent image formed on an image forming body with a developer so as to obtain a toner image, comprising:

a developer conveyance means for conveying said developer, including a toner, to a development zone, between said developer conveyance means and said image forming body, from an upstream side of said development zone in a conveyance direction to a downstream side thereof;

a plate member having an electrode portion, positioned at said upstream side of said development zone, wherein a downstream end portion of said plate member is positioned in contact with said development zone; and a power supply means for applying a first voltage, including a DC component and an AC component, to said developer conveyance means so that an electric field is generated at said development zone, said power supply means applying a second voltage, including a DC component, to said electrode portion of said plate member;

said plate member for controlling said electric field with said second voltage; said development apparatus satisfies:

$$V_{AC}>|V_{DEN}|-|V_{DC}|$$

when an amplitude of said AC component of said first voltage is defined as $V_{AC}$ (volts), said DC component of said first voltage is defined as $V_{DC}$ (volts), and said DC component of said second voltage is defined as $V_{DEN}$ (volts); and said development apparatus satisfies:

$$|V_H|>|V_{DC}|>|V_L|$$

and $$|V_{DC}|+|V_{DC}-V_L|\cdot D_3/D_1>|V_{DC}|>|V_{DC}|-|V_H-V_{DEC}|\cdot(1-D_3/D_1)$$

when a closest distance from said developer conveyance means to said image forming body is defined as $D_1$ (mm), a closest distance from said developer conveyance means to an end portion of said plate member on said downstream side in said conveyance direction is defined as $D_3$ (mm), a latent image electric potential at a solid portion thereof on said image forming body is defined as $V_L$ (volts), and a latent image electric potential at a background portion thereof on said image forming body is defined as $V_H$ (volts).

10. The apparatus of claim 9, further satisfying:

$$f_{AC}\geqq 10\cdot V_r/L_1$$

when a frequency of said AC component of said first voltage is defined as $f_{AC}$ (Hz), a moving speed of said developer conveyance means is defined as $V_r$ (mm/sec), and a width of said electrode portion in said conveyance direction of said developer conveyance means is defined as $L_1$ (mm).

11. The apparatus of claim 9, further satisfying:

$$D_4>D_2=D_5>H_1$$

when a closest distance from said developer conveyance means to said electrode portion is defined as $D_2$ (mm), a closest distance from said developer conveyance means to an end portion of said electrode portion on said downstream side of said conveyance direction is defined as $D_4$ (mm), a closest distance from said developer conveyance means to an end portion of said electrode portion on said upstream side of said conveyance direction is defined as $D_5$ (mm), and a thickness of a developer layer at a contacting point of said developer on said developer conveyance means with said plate member is defined as $H_1$ (mm).

12. The apparatus of claim 11, further satisfying:

$$D_4\geqq D_3\geqq H_2$$

and $$0.6\cdot D_1\geqq D_3\geqq 0.2D_1$$

when a thickness of a developer layer at a closest distance between said image forming body and said developer conveyance means is defined as $H_2$ (mm).

13. The apparatus of claim 9, further satisfying:

$$L_3>L_1>L_2\geqq 0$$

when a width of said electrode portion in said conveyance direction of said developer conveyance means is defined as $L_1$ (mm), a distance between an end portion of said electrode portion on said downstream side of said conveyance direction and an end portion of said plate member on said downstream side of said conveyance direction is defined as $L_2$ (mm), and a distance between a contacting point of said toner on said developer conveyance means with said plate member and an end portion of said plate member on said downstream side of said conveyance direction is defined as $L_3$ (mm).

14. The apparatus of claim 13, wherein said plate member includes said electrode portion and a coating layer which are formed on an insulating base material; and said apparatus further satisfying:

$$L_3>L_4\geqq L_1+L_2$$

when a width of said coating layer in said conveyance direction is defined as $L_4$ (mm).

15. The apparatus of claim 9, further satisfying:

$$r\cdot(1-\cos\theta)\geqq D_1$$

and $$r\cdot\sin\theta\geqq L_3\cdot\cos\theta$$

when a radius curvature of said developer conveyance means at a developing area is defined as r (mm), an angle, created by a line through a radius center of said developer conveyance means and a closest point of said developer conveyance means to said image forming body and a line through said radius center and a contact point of said plate member to said developer on said developer conveyance means, is defined as θ (°).

16. The apparatus of claim 9, further satisfying:

$$W_1>W_3>W_2>W_4$$

when a width of said plate member in a direction perpendicular to said conveyance direction is defined as $W_1$ (mm), a width of said electrode portion in a direction perpendicular to said conveyance direction is defined as $W_2$ (mm), a width of said developer, conveyed on said developer conveyance means, in a direction perpendicular to said conveyance direction is defined as $W_3$ (mm), and a width of said latent image, formed on said image forming body, in a direction perpendicular to said conveyance direction is defined as $W_4$ (mm).

17. An image forming apparatus, comprising:

an image forming body for forming a latent thereon;

a plurality of development means each for developing said latent image with a respective developer so as to obtain respective a toner image so that said plurality of development means forms a multi-color toner image;

each of said plurality of development means including:

a developer conveyance means for conveying a developer, including said respective toner, to a development zone, between said developer conveyance means and said image forming body, from an upstream side of said development zone in a conveyance direction to a downstream side thereof; and a plate member having an electrode portion, positioned at said upstream side of said development zone, wherein a downstream end portion of said plate member is positioned in contact with said development zone; and a power supply means for applying a first voltage, including a DC component and an AC component, to said developer conveyance means so that an electric field is generated at said development zone, said power supply means applying a second voltage, including a DC component, to said electrode portion of said plate member;

said plate member for controlling said electric field with said second voltage; said development means satisfies:

$$V_{AC}>|V_{DEN}|-|V_{DC}|$$

when an amplitude of said AC component of said first voltage is defined as $V_{AC}$ (volts), said DC component of said first voltage is defined as $V_{DC}$ (volts), and said DC component of said second voltage is defined as $V_{DEN}$ (volts); said development means satisfies:

$$10\cdot|Q_t|\cdot d_t\cdot D_1>V_{AC}>5|Q_t|\cdot d_t\cdot D_2$$

when a closest distance from said developer conveyance means to said image forming body is defined as $D_1$ (mm), a closest distance from said developer conveyance body to said electrode portion is defined as $D_2$ (mm), an average charge-to-mass of said toner is defined as $Q_t$ (μC/g), and an average particle size of said toner is defined as $d_t$ (μm); and an oscillation electric field in one of said plurality of development means is equal to or weaker than an oscillation electric field in other one of said plurality of development means which performs a developing operation after a developing operation of said one of said plurality of development means.

18. An image forming apparatus, comprising:

an image forming body for forming a latent thereon;

a plurality of development means each for developing said latent image with a respective developer so as to obtain respective a toner image so that said plurality of development means forms a multi-color toner image;

each of said plurality of development means including:

a developer conveyance means for conveying a developer, including said respective toner, to a development zone, between said developer conveyance means and said image forming body, from an upstream side of said development zone in a conveyance direction to a downstream side thereof; and a plate member having an electrode portion, positioned at said upstream side of said development zone, wherein a downstream end portion of said plate member is positioned in contact with said development zone; and a power supply means for applying a first voltage, including a DC component and an AC component, to said developer conveyance means so that an electric field is generated at said development zone, said power supply means applying a second voltage, including a DC component, to said electrode portion of said plate member;

said plate member for controlling said electric field with said second voltage; said development means satisfies:

$$V_{AC}>|V_{DEN}|-|V_{DC}|$$

when an amplitude of said AC component of said first voltage is defined as $V_{AC}$ (volts), an absolute value of said DC component of said first voltage is defined as $V_{DC}$ (volts), and an absolute value of said DC component of said second voltage is defined as $V_{DEN}$ (volts); and said development means satisfies:

$$|V_H|>|V_{DC}|>|V_L|$$

and $$|V_{DC}|+|V_{DC}-V_L|\cdot D_3/D_1>|V_{DEN}|>|V_{DC}|-|V_H-V_{DC}|\cdot(1-D_3/D_1)$$

when a closest distance from said developer conveyance means to said image forming body is defined as $D_1$ (mm), a closest distance from said developer conveyance means to an end portion of said plate member on said downstream side in said conveyance direction is defined as $D_3$ (mm), a latent image electric potential at a solid portion thereof on said image forming body is defined as $V_L$ (volts), and a latent image electric potential at a background portion thereof on said image forming body is defined as $V_H$ (volts); and said oscillation electric field in one of said plurality of development means is equal to or weaker than said oscillation electric field in other one of said plurality of development means which performs a developing operation after a developing operation of said one of said plurality of development means.

19. A development apparatus for developing a latent image formed on an image forming body with toner so as to obtain a toner image, comprising:

a developer conveyance means for conveying a developer, including said toner, to a development zone, between said developer conveyance means and said image forming body, from an upstream side of said development zone in a conveyance direction to a downstream side thereof;

a wire electrode positioned in said development zone; and a power supply means for applying a first voltage, including a DC component and an AC component, to said developer conveyance means so that an electric field is generated at said development zone, said power supply means applying a second voltage, including a DC component, to said wire electrode;

said wire electrode for controlling said electric field with said second voltage; said development apparatus satisfies:

$$V_{AC}>|V_{DEN}|-|V_{DC}|$$

when an amplitude of said AC component of said first voltage is defined as $V_{AC}$ (volts), said DC component of said first voltage is defined as $V_{DC}$ (volts), and said DC component of said second voltage is defined as $V_{DEN}$ (volts); said development apparatus satisfies:

$$f_{AC}\geqq 2\cdot V_r/d_w$$

when a frequency of said AC component of said first voltage is defined as $f_{AC}$ (Hz), a moving speed of said developer conveyance body is defined as $V_r$ (mm/sec), and a diameter of said wire electrode is defined as $d_w$ (mm); and said development apparatus satisfies:

$$8\cdot|Q_t|\cdot d_t\cdot D_1>V_{AC}>6\cdot|Q_t|\cdot d_t\cdot D_6$$

when a closest distance from said developer conveyance means to said image forming body is defined as $D_1$ (mm), a closest distance from said developer conveyance means to said wire electrode is defined as $D_6$ (mm), an average charge-to-mass of said toner is defined as $Q_t$ (μC/g), and an average particle size of said toner is defined as $d_t$ (μm).

20. The apparatus of claim 19, further satisfying:

$$f_{AC} \geqq 3 \cdot V_r / d_w$$

when a frequency of said AC component of said first voltage is defined as $f_{AC}$ (Hz).

21. The apparatus of claim 19, wherein said wire electrode includes a coating layer made of an insulating resin, and a thickness of said coating layer is between 0.005 and 0.02 mm.

22. The apparatus of claim 19, further satisfying:

$$D_1 \geqq D_7 > D_6$$

when a closest distance from said image forming body to said wire electrode is defined as $D_7$ (mm).

23. The apparatus of claim 22, further satisfying:

$$0.6 \cdot D_1 \geqq D_6 \geqq 0.2 \cdot D_1.$$

24. The apparatus of claim 19, further satisfying:

$$r \cdot (1 - \cos\theta) \geqq D_1$$

when a radius curvature of said developer conveyance means at a developing area is defined as r (mm), an angle, created by a line through a radius center of said developer conveyance means and a closest point of said developer conveyance means to said image forming body and a line through said radius center of said developer conveyance and a radius center of said wire electrode, is defined as θ (°).

25. The apparatus of claim 19, further satisfying:

$$H_2 \geqq H_5$$

when a thickness of a developer layer at a closest distance between said image forming body and said developer conveyance means is defined as $H_2$ (mm), and a thickness of said developer layer at a closest distance between said wire electrode and said developer conveyance means is defined as $H_2$ (mm).

26. The apparatus of claim 25, further satisfying:

$$4 \cdot H_5 \geqq H_2 \geqq 1.5 \cdot H_5.$$

27. A development apparatus for developing a latent image formed on an image forming body with toner so as to obtain a toner image, comprising:

a developer conveyance means for conveying a developer, including said toner, to a development zone, between said developer conveyance means and said image forming body, from an upstream side of said development zone in a conveyance direction to a downstream side thereof;

a wire electrode positioned in said development zone; and a power supply means for applying a first voltage, including a DC component and an AC component, to said developer conveyance means so that an electric field is generated at said development zone, said power supply means applying a second voltage, including a DC component, to said wire electrode;

said wire electrode for controlling said electric field with said second voltage; said development apparatus satisfies:

$$V_{AC} > |V_{DEN}| - |V_{DC}|$$

when an amplitude of said AC component of said first voltage is defined as $V_{AC}$ (volts), said DC component of said first voltage is defined as $V_{DC}$ (volts), and said DC component of said second voltage is defined as $V_{DEN}$ (volts); said development apparatus satisfies:

$$f_{AC} \geqq 2 \cdot V_r / d_w$$

when a frequency of said AC component of said first voltage is defined as $f_{AC}$ (Hz), a moving speed of said developer conveyance body is defined as $V_r$ (mm/sec), and a diameter of said wire electrode is defined as $d_w$ (nun); and said development apparatus satisfies:

$$|V_H| > |V_{DC}| > |V_L|$$

and $$|V_{DC}| + |V_{DC} - V_L| \cdot D_6/D_1 > |V_{DEN}| > |V_{DC}| - |V_H - V_{DC}| \cdot (1 - D_6/D_1)$$

when a closest distance from said developer conveyance means to said image forming body is defined as $D_1$ (mm), a closest distance from said developer conveyance means to said wire electrode is defined as $D_6$ (mm), a latent image electric potential at a solid portion thereof on said image forming body is defined as $V_L$ (volts), and a latent image electric potential at a background portion thereof on said image forming body is defined as $V_H$ (volts).

28. The apparatus of claim 27, further satisfying:

$$f_{AC} \geqq 3 \cdot V_r / d_w$$

when a frequency of said AC component of said first voltage is defined as $f_{AC}$ (Hz).

29. The apparatus of claim 28, further satisfying:

$$r \cdot (1 - \cos\theta) \geqq D_1$$

when a radius curvature of said developer conveyance means at a developing area is defined as r (mm), an angle, created by a line through a radius center of said developer conveyance means and a closest point of said developer conveyance means to said image forming body and a line through said radius center of said developer conveyance and a radius center of said wire electrode, is defined as θ (°).

30. The apparatus of claim 27, wherein said wire electrode includes a coating layer made of an insulating resin, and a thickness of said coating layer is between 0.005 and 0.02 mm.

31. The apparatus of claim 27, further satisfying:

$$D_1 \geqq D_7 > D_6$$

when a closest distance from said image forming body to said wire electrode is defined as $D_7$ (mm).

32. The apparatus of claim 31, further satisfying:

$$0.6 \cdot D_1 \geqq D_6 \geqq 0.2 \cdot D_1.$$

33. The apparatus of claim 27, further satisfying:

$$H_2 \geqq H_5$$

when a thickness of a developer layer at a closest distance between said image forming body and said developer conveyance means is defined as $H_2$ (mm), and a thickness of said developer layer at a closest distance between said wire electrode and said developer conveyance means is defined as $H_5$ (mm).

34. The apparatus of claim 33, further satisfying:

$$4 \cdot H_5 \geqq H_2 \geqq 1.5 \cdot H_5.$$

35. An image forming apparatus, comprising:

an image forming body for forming a latent thereon;

a plurality of development means each for developing said latent image with a respective toner so as to obtain respective a toner image so that said plurality of development means forms a multi-color toner image;

each of said plurality of development means including:

a developer conveyance means for conveying a developer, including said respective toner, to a development zone, between said developer conveyance means and said image forming body, from an upstream side of said development zone in a conveyance direction to a downstream side thereof; and a wire electrode positioned in said development zone; and a power supply means for applying a first voltage, including a DC component and an AC component, to said developer conveyance means so that an electric field is generated at said development zone, said power supply means applying a second voltage, including a DC component, to said wire electrode;

said wire electrode for controlling said electric field with said second voltage; said development means satisfies:

$$V_{AC} > |V_{DEN}| - |V_{DC}|$$

when an amplitude of said AC component of said first voltage is defined as $V_{AC}$ (volts), said DC component of said first voltage is defined as $V_{DC}$ (volts), and said DC component of said second voltage is defined as $V_{DEN}$ (volts); and said development means satisfies:

$$V_{AC}(n)/D_1(n) \geqq V_{AC}(n+1)/D_1(n+1)$$

when an amplitude of said AC component of said first voltage and a closest distance from said developer conveyance means to said image forming body, in a developing process of n-th time, are respectively defined as $V_{AC}(n)$ (volts) and $D_1(n)$ (mm), and an amplitude of said AC component of said first voltage and a closest distance from said developer conveyance means to said image forming body, in a developing process of (n+1)th time, are respectively defined as $V_{AC}(n+1)$ (volts) and $D_1(n+1)$ (mm).

36. An image forming apparatus, comprising:

an image forming body for forming a latent thereon;

a plurality of development means each for developing said latent image with a respective toner so as to obtain respective a toner image so that said plurality of development means forms a multi-color toner image;

each of said plurality of development means including:

a developer conveyance means for conveying a developer, including said respective toner, to a development zone, between said developer conveyance means and said image forming body, from an upstream side of said development zone in a conveyance direction to a downstream side thereof; and a wire electrode positioned in said development zone; and a power supply means for applying a first voltage, including a DC component and an AC component, to said developer conveyance means so that an electric field is generated at said development zone, said power supply means applying a second voltage, including a DC component, to said wire electrode;

said wire electrode for controlling said electric field with said second voltage; said development means satisfies:

$$V_{AC} > |V_{DEN}| - |V_{DC}|$$

when an amplitude of said AC component of said first voltage is defined as $V_{AC}$ (volts), said DC component of said first voltage is defined as $V_{DC}$ (volts), and said DC component of said second voltage is defined as $V_{DEN}$ (volts); and said development means satisfies:

$$(|V_{DEN}(n+1)| - |V_H(n+1)|)/D_6(n+1) \geqq (|V_{DEN}(n)| - |V_H(n)|)/D_6(n)$$

when said DC component of said second voltage, a latent image electric potential at a background portion thereof on said image forming body, and a closest distance from said developer conveyance body to said wire electrode, in a developing process of n-th time, are respectively defined as $V_{DEN}(n)$ (volts), $V_H(n)$ (volts), $D_6(n)$ (mm), and said DC component of said second voltage, a latent image electric potential at a background portion thereof on said image forming body, and a closest distance from said developer conveyance body to said wire electrode, in a developing process of (n+1)th time, are respectively defined as $V_{DEN}(n+1)$ (volts), $V_H(n+1)$ (volts), $D_6(n+1)$ (mm).

* * * * *